US006472132B1

(12) United States Patent
Yamada et al.

(10) Patent No.: US 6,472,132 B1
(45) Date of Patent: Oct. 29, 2002

(54) SILVER HALIDE PHOTOGRAPHIC LIGHT-SENSITIVE MATERIAL AND PROCESSING METHOD THEREOF

(75) Inventors: Kohzaburoh Yamada; Hirokazu Kyota; Masahiko Taniguchi; Takashi Hoshimiya; Tetsuo Yamaguchi; Ken-ichi Kuwabara; Toshihide Ezoe, all of Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/664,439

(22) Filed: Sep. 18, 2000

(30) Foreign Application Priority Data

| | | |
|---|---|---|
| Sep. 17, 1999 | (JP) | 263833/19999 |
| Sep. 17, 1999 | (JP) | 263901/1999 |
| Sep. 17, 1999 | (JP) | 263997/1999 |
| Oct. 8, 1999 | (JP) | 288772/1999 |

(51) Int. Cl.[7] ..... G03C 1/06

(52) U.S. Cl. ..... 430/543; 430/544; 430/546; 430/599; 430/600; 430/601; 430/607

(58) Field of Search ..... 430/543, 544, 430/546, 599, 600, 601, 607

(56) References Cited

U.S. PATENT DOCUMENTS 5,972,577 A * 10/1999 Komatsu et al. ..... 430/401

FOREIGN PATENT DOCUMENTS

| | | | |
|---|---|---|---|
| JP | A-4-278939 | | 10/1992 |
| JP | A-5-45767 | | 2/1993 |
| JP | A-5-45819 | | 2/1993 |
| JP | 05-045819 | * | 2/1993 |
| JP | 06-175253 | * | 6/1994 |
| JP | 11-184099 | * | 7/1999 |

OTHER PUBLICATIONS

Patent Abstracts of Japan for JP–A–5–45767.
Patent Abstracts of Japan for JP–A–5–45819.
English–language abstract of EP0495477 B1 (corresponding to JP–A–4–278939).

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

There is disclosed a silver halide photographic light-sensitive material comprising at least one compound selected from the group consisting of the compounds represented by the following formula (1), (2) or (3):

formula (1)

formula (2)

formula (3)

wherein $R_1$ represents a phenyl, aromatic heterocyclic or aliphatic group, having at least one electron-withdrawing group as a substituent, PUG represents a residue of a development inhibitor, $Y_1$ and $Z_1$ respectively represent a substituent which is substitutable on a benzene ring, and n1 and p1 denote integers from 0 to 4, Ar represents an aryl group or an aromatic heterocyclic group, PUG represents a residue of a development inhibitor, TIME represents a timing group and t denotes 0 or 1, A represents a connecting group, m denotes an integer from 2 to 6. According to the silver halide photographic light-sensitive material, an image having excellent photographic properties such as high sensitivity, high contrast (for example, γ is 10 or more) and high Dmax can be formed and it also has good original reproduction in the formation of an image.

21 Claims, No Drawings

SILVER HALIDE PHOTOGRAPHIC LIGHT-SENSITIVE MATERIAL AND PROCESSING METHOD THEREOF

FIELD OF THE INVENTION

The present invention relates to a silver halide photographic light-sensitive material and an image-forming method using the light-sensitive material. Particularly, the present invention relates to a silver halide light-sensitive material to form an ultra-high contrast photographic image that is used in the fields of graphic art, and to an image-forming method using the light-sensitive material.

BACKGROUND OF THE INVENTION

In a photomechanical process in the fields of graphic art, a method is used in which a photographic Ad image having continuous tone is converted into a so-called dot image, which expresses the contrast of an image by the size of a dot area, and this dot image is combined with an image obtained by taking photographs of character and line originals, to produce a printing original plate. It has been demanded that silver halide light-sensitive materials used for such a purpose have ultra-high contrast (particularly, γ is 10 or more) photographic properties enabling clear separation of image portions from non-image portions, to improve the reproduction of characters, line originls, and dot images.

In the fields of graphic art, image-forming systems obtaining ultra-high contrast (particularly, γ is 10 or more) photographic properties are disired, to obtain good reproduction of continuous tone images by dot images.

As a method for obtaining high-contrast photographic properties, a lithographic developing system, making use of the so-called "infectious development effect", has long been used. However, this system is very unstable with respect to oxidation of a developer by air, since the density of sulfurous ions in the developer is low, requiring much replenisher to keep the liquid activity stable.

Examples of an image-forming system that eliminates the instability of the lithographic developing system in the formation of an image, that ensures processing using a developer having high storage stability, and that makes it possible to obtain ultra-high contrast photographic properties, include systems described in U.S. Pat. Nos. 4,166,742, U.S. Pat. No. 4,168,977, U.S. Pat. No. 4,221,857, U.S. Pat. No. 4,224,401, U.S. Pat. No. 4,243,739, U.S. Pat. No. 4,269,922, U.S. Pat. No. 4,272,606, U.S. Pat. No. 4,311,781, U.S. Pat. No. 4,332,878, U.S. Pat. No. 4,618,574, U.S. Pat. No. 4,634,661, U.S. Pat. No. 4,681,836 and U.S. Pat. No. 5,650,746. In these systems, a surface-latent-image-type silver halide photographic light-sensitive material, to which a hydrazine derivative is added, is processed by a developer using, as the developing agent, hydroquinone/Metol or hydroquinone/phenidone having a pH of 11.0 to 12.3 and containing a sulfurous acid preservative in an amount of 0.15 mol/liter or more, to form an ultra-high contrast negative image having a γ value exceeding 10. According to this method, ultra-high contrast and highly sensitive photographic properties can be obtained, and because a sulfite with a high concentration can be added in a developer, the stability of the developer against oxidation by air is extremely improved compared with the stability of a conventional lithographic developer.

Meanwhile, in the fields of photomechanical processes, there are demands for photographic light-sensitive materials excellent in image reproduction of an original, stable processing solutions, facilitated replenishment, and the like, to deal with the variation and complexity of printed products.

Particularly, originals to be used for a line portion-containing photographic step are made by applying photocomposition characters, handwriting characters, illustrations, and dotted photographs. In the originals, therefore, images differing in density and line width are intermingled, and there is hence a strong demand for a process camera, a photographic light-sensitive material, and an image-forming method that enable these originals to be reproduced with good image reproduction. In a mechanical process for catalogues or large-scale posters, expansion (division extension) or contraction (division contraction) of a dot photograph is widely practiced. In a mechanical process in which dots are expanded and used, the line density is roughened, leading to photography with blurred points. In a mechanical process in which dots. are contracted, the number of lines per inch is larger than that of the original, leading to photography of fine points. Therefore, an image-forming method having a wider latitude is needed, to keep the reproduction of dot gradation. In order to improve, particularly, the reproduction of dot images in the expansion (division extension) or contraction (division contraction) of a photograph composed of dots, and the reproduction of characters of originals in which Mincho/Gothic characters are intermingled, an image-forming method is sought that has a wide latitude not only providing ultra-high contrast photographic properties but also enabling reproduction of fine line image of originals and exact reproduction of dot images ranging from large dots to small dots.

To improve original reproduction, JP-A-3-39952 (the term "JP-A-" as used herein means an unexamined published Japanese patent application), JP-A-3-174143, JP-A-4-19647, or the like disclose a method in which an ultra-high contrast silver halide light-sensitive material having a multilayer structure, which includes a layer containing a redox compound that releases a development inhibitor by oxidation, and a light-sensitive silver halide emulsion layer containing a hydrazine derivative, is processed in a developer having a pH of 11 or more. In this method, the original reproduction is remarkably improved.

The above method, in which a surface-latent-image-type silver halide photographic light-sensitive material, to which a hydrazine derivative is added, is processed in a developer having a pH of 11.0 to 12.3, makes it possible to improve the stability of a developer by using a high-density sulfurous acid preservative. However, in order to obtain an ultra-high contrast photographic image, it is necessary to use a developer having a relatively high pH value. In this case, the developer tends to be oxidized by air, and it is therefore necessary to replenish a large amount of a developer. In view of this, various ideas, in which an ultra-high contrast photographic image-forming system utilizing nuclei formation developing of a hydrazine compound is realized using a developer having a lower pH, have been attempted.

In order to obtain an ultra-high contrast image by using a stable developer having a pH of less than 11.0, a method using a highly active hydrazine-type nucleating agent, and a nucleation accelerator, is disclosed in U.S. Pat. No. 4,269,929 (JP-A-61-267759), U.S. Pat. No. 4,737,452 (JP-A-60-179734), U.S. Pat. No. 5,104,769, and U.S. Pat. No. 4,798,780; JP-A-1-179939 and JP-A-1-179940; U.S. Pat. No. 4,998,604 and U.S. Pat. No. 4,994,365, and JP-A-8-272023.

In the processing using such an image-forming system, improvements in sharp dot quality and process stability are observed. However, further improvement is needed in view of reproduction of an original and a wide exposure latitude. Also, the above method cannot be said to be satisfactory in the point of original reproduction in the case of using the aforementioned redox compound that releases a development inhibitor by oxidation. There is a strong need to develop light-sensitive materials having higher original reproduction. Also, in view of environmental problems, which have been greatly emphasized in recent years, there is a strong need to develop light-sensitive materials that have small variation in the photographic properties, and that also have small variation in original reproduction, with variation in the composition of a developer, to decrease developer waste.

Meanwhile, Japanese patent No. 2709760 discloses a hydrazine-type redox compound that includes two sulfonamido groups and four or more repeating units of an ethyleneoxy group, and JP-A-9-269553 discloses a hydrazine-type redox compound that includes two sulfonamido groups in its molecule. However, these compounds also afford no possibility for producing silver halide photographic light-sensitive materials that have good reproduction of an original and are reduced in variations in photographic properties and in original reproduction with a variation in the composition of a developer, when processed in a low-pH developer.

In addition, Japanese patent No. 2656924 discloses a hydrazine-type redox compound containing a carboxyl group, and Japanese patent No. 2676439 discloses a hydrazine-type redox compound containing a sulfo group. However, even these compounds do not succeed in satisfying the requirement of silver halide photographic light-sensitive materials that have good reproduction of an original and suppressed black-spots, and that also have high sensitivity and contrast.

JA-P-4-122926, JP-A-7-43867, and JP-A-7-261310 disclose methods in which a light-sensitive material having a multilayer structure, comprising a layer containing a redox compound that releases a development inhibitor by oxidation, and a light-sensitive silver halide emulsion layer containing a hydrazine derivative and a nucleation development accelerator, is processed in a developer having a pH of 11 or less, to form an image improved in original reproduction.

As outlined above,improvement in original reproduction is a permanent object for light-sensitive materials used in graphic art, and there is a strong need for development of a system showing better reproduction of an original.

SUMMARY OF THE INVENTION

A first object of the present invention is to provide a silver halide photographic light-sensitive material that has high sensitivity, high contrast (e.g., γ is 10 or more), and high maximum density (high Dmax) as its photographic properties, and that also shows excellent original reproduction.

A second object of the present invention is, in addition to the above object, to provide a silver halide photographic light-sensitive material that is reduced in the variations of sensitivity, γ, and Dmax, and that shows also excellent original reproduction, even if it is processed in a developer in which the density of sulfurous acid, introduced as a preservative, is decreased and the pH is changed by deterioration over time, or even if it is processed in a developer in which the pH is changed and the density of bromine ions is increased due to processing of a large number of films.

A third object of the present invention is to provide a silver halide photographic light-sensitive material that provides a highly stable and high-contrast image.

A fourth object of the present invention is to provide a silver halide photographic light-sensitive material having good dot quality and excellent original reproduction.

A fifth object of the present invention is to provide an image-forming method ensuring high sensitivity, w high contrast, and high Dmax, as photographic properties, and also excellent original reproduction.

A sixth object of the present invention, in addition to the above objects, is to provide a method of forming an image having wide exposure latitude and high dot quality.

Other and further objects, features, and advantages of the invention will appear more fully from the following description.

DETAILED DESCRIPTION OF THE INVENTION

These objects of the present invention were attained by the following measures.

(1) A silver halide photographic light-sensitive material comprising at least one compound selected from the group consisting of the compounds represented by the following formula (1), (2) or (3):

formula (1)

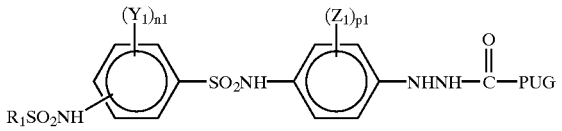

wherein $R_1$ represents a phenyl group having at least one electron-withdrawing group as a substituent, or aromatic heterocyclic or aliphatic group, provided that when $R_1$ is an alkyl group, it does not contain 4 or more repeating units of an ethyleneoxy group, PUG represents a residue of a development inhibitor, $Y_1$ and $Z_1$ respectively represent a substituent which is substitutable on a benzene ring, and n1 and p1 denote integers from 0 to 4;

formula (2)

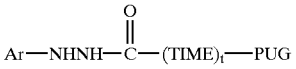

wherein Ar represents an aryl group or an aromatic heterocyclic group, PUG represents a residue of a development inhibitor, TIME represents a timing group and t denotes 0 or 1, wherein the group represented by Ar is substituted directly or indirectly by at least one dissociating group;

formula (3)

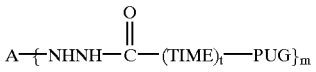

wherein A represents a connecting group, m denotes an integer from 2 to 6, PUG represents a residue of a development inhibitor, TIME represents a timing group and t denotes 0 or 1.

(2) The silver halide photographic light-sensitive material as described in (1), comprising at least one of the compounds represented by the formula (1).

(3) The silver halide photographic light-sensitive material as described in (2), wherein $R_1$ in the formula (1) is a phenyl group having at least one electron-withdrawing group as a substituent.

(4) The silver halide photographic light-sensitive material as described in (2), wherein the compound represented by the formula (1) has, as a substituent, at least one ballasting group or an (alkyl, aryl or heterocyclic)thio group.

(5).The silver halide photographic light-sensitive material as described in (1), comprising at least one redox compound represented by the formula (2).

(6) The silver halide photographic light-sensitive material as described in (5), wherein the redox compound represented by the formula (2) is represented by the following formula (2-1):

formula (2-1)

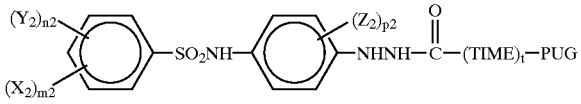

wherein TIME, t, and PUG respectively have the same meaning as those in the formula (2), $X_2$ represents a dissociating group or a substituent containing at least one dissociating group, $Y_2$ and $Z_2$ respectively represent a substituent which is substitutable on a benzene ring, m2 denotes an integer from 1 to 5, n2 and p2 denotes integers from 0 to 4, provided that the sum of m2 and n2 does not exceed 5 and when $X_2$ includes a sulfo group (—$SO_3H$) or its salt, it does not contain a pyridinio group as a substituent at the same time.

(7) The silver halide photographic light-sensitive material as described in (6), wherein the dissociating group in the formula (2-1) is selected from the group consisting of a carboxy group (—COOH), a sulfo group (—$SO_3H$), —$SO_2NH_2$, —$SO_2NHCO$—, —$SO_2NHCONH$—, —$NHSO_2NHCO$—, —CONHCO—, —$SO_2NHSO_2$—, and salts of these.

(8) The silver halide photographic light-sensitive material as described in (5), wherein the redox compound represented by the formula (2) contains at least one ballasting group as a substituent.

(9) The silver halide photographic light-sensitive material as described in (6) or (7), wherein at least one group represented by $X_2$ or $Y_2$ in the formula (2-1) is a ballasting group or a substituent substituted with a ballasting group.

(10) The silver halide photographic light-sensitive material as described in (5), wherein the redox compound represented by the formula (2) contains at least one alkylthio group, arylthio group or heterocyclic thio group as a substituent.

(11) The silver halide photographic light-sensitive material as described in (6) or (7), wherein at least one group represented by $X_2$ or $Y_2$ in the formula (2-1) is a substituent substituted with an alkylthio group, an arylthio group or a heterocyclic thio group.

(12) The silver halide photographic light-sensitive material as described in (1), comprising at least one redox compound represented by the formula (3).

(13) The silver halide photographic light-sensitive material as described in (12)i wherein the redox compound represented by the formula (3) is represented by the following formula (3-1) or (3-2):

formula (3-1)

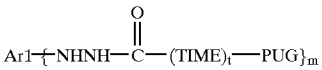

-continued formula (3-2)

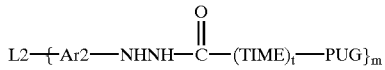

wherein Ar1 represents an m-valent aromatic or aromatic heterocyclic group, Ar2 represents a divalent aromatic or aromatic heterocyclic group, L2 represents an m-valent connecting group, and PUG, TIME, t and m respectively have the same meaning as those in the formula (3).

(14) The silver halide photographic light-sensitive material as described in (13), wherein the redox compound represented by the formula (3-2) is represented by the following formula (3-3) or (3-4):

formula (3-3)

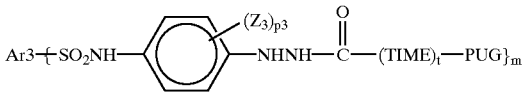

formula (3-4)

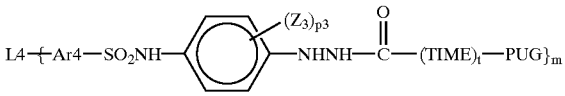

wherein Ar3 represents an m-valent aromatic or aromatic heterocyclic group, Ar4 represents a divalent aromatic or aromatic heterocyclic group, L4 represents an m-valent connecting group, TIME, t, PUG, and m respectively have the same meaning as those in the formula (3), $Z_3$ represents a substituent which is substitutable on a benzene ring, and p3 denotes an integer from 0 to 4.

(15) The silver halide photographic light-sensitive material as described in any one of (12) to (14), wherein the redox compound is made to be contained by solid dispersion or polymer dispersion.

(16) The silver halide photographic light-sensitive material as described in any one of (1) to (15), comprising at least one nucleating agent.

(17) The silver halide photographic light-sensitive material as described in (16), comprising at least one nucleation accelerator.

(18) The silver halide photographic light-sensitive material as described in (17), comprising at least one quaternary salt compound represented by the formula (a), (b), (c), (d), (e) or (f):

formula (a)

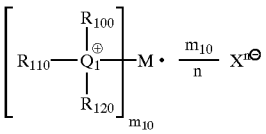

formula (b)

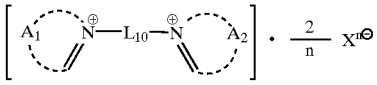

formula (c)

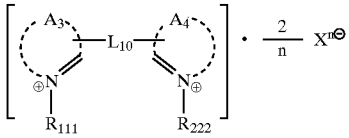

-continued formula (d)

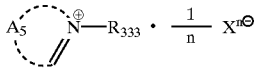

in the formula (a), $Q_1$ represents a nitrogen atom or a phosphorous atom, $R_{100}$, $R_{110}$ and $R_{120}$ respectively represent an aliphatic group, an aromatic group or a heterocyclic group and may be combined to form a ring structure, and M represents an $m_{10}$-valent organic group which is combined with $Q_1^+$ by a carbon atom contained in M wherein $m_{10}$ denotes an integer from 1 to 4;

in the formula (b), (c) or (d), $A_1$, $A_2$, $A_3$, $A_4$ and $A_5$ respectively represent an organic residue for forming an unsaturated hetero ring containing a quaternary nitrogen atom, $L_{10}$ and $L_{20}$ respectively represent a divalent connecting group and $R_{111}$, $R_{222}$ and $R_{333}$ respectively represent a substituent;

the quaternary salt compound represented by the formula (a), (b), (c) or (d) has, in its molecule, 20 or more of total repeating units of an ethyleneoxy group or propyleneoxy group, and these repeating units may be substituted on over plural positions;

formula (e)

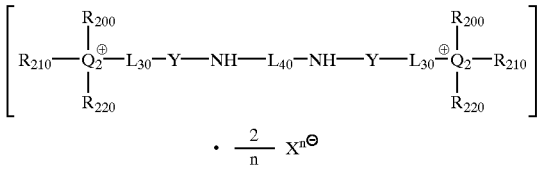

formula (f)

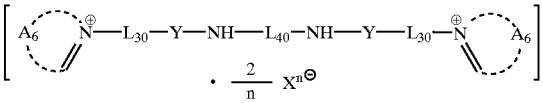

in the formula (e), $Q_2$ represents a nitrogen atom or a phosphorous atom, $R_{200}$, $R_{210}$ and $R_{220}$ respectively represent the same groups as defined for $R_{100}$, $R_{110}$ and $R_{120}$ in the formula (a) respectively;

in the formula (f), $A_6$ represents the same groups as defined for $A_1$ or $A_2$ in the formula (b) provided that the nitrogen-containing unsaturated hetero ring which $A_6$ forms may have a substituent but does not contain a primary hydroxyl group on the substituent;

in the formulae (e) and (f), $L_{30}$ represents an alkylene group, Y represents —C(=O)— or —$SO_2$—, $L_{40}$ represents a divalent connecting group having at least one hydrophilic group;

in the formulae (a) to (f), $X^{n-}$ represents an n-valent counter anion where n denotes an integer from 1 to 3, provided that when an anionic group is contained besides in a molecule and forms an intermolecular salt with $Q_1^+$, $Q_2^+$ or $N^+$, $X^{n-}$ can be omitted.

(19) The silver halide photographic light-sensitive material as described in (18), comprising at least one compound represented by the formula (1), and at least one quaternary salt compound represented by the formula (b) or (f).

(20) A processing method of a silver halide photographic light-sensitive material, comprising developing the silver halide photographic light-sensitive material as described in any one of (1) to (19) by using a developer having a pH of 9.0 to 11.0 after the light-sensitive material is subjected to image exposure.

The silver halide photographic light-sensitive material of the present invention comprises at least one compound selected from the group consisting of the compounds represented by the aforementioned formulae (1) to (3).

Firstly, the compounds represented by the formula (1) for use of the present invention will be explained in detail.

$R_1$ in the formula (1) represents a phenyl group having at least one electron-withdrawing group as a substituent, or aromatic helerocyclic or aliphatic group. When $R_1$ represents an aromatic heterocyclic group, the aromatic heterocyclic group is a monocyclic or dicyclic and substituted or unsubstituted aromatic heterocyclic group having at least one nitrogen atom, oxygen atom or sulfur atom. Specific examples of the aromatic heterocyclic group include a pyridine ring, quinoline ring, isoquinoline ring, imidazole ring, pyrrole ring, furan ring, thiophene ring, thiazole ring, and indole ring. The aliphatic group represented by $R_1$ is an alkyl group, alkenyl group or alkinyl group, which is substituted or unsubstituted and straight-chain, branched or cyclic, provided that when $R_1$ represents an alkyl group, 4 or more repeating units of an ethyleneoxy group are not contained in it. When $R_1$ represents a phenyl group having at least one electron-withdrawing group as a substituent, the electron-withdrawing group means a substituent of which the Hammett's substituent constant op has a positive value in the case of substituents disposed at the ortho or para position or a substituent of which the value om has a positive value in the case of substituents disposed at the meta position. Here, specific examples of the substituent whose op has a positive value include a halogen atom, acyl group, alkoxycarbonyl group, aryloxycarbonyl group, carbamoyl group, carboxyl group, cyano group, (alkyl or aryl)sulfonyl group, sulfo group or its salts, sulfamoyl group, nitro group, thioureido group, sulfonamide group, imide group and alkyl group substituted with plural halogen atoms (e.g., —$CF_3$ group). Examples of the substituent of which the value om has a positive value include, besides the same groups as those given as examples of the substituent of which the value op has a positive value, an acylamino group, ureido group, (alkoxy or aryloxy)carbonylamino group, sulfamoylamino group, (alkyl, aryl or heterocyclic)thio group, alkoxy group and aryloxy group.

When $R_1$ represents a phenyl group, it may have two or more electron-withdrawing groups as substituents, and it may have an optional substituent other than the electron-withdrawing group.

The group represented by $R_1$ may have optional substituents. In the present invention, examples of the optional substituent include a halogen atom (a fluorine atom, chlorine atom, bromine atom or iodine atom), alkyl group (including an aralkyl group, cycloalkyl group, active methine group and the like), alkenyl group, alkynyl group, aryl group, heterocyclic group, heterocyclic group containing a quaternary nitrogen atom (e.g., pyridinio group), acyl group, alkoxycarbonyl group, aryloxycarbonyl group, carbamoyl group, carboxy group or its salts, sulfonylcarbamoyl. group, acylcarbamoyl group, sulfamoylcarbamoyl group, carbazoyl group, oxalyl group, oxamoyl group, cyano group, thiocarbamoyl group, hydroxy group, alkoxy group, aryloxy group, heterocyclic oxy group, acyloxy group, (alkoxy or aryloxy) carbonyloxy group, carbamoyloxy group, sulfonyloxy group, amino group, (alkyl, aryl or heterocyclic)amino group, nitrogen-containing heterocyclic group substituted with N, acylamino group, sulfonamide group, ureido group, thioureido group, imide group, (alkoxy or aryloxy)

carbonylamino group, sulfamoylamino group, semicarbazide group, thiosemicarbazide group, hydrazino group, quaternary ammonio group, oxamoylamino group, (alkyl or aryl)sulfonylureide group, acylureido group, acylsulfamoylamino group, nitro group, mercapto group, (alkyl, aryl or heterocyclic)thio group, (alkyl or aryl)sulfonyl group, (alkyl or aryl)sulfinyl group, sulfo group or its salts, sulfamoyl group, acylsulfamoyl group, sulfonylsulfamoyl group or its salts and groups containing a phosphoric acid amide or phosphate structure. These substituents may be further substituted with these substituents.

$Y_1$ and $Z_1$ in the formula (1) represent substituents that are substitutable on a benzene ring. Examples of $Y_1$ and $Z_1$ include the same substituents as those which the Ad above $R_1$ may have. Preferable examples of $Y_1$ and $Z_1$ include a halogen atom, alkyl group, acylamino group, sulfonamide group, ureido group, thioureido group, sulfamoylamino group, imide group, phosphoric acid amide group, hydroxy group, alkoxy group, aryloxy group, acyl group, alkoxycarbonyl group, aryloxycarbonyl group, (alkyl, aryl or heterocyclic)thio group, sulfamoyl group, carbamoyl group, cyano group, and nitro group.

n1 and p1 in the formula (1) each represents an integer from 0 to 4. When n1 and p1 respectively are 2 or more, plural $Y_1$ and $Z_1$ may respectively be the same or different.

Examples of the development inhibitor given by the group represented by PUG in formula (1) include known development inhibitors having a heteroatom and combined directly with —C(=O)— via the heteroatom. Specific examples of the development inhibitor may include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetrazaindenes, triazaindenes and mercaptoaryls. The development inhibitor given by the group represented by PUG is preferably a compound that restrains nuclei formation-infectious development. Specific examples of the compound include compounds having at least one or more nitro group or nitroso group, nitrogen-containing heterocyclic compounds such as pyridine, pyrazine, quinoline, quinoxaline and phenazine, and compounds adsorptive onto silver halide particles having an anionic charge group. Particularly, the compounds having a nitro group are preferable. Residues of these development inhibitors represented by PUG may have an optional substituent. More detailed explanations and specific examples concerning PUG include those described in Japanese Patent No. 2632056, page 11, column 22, line 38 to page 14, column 27, line 15, Japanese Patent No. 2676439, page 4, column 8, line 41 to page 5, column 10, line 10 and JP-A-9-269553, page 25, column 48, line 47 to page 26, column 50, line 17.

Next, a preferable range of the compound represented by the formula (1) will be explained.

The group represented by $R_1$ in the formula (1) is preferably a phenyl group having at least one electron-withdrawing group. More preferable examples of the electron-withdrawing group include a halogen atom (particularly, a chlorine atom), alkoxycarbonyl group, carbamoyl group, sulfonamide group, thioureide group, sulfonyl group, m-acylamino group or m-ureide group which has a total carbon number of 0 to 30. Preferably the phenyl group represented by $R_1$ has one or two electron-withdrawing groups.

In the formula (1), n, is preferably 0 or 1, and $P_1$ is preferably 0.

Particularly preferable examples of $Y_1$ of the formula (1) include a chlorine atom, alkyl group, acylamino group, sulfonamide group, ureido group, thioureido group, sulfamoylamino group, alkoxy group, alkoxycarbonyl group, and carbamoyl group.

Redox compounds represented by the formula (1) for use in the present invention includes a compound into which a ballasting group, which is commonly used in immobile photographic additives such as a coupler, or a polymer is incorporated. Among these, the compound into which a ballasting group is incorporated is one of the preferable compounds for use of the present invention. The ballasting group in the present invention represents a straight-chain or branched alkyl (or alkylene), alkoxy(or alkylenoxy), alkylamino(or alkyleneamino) or alkylthio group, having 6 or more carbon atoms, or a group having these groups as a partial structure, and more preferably a straight-chain or branched alkyl (or alkylene), alkoxy(or alkyleneoxy), alkylamino(or alkyleneamino) or alkylthio group, having 7 or more but 24 or less carbon atoms, or a group having these groups as a partial structure.

Although the ballasting group may be a substituent of any group of $R_1$, $Y_1$, and $Z_1$ in the formula (1), it is preferably a substituent of the group represented by $R_1$. More preferably, $R_1$ is phenyl group substituted indirectly with the ballasting group.

As examples of the above polymer, those described in JP-A-1-100530 are given.

The redox compounds represented by formula (1) may contain a cationic group (e.g. a group containing a quaternary ammonio group, a group containing a quarternarized phosphorus atom, or a nitrogen-containing heterocyclic group containing a quarternarized nitrogen atom), a group containing a repeating unit of an ethyleneoxy group or a propyleneoxy group (provided that when $R_1$ is an alkyl group, $R_1$ does not contain 4 or more repeating units of an ethyleneoxy group); an alkyl-, aryl-, or heterocyclic-thio group, or a dissociating group (a group, or a partial structure, having a proton(s) of such low acidity that the proton is dissociable by an alkaline developer, e.g. carboxyl group/—COOH, sulfo group/—$SO_3H$, phosphonic acid group/—$PO_3H$, phosphoric acid group/—$OPO_3H$, hydroxy group/—OH, mercapto group/—SH, —$SO_2NH_2$, N-substituted sulfonamide group/—$SO_2NH$—, —$CONHSO_2$—, —$CONHSO_2NH$—, —$NHCONHSO_2$—, —$SO_2NHSO_2$, —CONHCO—, an activated methylene group, —NH— present in a nitrogen-containing heterocyclic group, or salts of these groups). Examples of the compounds containing these groups include those described, for example, in JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, German Patent No. 4006032, and JP-A-11-7093.

The redox compound represented by the formula (1) containing an (alkyl, aryl or heterocyclic)thio group may be preferably used in the present invention. When an (alkyl, aryl or heterocyclic)thio group is contained in the redox compound represented by the formula (1), the thio group is preferably substituted on the group represented by $R_1$ in the formula (1) directly or indirectly.

The redox compounds represented by formula (1) may contain an adsorptive group capable of being adsorbed onto the silver halide. Examples of the adsorptive group include an alkylthio group, an arylthio group, a thiourea group, a-thioamide group, a mercapto heterocyclic group, and a triazole group, described in U.S. Pat. Nos. 4,385,108 and 4,459,347, JP-A-59-195233, JP-A-59-200231, JP-A-59-

201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these adsorptive groups onto the silver halide may be modified into a precursor thereof. Examples of the precursor include those groups described in JP-A-2-285344.

The compound represented by the formula (2) used in the present invention will be explained in detail.

In the formula (2), Ar represents an aryl group or an aromatic heterocyclic group. The group represented by Ar is substituted with at least one dissociating group directly or indirectly.

When Ar in the formula (2) represents an aryl group, the aryl group is a monocyclic or dicyclic aryl group, specifically, a phenyl group and a naphthyl group. When Ar represents an aromatic heterocyclic group, the aromatic heterocyclic group is a monocyclic or dicyclic aromatic heterocyclic group including at least one nitrogen atom, oxygen atom or sulfur atom. Specific examples of the aromatic heterocyclic group include groups having a pyridine ring, quinoline ring, isoquinoline ring, pyrrole ring, furan ring, thiophene ring, thiazole ring and indole ring.

The aryl or aromatic heterocyclic group represented by Ar in the formula (2) may have an optional substituent.

Examples of the optional substituent include a halogen atom (a fluorine atom, chlorine atom, bromine atom or iodine atom), alkyl group (including an aralkyl group, cycloalkyl group, active methine group and the like), alkenyl group, alkynyl group, aryl group, heterocyclic group, heterocyclic group containing a quaternary nitrogen atom (e.g., pyridinio group), acyl group, alkoxycarbonyl group, aryloxycarbonyl group, carbamoyl group, carboxy group or its salts, sulfonylcarbamoyl group, acylcarbamoyl group, sulfamoylcarbamoyl group, carbazoyl group, oxalyl group, oxamoyl group, cyano group, thiocarbamoyl group, hydroxy group, alkoxy group (including a group containing a repeating unit of ethyleneoxy or propyleneoxy), aryloxy group, heterocyclic oxy group, acyloxy group, (alkoxy or aryloxy) carbonyloxy group, carbamoyloxy group, sulfonyloxy group, amino group, (alkyl, aryl or heterocyclic)amino group, nitrogen-containing heterocyclic group substituted with N, acylamino group, sulfonamide group, ureido group, thioureido group, imide group, (alkoxy or aryloxy) carbonylamino group, sulfamoylamino group, semicarbazide group, thiosemicarbazide group, hydrazino group, quaternary-ammonio group, oxamoylamino group, (alkyl or aryl)sulfonylureide group, acylureido group, acylsulfamoylamino group, nitro group, mercapto group, (alkyl, aryl or heterocyclic)thio group, (alkyl or aryl)sulfonyl group, (alkyl or aryl)sulfinyl group, sulfo group or its salts, sulfamoyl group, acylsulfamoyl group, sulfonylsulfamoyl group or its salts and groups containing a phosphoric acid amide or phosphate structure.

These substituents may be further substituted with these substituents.

The group represented by Ar in the formula (2) is substituted with at least one dissociating group directly or indirectly. Here, the dissociating group is a group or partial structure having a low acidic dissociating proton in an alkaline developer or its salts. Specific examples of the dissociating group include a carboxy group (—COOH), sulfo group (—$SO_3H$), phosphonic acid group (—$PO_3H$), phosphoric acid group (—$OPO_3H$—), —$SO_2NH_2$, —$SO_2NHCO$—, —$SO_2NHCONH$—, —$NHSO_2NHCO$—, —$SO_2NHSO_2$—, —CONHCO—, and activated methylene group, or salts of these groups. However, a mercapto group (—SH), —NH— present in a nitrogen-containing heterocyclic group, —OH, and N-substituted substituted sulfonamide group (—$SO_2NH$—) are excluded from the dissociating group. Here, the activated methylene group means a methylene or methine group sandwiched between two or three electron-withdrawing groups. The electron-withdrawing group is an atomic group of which the Hammett's substituent constant op can have a positive value. Specific examples of the electron-withdrawing group include a carbonyl group, sulfonyl group, phosphonyl group, or groups including these atomic groups (e.g., an oxycarbonyl group, carbamoyl group, sulfamoyl group, and formyl group), imino group, cyano group and nitro group. Two of these electron-withdrawing groups may be combined to form a ring structure.

When the dissociating group is indirectly combined with the Ar group, the aforementioned optional substituents which the Ar group may have or combinations of these substituents are given as examples of the connecting group between the dissociating group and the Ar group. When the dissociating group is divalent, the style of substitution may be any one of left and right side substitutions, and as a group to be substituted on the dissociating group on the side opposite to the connecting group connected to the Ar side, a substitutable group is selected from optional substituents which the Ar group may have. It is to be noted that, when the dissociating group represents a sulfo group or its salt, the group represented by Ar in the formula (2) never has a pyridinio group as a substituent. Also, when the dissociating group represents —COOH, it is necessary that t is 0, or the —COOH be connected to the Ar group via a sulfonamide group (—$SO_2NH$—) when t is 1.

In the present invention, examples of the salts of the dissociating group include salts comprising alkali metal ions, alkali earth metal ions, organic ammonium ions and organic phosphonium ions, such as a sodium cation, potassium cation, lithium cation, magnesium cation and tetrabutylammonium cation.

When the aryl or aromatic heterocyclic group represented by Ar in the formula (2) has a separate substituent other than the aforementioned dissociating group or the substituent containing the dissociating group, preferable examples of the separate substituent include an alkyl group, acylamino group, sulfonamide group, ureide group, sulfamoylamino group, imide group, thioureide group, phosphoric acid amide group, hydroxy group, alkoxy group, aryloxy group, acyloxy group, acyl group, alkoxycarbonyl group, aryloxycarbonyl group, carbamoyl group, (alkyl, aryl or heterocyclic)thio group, sulfamoyl group, halogen atom, cyano group, and nitro group.

As examples of the residue of a development inhibitor represented by PUG in the formula (2), known residues of a development inhibitor which have a heteroatom and are bound with —C(=O)—(TIME)t— through the heteroatom. Specific examples and preferable examples of these residues are the same as those explained for PUG in the formula (1).

The timing group represented by TIME in the formula (2) represents a divalent connecting group which can release the group represented by $(TIME)_t$—PUG by a hydrolysis reaction of a developer in succession after the Acompound represented by the formula (2) is oxidized during developing, and further can releases PUG from the group represented by $(TIME)_t$—PUG through reactions run in one or more stages.

Detailed explanations and specific examples concerning the timing group represented by TIME include in Japanese Patent No. 2632056, page 4, column 8, line 10 to page 11, column 22, line 35, Japanese Patent No. 2676439, page 4, column 7, line 39 to page 4, column 8, line 40 and JP-A-9-269553, page 47, column 47, line 45 to page 47, column 48, line 46.

Next, a preferable range of the redox compound represented by the formula (2) will be explained.

The group represented by Ar in the formula (2) is preferably an aryl group and more preferably a phenyl group.

Preferable examples of the dissociating group which Ar contains as a direct or indirect substituent include carboxy group, sulfo group, phosphonic acid group, —$SO_2NH_2$, —$SO_2NHCO$—, —$SO_2NHCONH$—, —$NHSO_2NHCO$—, —$SO_2NHSO_2$—, —CONHCO— and activated methylene group or salts of these groups. Particularly preferable examples are carboxy group, sulfo group, —$SO_2NH_2$, —$SO_2NHCO$—, —$SO_2NHCONH$—, —$NHSO_2NHCO$— or salts of these groups. As the salts of these groups, a sodium cation or potassium cation is more preferable.

When t is 0 in the formula (2), preferable examples of the residue of a development inhibitor represented by PUG are residues of benzimidazoles, indazoles, benzotriazoles and pyrazoles having a nitro group. Among these residues, residues of indazoles are particularly preferable. When t is 1, preferable examples of the residue of a development inhibitor represented by PUG are residues of benzimidazoles, indazoles, benzotriazoles, mercaptotetrazoles, mercaptobenzimidazoles, mercaptobenzothiazoles, mercaptobenzoxazoles, mercaptothiadiazoles, mercaptotriazoles or pyrazoles containing a nitro group. Among these residues, residues of indazoles, benzotriazoles, mercaptotetrazoles, mercaptobenzimidazoles, mercaptobenzothiazoles or mercaptobenzoxazoles are more preferable and residues of indazoles, benzotriazoles or mercaptotetrazoles are particularly preferred.

As the timing group represented by TIME in the formula (2), timing groups represented by the formulae (T-1), (T-2) and (T-3) described in Japanese Patent No. 2632056 are preferable and the timing groups represented by the formula (T-1) are particularly preferable.

In the formula (2), t is more preferably 0.

Among the compounds represented by the formula (2), more preferable compounds are represented by the following formula (2-1).

formula (2-1)

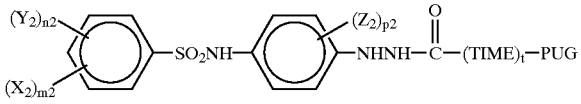

TIME, t and PUG in the formula (2-1) are the same as those in the formula (2) and each preferable range of them is also the same as that in the formula (2).

$X_2$ represents a dissociating group or a substituent having at least one dissociating group. $Y_2$ and $Z_2$ respectively represent a substituent that can be substituted on a benzene ring. m2 represents an integer from 1 to 5 and n2 and p2 represent integers from 0 to 4, provided that the sum of m2 and n2 never exceeds 5. When $X_2$ has the dissociating group represents a sulfo group (—$SO_3H$), or a salt thereof, the case where the group represented by $X_2$ has a pyridinio group, as a substituent, is excluded. When m2, n2 or p2 is an integer of 2 or more, a plurality of $X_2$, $Y_2$ or $Z_2$ may be the same or different.

Here, the substituents represented by $Y_2$ and $Z_2$ show groups except for dissociating groups among optional substituents which the Ar group in the formula (2) may have. Preferable examples of the substituent are an alkyl group, acylamino group, sulfonamide group, ureide group, sulfamoylamino group, imide group, thioureide group, phosphoric acid amide group, hydroxy group, alkoxy group, aryloxy group, acyloxy group, acyl group, alkoxycarbonyl group, aryloxycarbonyl group, carbamoyl group, (alkyl, aryl or heterocyclic)thio group, sulfamoyl group, halogen atom, cyano group and nitro group.

In the formula (2-1), p2 is preferably 0, n2 is preferably 0 or 1 and m2 is preferably 1 or 2.

In the formula (2-1), $X_2$ is preferably groups having the following dissociating group (or its salt). Specifically, preferable examples of $X_2$ include groups having —COOH, —O—L—COOH, —S—L—COOH, —CONH—L—COOH, —COO—L—COOH, —NHCO—L—COOH, —NHCONH—L—COOH, —NHCON(—L—COOH)$_2$, —$NHCONR_{500}$—L—COOH, —$NHSO_2$—L—COOH, —NHP(=O)(O—L—COOH)$_2$, —$SO_2NH$—L—COOH, —L—COOH, —$SO_3H$, —O—L—$SO_3H$, —S—L—$SO_3H$, —CONH—L—$SO_3H$, —CONH—L—$SO_2NH_2$, —COO—L—$SO_3H$, —COO—L—$SO_2NH_2$, —NHCO—L—$SO_3H$, —NHCONH—L—$SO_3H$, —NHCONH—L—$SO_2NH_2$, —NHCON(—L—$SO_3H$)$_2$, —$NHCONR_{500}$—L—$SO_3H$, —$NHCONR_{500}$—L—$SO_2NH_2$, —$NHSO_2$—L—$SO_3H$, —NHP(=O)(O—L—$SO_3H$)$_2$, —$SO_2NH$—L—$SO_3H$, —L—$SO_3H$, —CONHCO—$R_{500}$, —$CONHSO_2$—$R_{500}$, —$CONHSO_2NH$—$R_{500}$, —$NHCONHSO_2$—$R_{500}$, —$NHSO_2NHSO_2$—$R_{500}$, —$SO_2NHSO_2$—$R_{500}$ or salts of these groups.

Here, L represents a divalent connecting group having at least one alkylene group (preferably 1 to 20 carbon atoms) or a phenylene group and may contain one of or a combination of —O—, —$NR_{510}$—, —S—, —C(=O)—, —$SO_2$—, —C(=S)—, —SO— and —PO—. Also, L may have an optional substituent. As examples of the substituent, optional substituents which the Ar group in the formula (2) may have are given. These substituents may be dissociating groups. $R_{500}$ represents a monovalent aliphatic group (preferably 1–20 carbon atoms), aromatic group (preferably 6 to 20 carbon atoms) or heterocyclic group (preferably five- to seven-membered rings having at least one nitrogen atom, sulfur atom or oxygen atom). $R_{510}$ represents a hydrogen atom, monovalent aliphatic group (preferably 1–20 carbon atoms), monovalent aromatic group (preferably 6 to 20 carbon atoms) or monovalent heterocyclic group (preferably five- to seven-membered rings having at least one nitrogen atom, sulfur atom or oxygen atom).

More preferable examples of $X_2$ in the formula (2-1) include groups having —O—L—COOH, —CONH—L—COOH, —COO—L—COOH, —NHCO—L—COOH, —NHCONH—L—COOH, —$NHCONR_{500}$—L—COOH, —CONH—L—$SO_3H$, —COO—L—$SO_3H$, —NHCONH—L—$SO_3H$, —$NHCONR_{500}$—L—$SO_3H$, —CONHCO—$R_{500}$, —$CONHSO_2$—$R_{500}$, —$CONHSO_2NH$—$R_{500}$, —$NHCONHSO_2$—$R_{500}$, —$NHSO_2NHSO_2$—$R_{500}$, —$SO_2NHSO_2$—$R_{500}$ or salts of these groups. Particularly preferable examples of $X_2$ are groups having —CONH—L—COOH, —COO—L—COOH, —NHCO—L—COOH, —NHCONH—L—COOH, —$NHCONR_{500}$—L—COOH, —CONH—L—$SO_3H$, —NHCONH—L—$SO_3H$, —$NHCONR_{500}$—L—$SO_3H$, —$CONHSO_2$—$R_{500}$, —$CONHSO_2NH$—$R_{500}$, —$NHCONHSO_2$—$R_{500}$, or salts of these groups. Most preferable examples of $X_2$ are groups having —COO—L—COOH, —NHCO—L—COOH, —NHCONH—L—COOH, —$NHCONR_{500}$—L—COOH, —$CONHSO_2$—$R_{500}$, —$CONHSO_2NH$—$R_{500}$, $NHCONHSO_2$—$R_{500}$, or salts of these groups.

Preferably, $R_{500}$ represents a monovalent substituted or unsubstituted alkyl group, or a monovalent substituted or unsubstituted phenyl group.

Redox compounds represented by the formula (2) or (2-1) includes a compound into which a ballasting group, which is commonly used in immobile photographic additives such as a coupler, or a polymer is incorporated. Particularly, a redox compound represented by the formula (2) or (2-1) into which a ballasting group is incorporated is preferably used for this invention. The ballasting group has 6 or more carbon atoms and can be selected from a straight-chain or branched, alkyl group (or alkylene group), alkoxy group (or alkyleneoxy group), alkylamino group (or alkyleneamino group), or alkylthio group, or a group having these groups as its partial structure. It is more preferable that the ballasting group is, having 7 or more but 24 or less carbon atoms, a straight-chain or branched, alkyl group (or alkylene group), alkoxy group (or alkyleneoxy group), alkylamino group (or alkyleneamino group), or alkylthio group, or a group having these groups as its partial structure.

Although the ballasting group may be a substituent of any group of Ar, TIME and PUG in the formula (2), it is preferably a substituent of the group represented by Ar. More preferably, the ballasting group is substituted on the group represented by Ar indirectly. Further more preferable is the case where at least one of the groups represented by $X_2$ or $Y_2$ in the formula (2-1) is the ballasting group or a group substituted with the ballasting group.

Examples of the above polymer include those described, for example, in JP-A-1-100530.

The compound represented by the formula (2) or (2-1) may contain a cationic group (specifically, for example, a group containing a quaternary ammonio group, group containing a quaternary phosphorus atom, or a nitrogen-containing heterocyclic group containing a quaternary nitrogen atom), group containing a repeating unit of an ethyleneoxy group or a propyleneoxy group, or (alkyl, aryl or heterocyclic)thio group. When the dissociating group represents a sulfo group (—$SO_3H$) or its salt, the group represented by Ar in the formula (2) does not contain a pyridinio group as a substituent. Examples of the compounds containing these groups include those described, for example, in JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032.

The compound represented by the formula (2) or (2-1) and containing an (alkyl, aryl or heterocyclic)thio group is among those that may be preferably used in the present invention. When an (alkyl, aryl or heterocyclic)thio group is contained in the compound represented by the formula (2), the thio group is preferably substituted on the group represented by Ar in the formula (2) directly or indirectly. More preferably, the (alkyl, aryl or heterocyclic)thio group is substituted on the group represented by $X_2$ or $Y_2$ in the formula (2-1).

The redox compound represented by the formula (2) or (2-1) may contain an adsorptive group that adsorbs onto the silver halide. Examples of the adsorbing group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-2201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these groups capable of being adsorbed onto the silver halide may be modified into a precursor thereof. Examples of the precursor include those groups described in JP-A-2-285344.

Next, the redox compound represented by the formula (3) and used in the present invention will be explained in detail.

The connecting group represented by A in the formula (3) shows polyvalent connecting groups comprising singly or in combinations of, groups such as an alkylene group (preferably 1 to 20 carbon atoms), arylene group (preferably 6 to 20 carbon atoms), heterocyclic group (preferably five- to seven-membered ring having at least one nitrogen atom, sulfur atom or oxygen atom, which may be a condensate), single bond, —O—, —$NR_{540}$—, —S—, —C(=O)—, —$SO_2$—, —C(=S)—, —SO— and —PO—. Here, $R_{540}$ represents a hydrogen atom, monovalent aliphatic group (preferably 1 to 20 carbon atoms), monovalent aromatic group (preferably 6 to 20 carbon atoms) or monovalent heterocyclic group (preferably five- to seven-membered ring having at least one nitrogen atom, sulfur atom or oxygen atom). The connecting group represented by A may have an optional substituent as same as the substituents which $R_1$ in the formula (2) may have.

As examples of the residue of a development inhibitor represented by PUG in the formula (3), known residues of a development inhibitor which have a heteroatom and are bound with —C(=O)—(TIME)t— through the heteroatom. Specific examples and preferable examples of these residues are the same as those explained for PUG in the formula (1).

The timing group represented by TIME in the formula (3) has the same meaning as the aforementioned TIME in the formula (2) and the details, specific examples and the like of the timing group are the same as those explained in the formula (2).

The connecting group represented by A in the formula (3) is preferably a connecting group having at least two arylene groups, and more preferably a connecting group at least two arylene groups and at least two sulfonamide groups (—$SO_2NH$—). A connecting group having at least three arylene groups and at least two sulfonamide groups is most preferable.

Among the compounds represented by the formula (3), more preferable compounds are represented by the following formula (3-1) or (3-2).

formula (3-1)

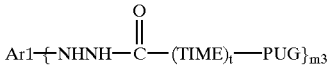

formula (3-2)

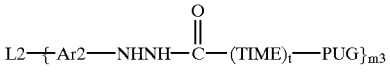

wherein Ar1 represents an aromatic or aromatic heterocyclic group having m valences, Ar2 represents a divalent aromatic or aromatic heterocyclic group, L2 represents a connecting group having m valences and PUG, TIME, t and m have the same meanings as those in the formula (3).

When Ar1 or Ar2 represents an aromatic group, the aromatic group is a monocyclic or dicyclic aromatic group having m valences or two valences. Specific examples of the aromatic group include a phenylene group and naphthylene group. When Ar1 or Ar2 represents an aromatic heterocyclic group, the aromatic heterocyclic group is a monocyclic or dicyclic aromatic heterocyclic group having m or two valences, including at least one nitrogen atom, oxygen atom or sulfur atom. Given as specific examples of the aromatic heterocyclic group are groups having a pyridine-ring, quinoline ring, isoquinoline ring, pyrrole ring, furan ring, thiophene ring, thiazole ring, and indole ring, or the like. The aromatic group or heterocyclic group represented by Ar1 or Ar2 may have an optional substituent.

The connecting group represented by L2 in the formula (3-2) shows connecting groups comprising singly, or in combinations, groups such as an alkylene group, arylene group, polyvalent heterocyclic group, single bond, —O—, —$NR_{530}$—, —S—, —C(=O)—, —$SO_2$—, —C(=S)—, —SO— and —PO—. Here, $R_{530}$ represents a hydrogen atom, monovalent aliphatic group , monovalent aromatic group or monovalent heterocyclic group. The connecting group represented by L2 may have an optional substituent.

Next, a preferable range of the compound represented by the formula (3-1) or (3-2) will be explained.

The group represented by Ar1 or Ar2 in the formula (3-1) or (3-2) is preferably an aromatic group and more preferably a phenylene group.

When the group represented by Ar1 or Ar2 in the formula (3-1) or (3-2) has a substituent, preferable examples of the substituent are an alkyl group, acylamino group, sulfonamide group, ureide group, sulfamoylamino group, imide group, thioureide group, phosphoric acid amide group, hydroxy group, alkoxy group, aryloxy group, acyloxy group, acyl group, alkoxycarbonyl group, aryloxycarbonyl group, carbamoyl group, (alkyl, aryl or heterocyclic)thio group, sulfamoyl group, halogen atom, cyano group and nitro group.

In the formula (3-1) or (3-2), preferable groups as PUG when t is 0 and preferable groups as PUG when t is 1 are the same as those given in the formula (2) respectively.

Preferable groups as the timing group represented by TIME in the formula (3-1) or (3-2) are also the same as those given in the formula (2).

In the formula (3-1) or (3-2), t is more preferably 0.

In the formula (3-1) or (3-2), m is more preferably 2 or 3 and particularly preferably 2.

A preferable one as the connecting group represented by L2 in the formula (3-2) is a polyvalent connecting group having a sulfonamide group. A more preferable one is a polyvalent connecting group having at least one of arylene, alkylene, and heterocyclic group, and at least two sulfonamide groups.

More preferable compounds among the compounds represented by the formula (3-1) or (3-2) are represented by the following formula (3-3) or (3-4).

formula (3-3)

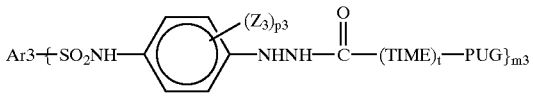

formula (3-4)

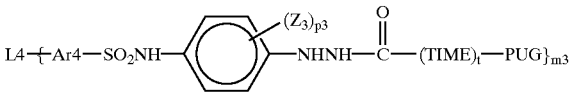

In the formulae (3-3) and (3-4), TIME, t, PUG and m have the same meanings as those in the formulae (3-1) and (3-2), and each preferable range is also the same. In the formulae (3-3) and (3-4), Ar3 and Ar4 respectively represent an aromatic or aromatic heterocyclic group. Ar3 is an m-valent group and Ar4 is a divalent group. Ar3 and Ar4 respectively have same meanings as Ar1 and Ar2 in the formulae (3-1) and (3-2). L4 in the formula (3-4) represents an m-valent connecting group. In the formulae (3-3) and (3-4), $Z_3$ represents a substituent and p3 represents an integer from 0 to 4.

In the formulae (3-3) and (3-4), preferable examples of the substituent represented by $Z_3$ are the same as the optional substituent which A in the formula (3) may have. Preferable examples of the substituent are an alkyl group, acylamino group, sulfonamide group, ureide group, sulfamoylamino group, imide group, thioureide group, phosphoric acid amide group, hydroxy group, alkoxy group, aryloxy group, acyloxy group, acyl group, alkoxycarbonyl group, aryloxycarbonyl group, carbamoyl group, (alkyl, aryl or heterocyclic)thio group, sulfamoyl group, halogen atom, cyano group and nitro group.

In the formulae (3-3) and (3-4), p3 is preferably 1 or 0, and more preferably 0.

In the formula (3-3), as the aromatic group or aromatic heterocyclic group represented by Ar3, a phenylene group, naphthylene group or six- or five-membered aromatic heterocyclic group (specifically, groups having a pyridine ring, pyrimidine ring, triazine ring, quinoline ring, isoquinoline ring or the like) is preferable. Ar3 in the formula (3-3) is particularly preferably a phenylene group or a naphthylene group.

As the aromatic group or aromatic heterocyclic group represented by Ar4 in the formula (3-4), a phenylene group is particularly preferable.

The m-valent connecting group represented by L4 in the formula (3-4) shows connecting groups comprising singly, or in combinations, groups such as an alkylene group, arylene group, polyvalent heterocyclic group, single bond, —O—, —$NR_{520}$—, —S—, —C(=O)—, —$SO_2$— and —C(=S)—. Here, $R_{520}$ represents a hydrogen atom, monovalent aliphatic group or monovalent aromatic group.

When L4 includes an arylene group, a phenylene group or a naphthylene group is preferable as the arylene group. Also, when L4 includes a polyvalent heterocyclic group, the heterocyclic group may be an aromatic or non-aromatic heterocyclic group, specifically, a nitrogen-containing heterocyclic group containing a quaternary nitrogen atom such as a pyridinio group. Specific examples of the heterocyclic group include 1,4-dioxane ring, piperazine ring, 2,4,8,10-tetraoxaspiro-(5,5)undecane ring, biphthalimide ring, 1,2,4,5-benzenetetracarboxydiimide ring, triazine ring and pyridine ring. Also, when L4 has an alkylene group, the alkylene group may be a cycloalkylene group. Examples of the cycloalkylene group include groups including a cyclopropane ring, cyclohexane ring, bicyclohexane ring, decaline ring, or norbornane ring.

The m-valent connecting group represented by L4 may have an optional substituent. Examples of the substituent includes the aforementioned substituents which A in the formula (3) may have, and the combinations thereof.

A particularly preferable m-valent connecting group represented by L4 in the formula (3-4) is a connecting group having at least one alkylene group, arylene group, polyvalent heterocyclic group or single bond.

The redox compound represented by the formula (3) may be those into which the same ballasting group or polymer as the ballasting group or polymer which may be commonly used in immobile photographic additives such as a coupler, as same as the ballasting group or the polymer incorporated in the compounds represented by the formula (2) or (2-1). The ballasting group in the formula (3) is preferably substituted on the group represented by A directly or indirectly. Further, in the formula (3-1) or (3-2), the ballasting group is preferably substituted on Ar1 or L2 directly or indirectly, and in the formula (3-3) or (3-4), the ballasting group is preferably substituted on Ar3 or L4 directly or indirectly.

The redox compound represented by the formula (3) may contain an adsorptive group that adsorbs onto the silver halide. Given as examples of such an adsorptive group are the groups given as the adsorptive group which the compound represented by the formula (2) or (2-1) may have.

The redox compound represented by the formula (3) may contain a cationic group (specifically, for example, a group containing a quaternary ammonio group, group containing a quaternary phosphorus atom or a nitrogen-containing heterocyclic group containing a quaternary nitrogen atom), group containing a repeating unit of an ethyleneoxy group or a propyleneoxy group or (alkyl, aryl or heterocyclic)thio group. As examples containing these groups, the compounds given as the specific examples containing the above groups in relation to the compound represented by the formula (2) or (2-1) are given.

Specific examples of the redox compounds represented by formulae (1) to (3) are shown below. However, these compounds are not intended to be limiting of the present invention.

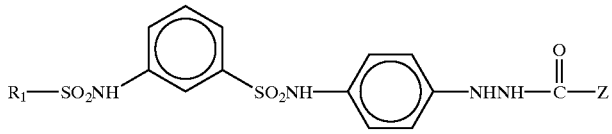

| No. | $R_1$ = | Z = |
|---|---|---|
| 1-1 | 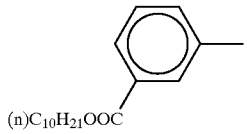 | 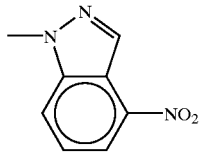 |
| 1-2 | 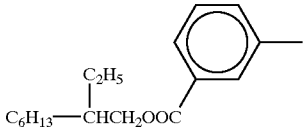 | 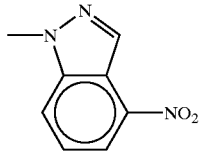 |
| 1-3 | 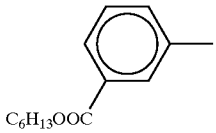 | 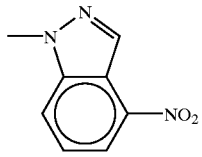 |
| 1-4 | 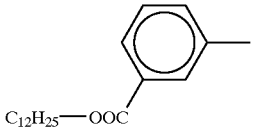 | 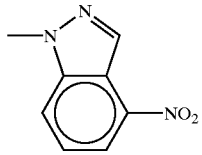 |
| 1-5 | 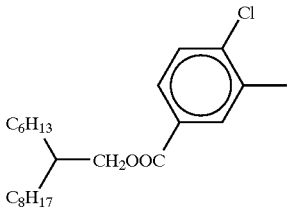 | 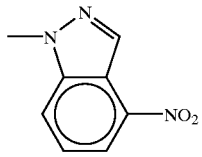 |
| 1-6 | 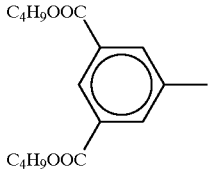 | 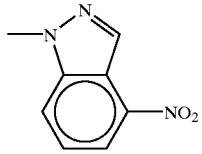 |

-continued
1-7
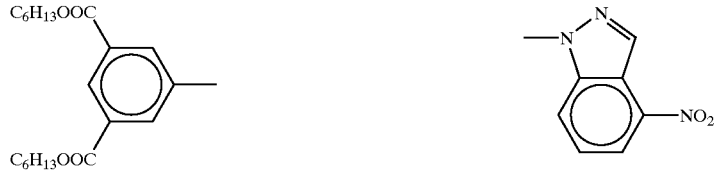
1-8
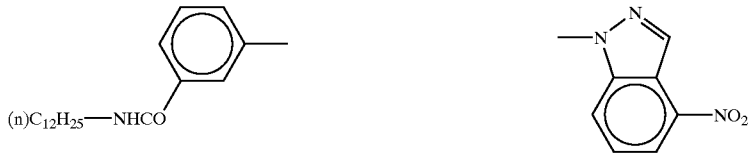
1-9
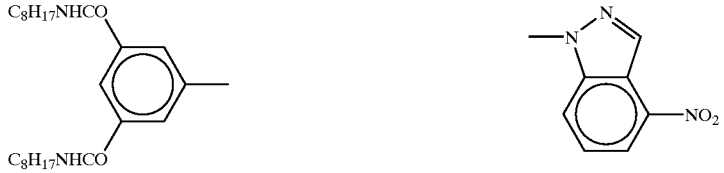
1-10
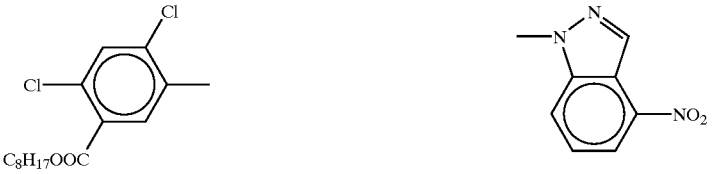
1-11
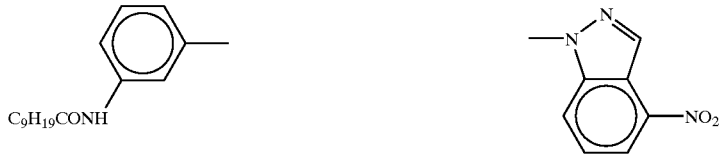
1-12
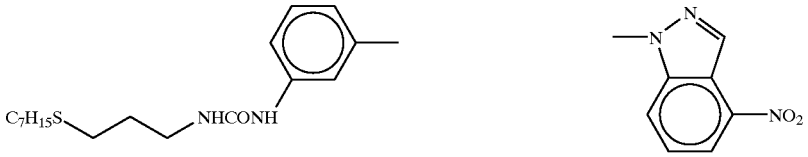
1-13
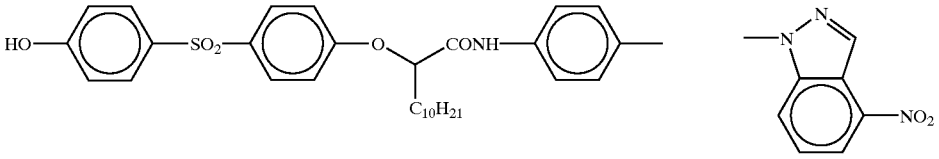
1-14
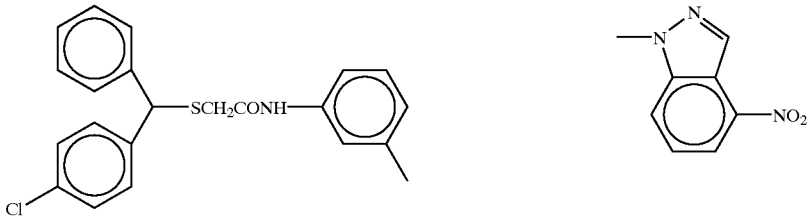

-continued
| | | |
|---|---|---|
| 1-15 | 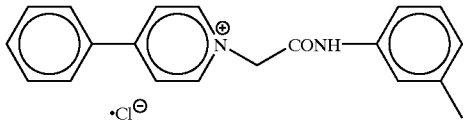 | 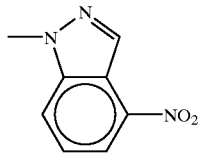 |
| 1-16 | 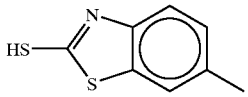 | 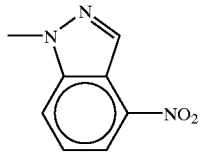 |
| 1-17 | 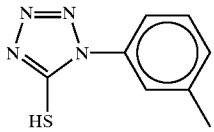 | 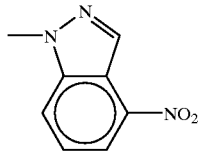 |
| 1-18 | 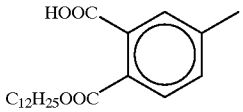 | 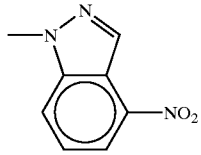 |
| 1-19 | 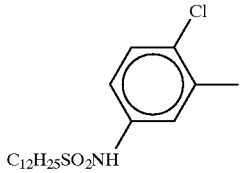 | 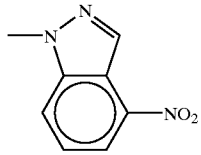 |
| 1-20 | 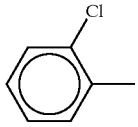 | 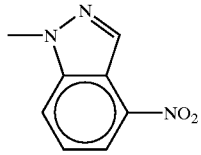 |
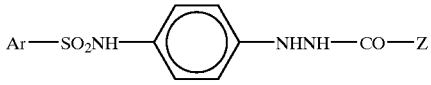
| No. | Ar = | Z = |
|---|---|---|
| 1-21 | 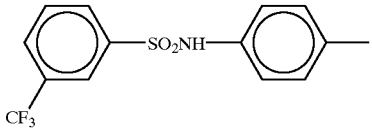 | 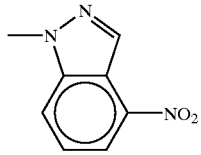 |
| 1-22 | 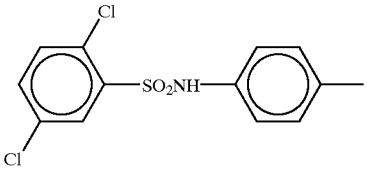 | 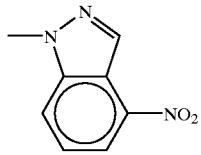 |

-continued
1-23
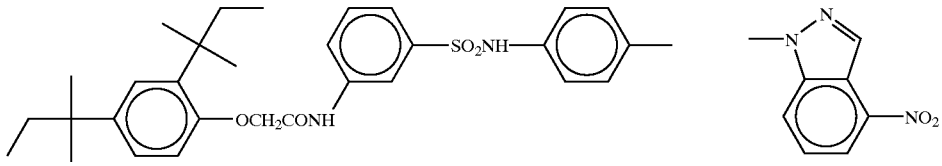
1-24
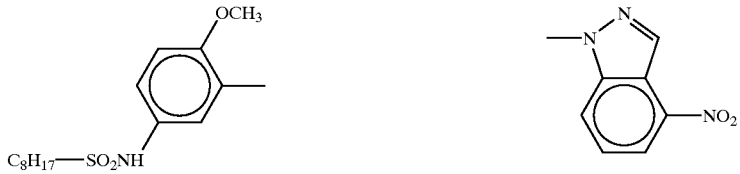
1-25
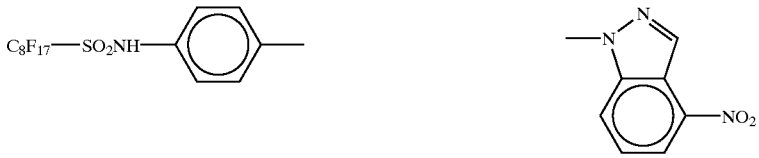
1-26
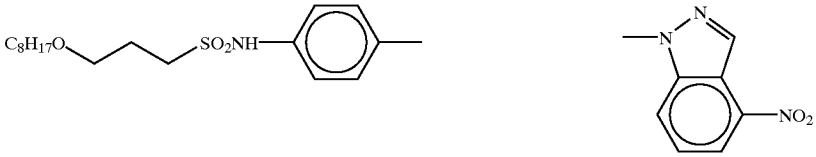
1-27
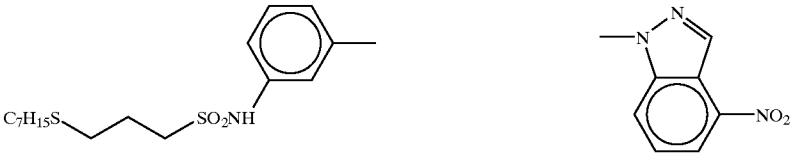
1-28
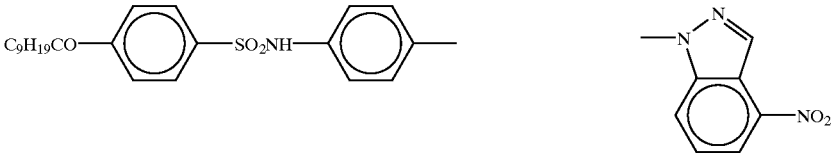
1-29
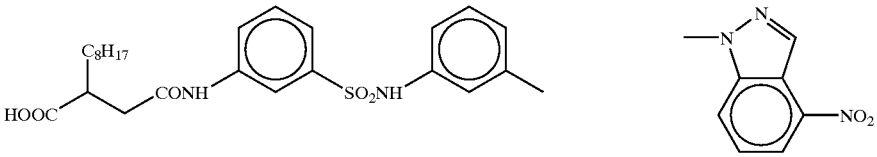
1-30
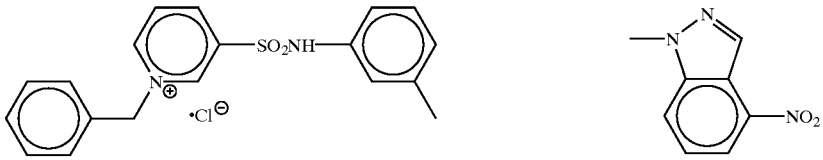

-continued
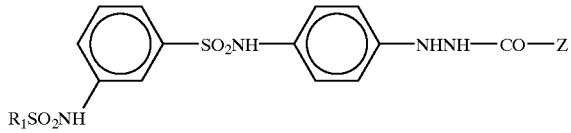
| No. | $R_1$ = | Z = |
|---|---|---|
| 1-31 | 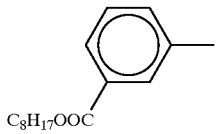 | 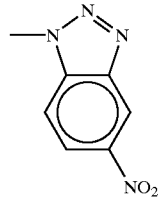 |
| 1-32 | 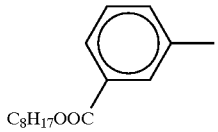 | 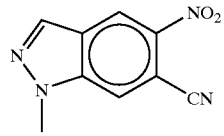 |
| 1-33 | 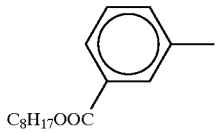 | 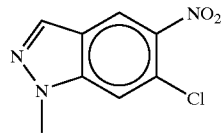 |
| 1-34 | 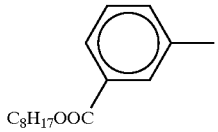 | 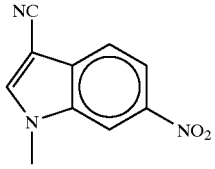 |
| 1-35 | 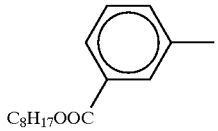 | 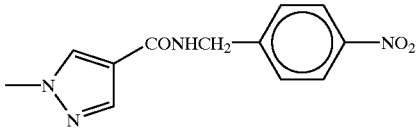 |
| 1-36 | 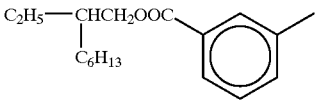 | 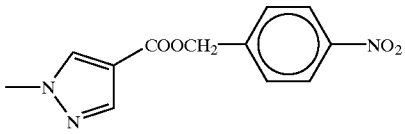 |
| 1-37 | 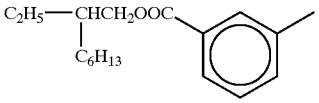 | 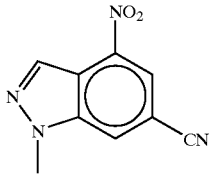 |
| 1-38 | 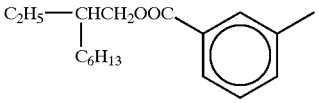 | 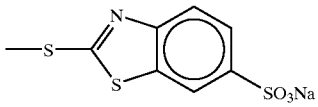 |

-continued
1-39
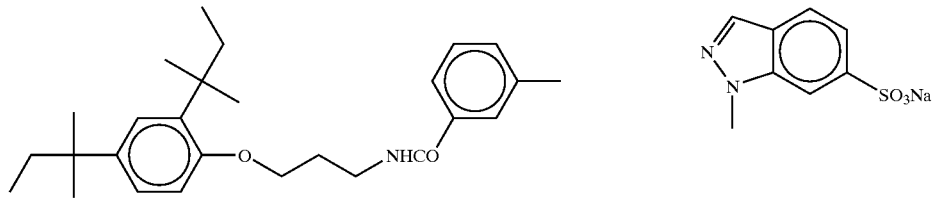
1-40
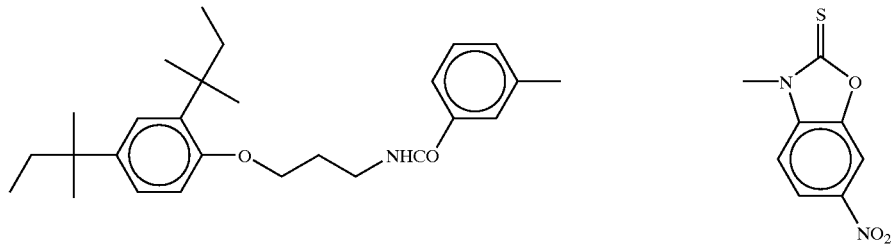
1-41
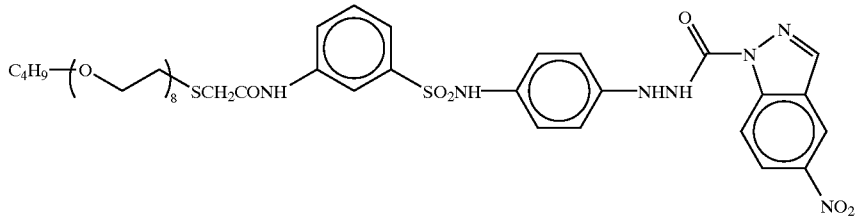
1-42
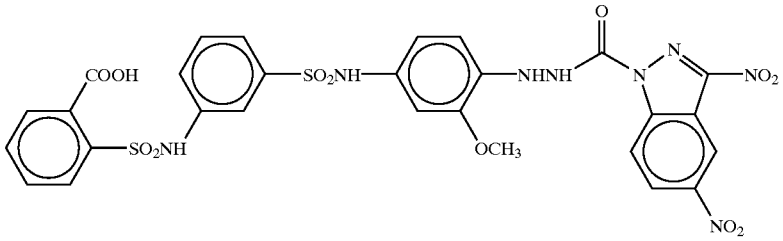
1-43
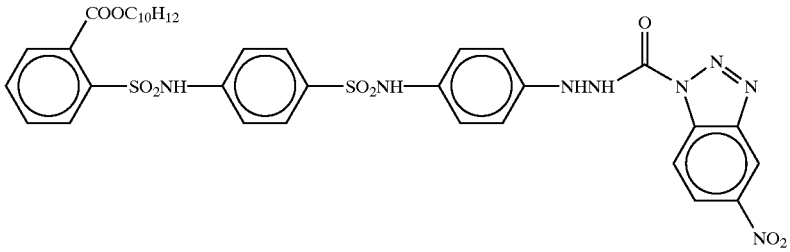
1-44
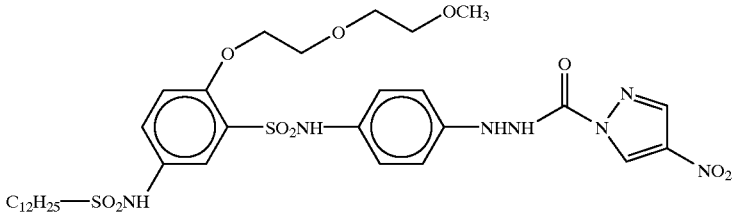

-continued
1-45
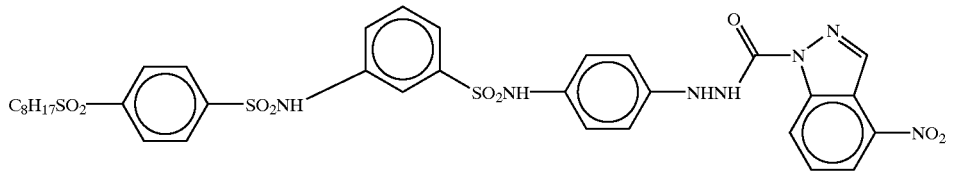
1-46
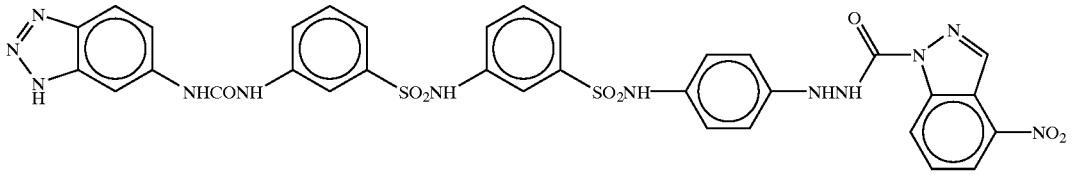
1-47
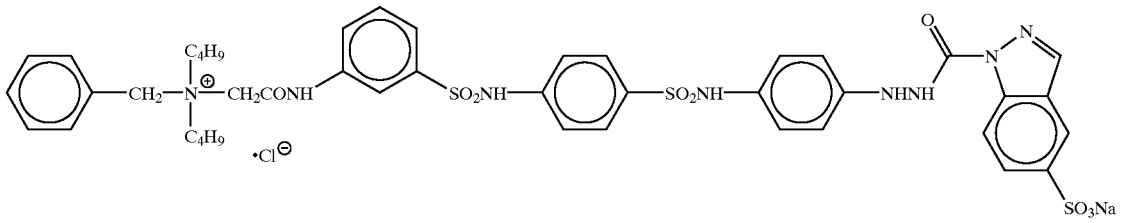
1-48
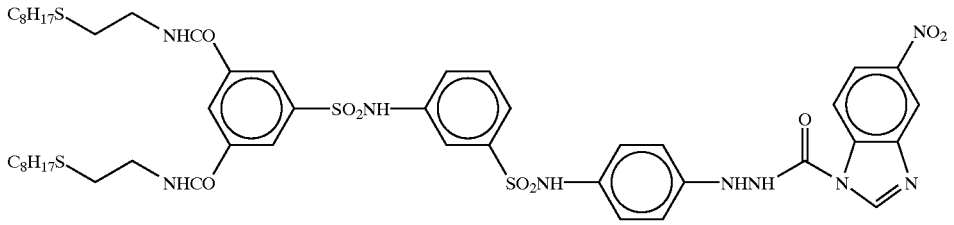
1-49
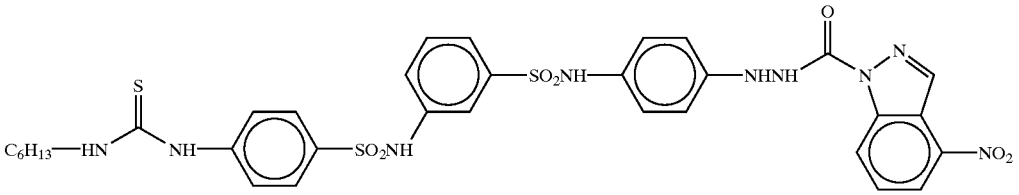
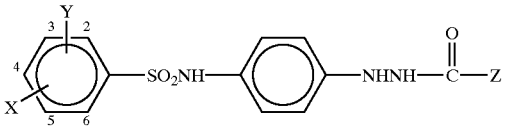
| No. | X = | Y = | Z = |
|---|---|---|---|
| 2-1 | 5-NHCOCH$_2$CH(C$_{12}$H$_{25}$)—COOH | — | 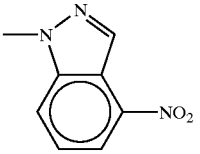 |
| 2-2 | 5-NHCO—COOH | — | 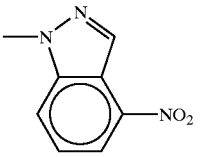 |

-continued
| | | | |
|---|---|---|---|
| 2-3 | 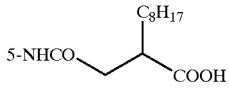 | 4-Cl | 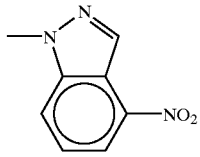 |
| 2-4 | 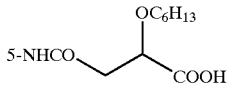 | — | 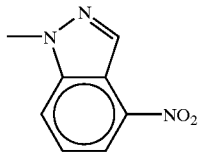 |
| 2-5 | 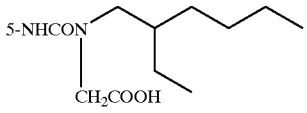 | — | 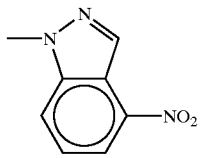 |
| 2-6 | 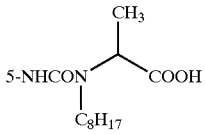 | — | 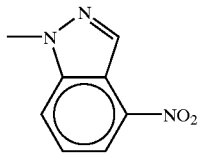 |
| 2-7 | 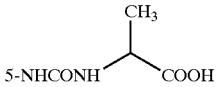 | — | 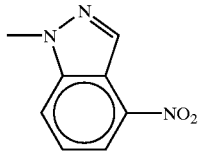 |
| 2-8 | 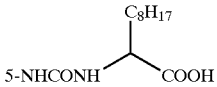 | — | 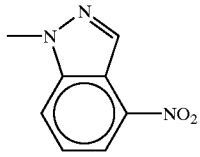 |
| 2-9 | 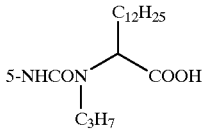 | — | 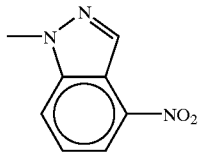 |
| 2-10 | 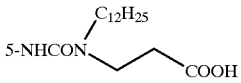 | — | 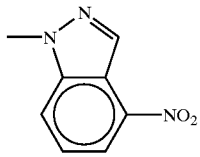 |
| 2-11 | 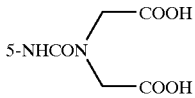 | 2-Cl | 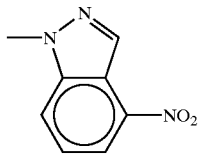 |

-continued
| | | | |
|---|---|---|---|
| 2-12 | 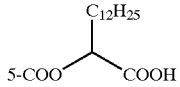 | — | 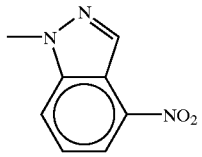 |
| 2-13 | 4-COO$(CH_2)_9$COOH | — | 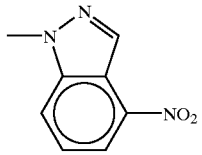 |
| 2-14 | 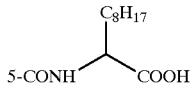 | — | 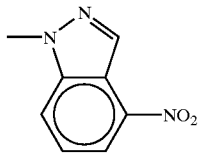 |
| 2-15 | 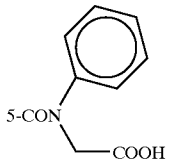 | 4-Cl | 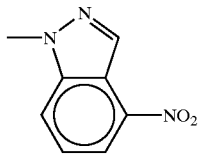 |
| 2-16 | 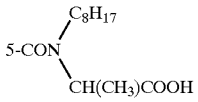 | — | 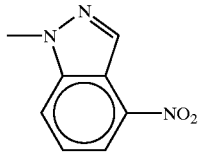 |
| 2-17 | 5-CONHSO$_2$C$_{12}$H$_{25}$ | — | 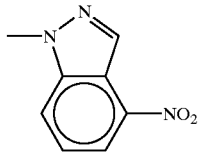 |
| 2-18 | 4-CONHCO—C$_7$H$_{15}$ | — | 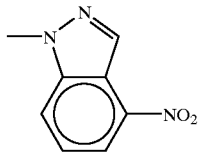 |
| 2-19 | 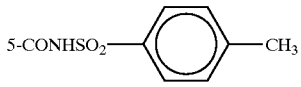 | 4-Cl | 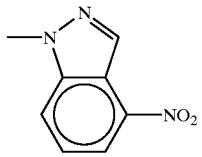 |
| 2-20 | 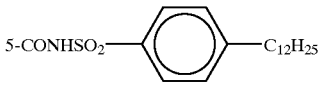 | — | 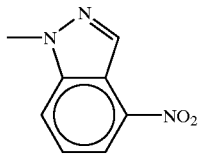 |

-continued
| | | | |
|---|---|---|---|
| 2-21 | 5-CONH—$(CH_2)_{11}$—COOH | — | 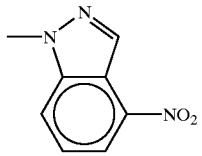 |
| 2-22 | 5-COO$(CH_2)_{14}$—COOH | — | 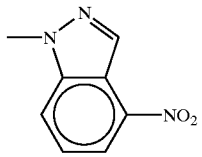 |
| 2-23 | 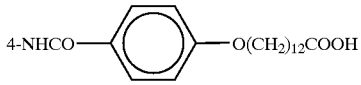 | — | 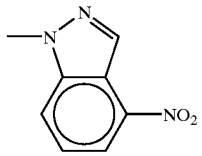 |
| 2-24 | 4-NHCONH$(CH_2)_{11}$COOH | — | 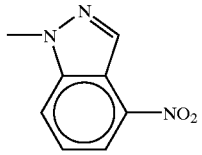 |
| 2-25 | 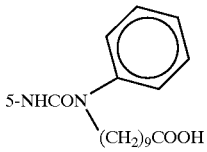 | 4-Cl | 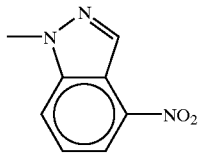 |
| 2-26 | 5-NHCONHSO$_2$C$_{12}$H$_{25}$ | — | 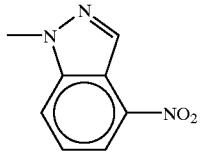 |
| 2-27 | 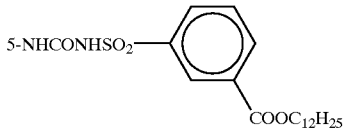 | — | 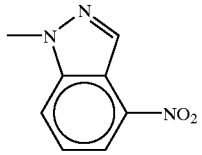 |
| 2-28 | 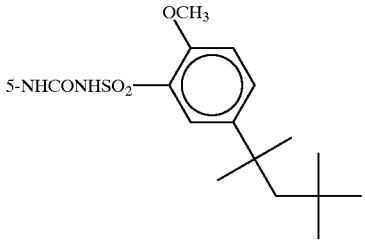 | 4-OCH$_3$ | 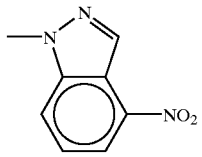 |
| 2-29 | 5-NHSO$_2$NHSO$_2$C$_8$H$_{17}$ | — | 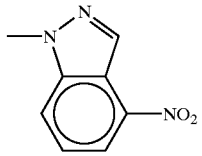 |

-continued
| | | | |
|---|---|---|---|
| 2-30 | 5-$NHSO_2NHCOC_9H_{19}$ | — | 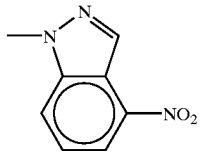 |
| 2-31 | 4-$O(CH_2)_9COOH$ | — | 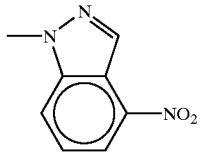 |
| 2-32 | 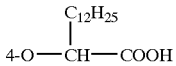 | — | 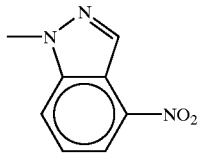 |
| 2-33 | 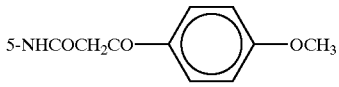 | — | 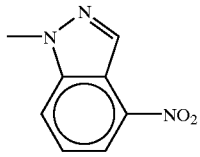 |
| 2-34 | 4-$NHCOCH_2SO_2C_8H_{17}$ | — | 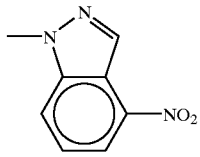 |
| 2-35 | 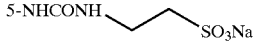 | — | 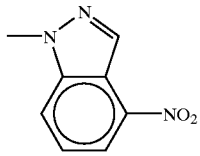 |
| 2-36 | 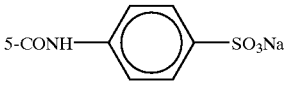 | — | 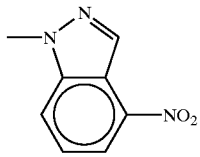 |
| 2-37 | 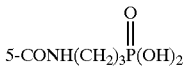 | — | 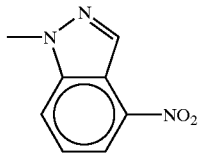 |
| 2-38 | 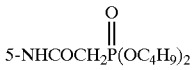 | — | 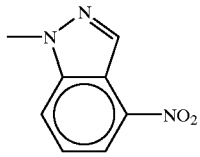 |

-continued
| | | | |
|---|---|---|---|
| 2-39 | 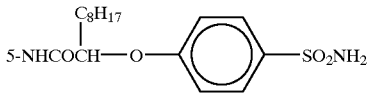 | — | 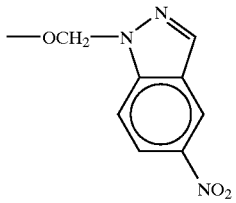 |
| 2-40 | 5-NHCO$(CH_2)_9$COOH | — | 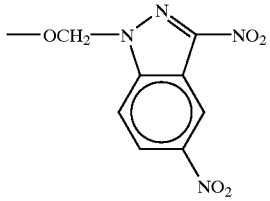 |
| 2-41 | 5-COO$(CH_2)_9$COOH | — | 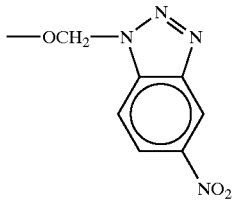 |
| 2-42 | 5-NHCONH$(CH_2)_{11}$COOH | 4-Cl | 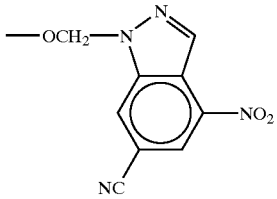 |
| 2-43 | 5-NHCONH$SO_2C_{12}H_{25}$ | — | 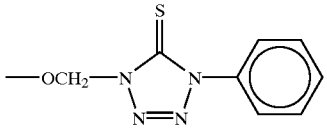 |
| 2-44 | 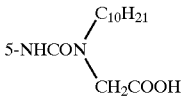 | — | 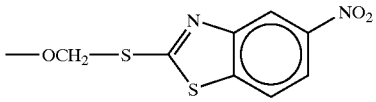 |
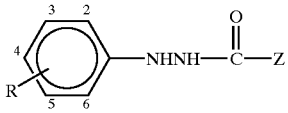
| No. | R = | Z = |
|---|---|---|
| 2-45 | 4-NHCONH—$(CH_2)_9$—COOH | 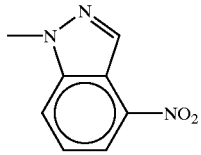 |

-continued
| | | |
|---|---|---|
| 2-46 | 4-O$(CH_2)_{31}$—COOH | 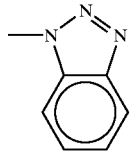 |
| 2-47 | 4-$NHSO_2CH_2CH(COOC_2H_5)_2$ | 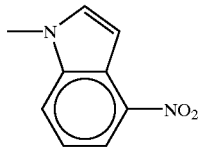 |
| 2-48 | 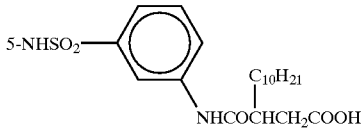 | 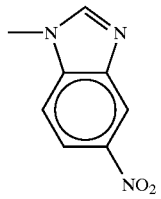 |
| 2-49 | 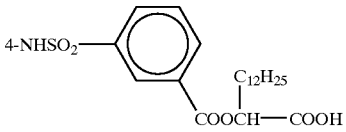 | 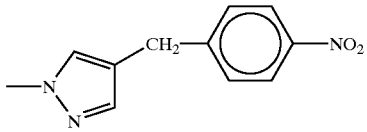 |
| 2-50 | 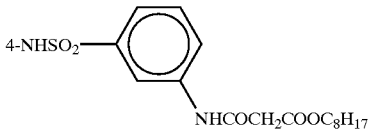 | 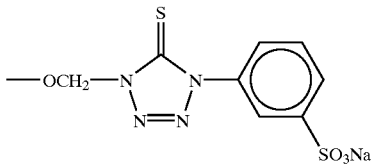 |
| 2-51 | 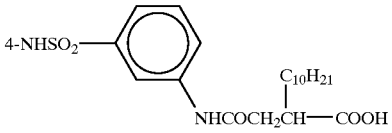 | 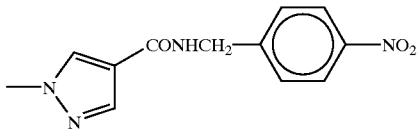 |
| 2-52 | 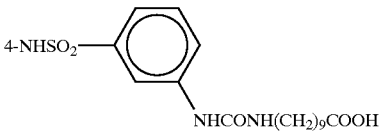 | 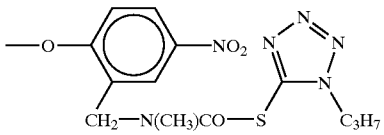 |
| 2-53 | 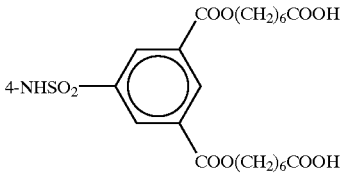 | 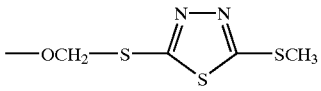 |
| 2-54 | 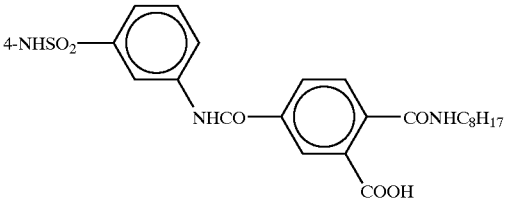 | 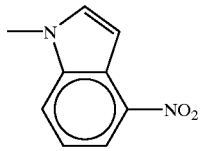 |

-continued
| | | |
|---|---|---|
| 2-55 | 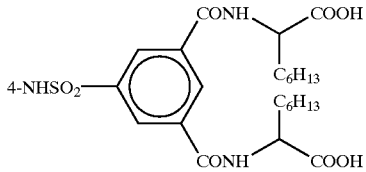 | 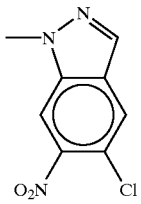 |
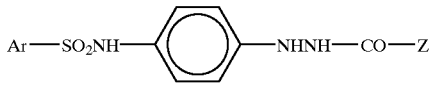
| No. | Ar = | Z = |
|---|---|---|
| 2-56 | 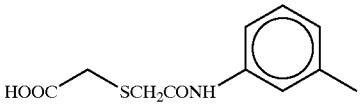 | 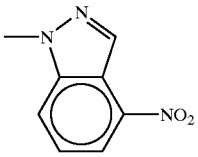 |
| 2-57 | 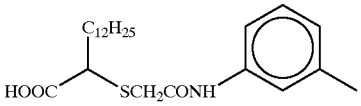 | 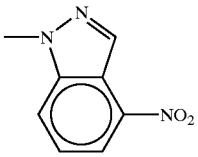 |
| 2-58 | 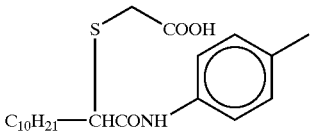 | 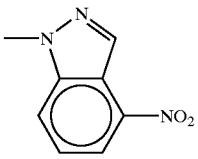 |
| 2-59 | 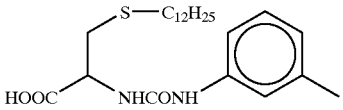 | 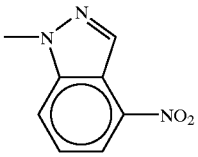 |
| 2-60 | 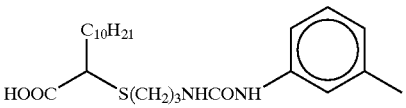 | 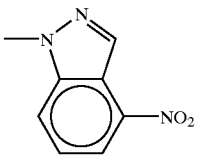 |
| 2-61 | 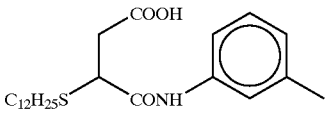 | 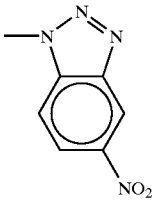 |

-continued
| | | |
|---|---|---|
| 2-62 | 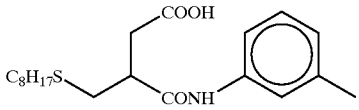 | 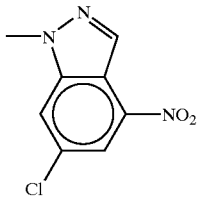 |
| 2-63 | 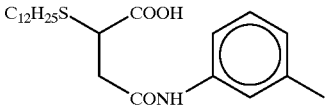 | 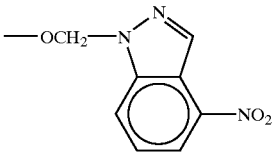 |
| 2-64 | 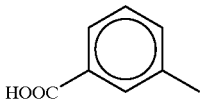 | 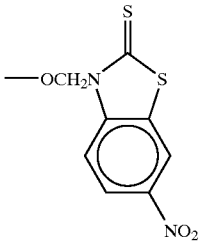 |
| 2-65 | 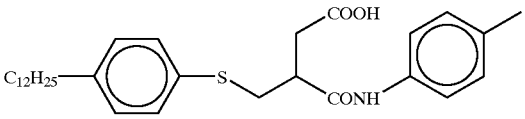 | 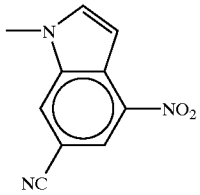 |
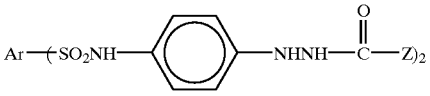
| No. | Ar = | Z = |
|---|---|---|
| 3-1 | 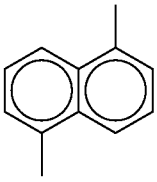 | 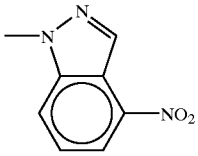 |
| 3-2 | 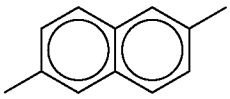 | 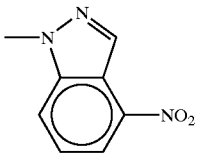 |
| 3-3 | 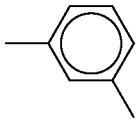 | 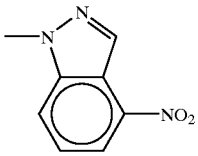 |

-continued
| | | |
|---|---|---|
| 3-4 | 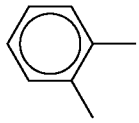 | 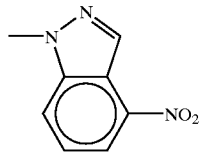 |
| 3-5 | 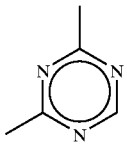 | 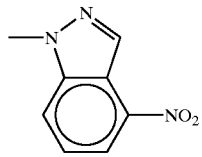 |
| 3-6 | 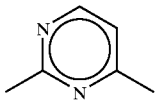 | 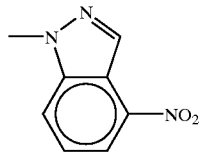 |
| 3-7 | 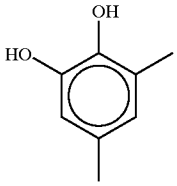 | 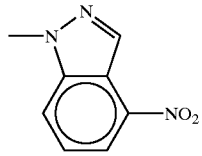 |
| 3-8 | 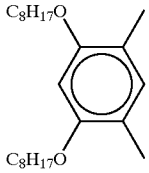 | 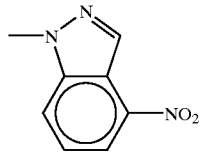 |
| 3-9 | 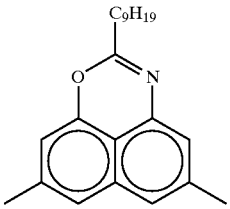 | 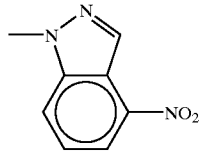 |
| 3-10 | 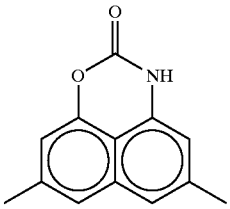 | 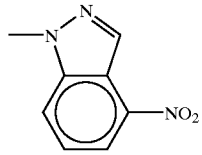 |
| 3-11 | 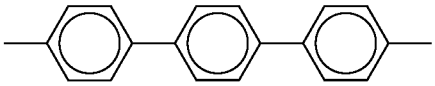 | 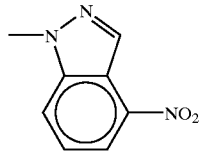 |

-continued
3-12
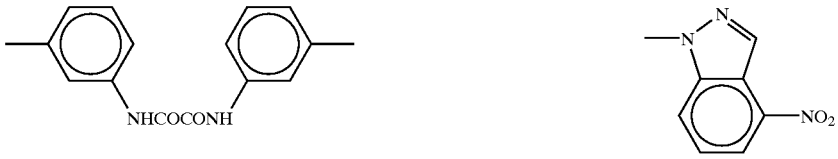
3-13
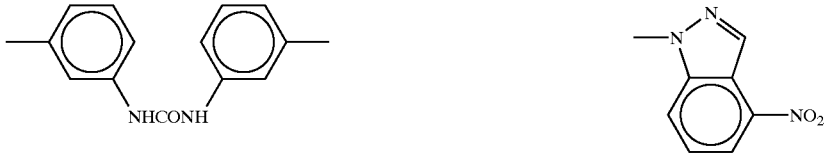
3-14
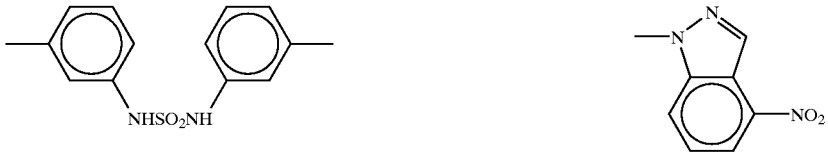
3-15
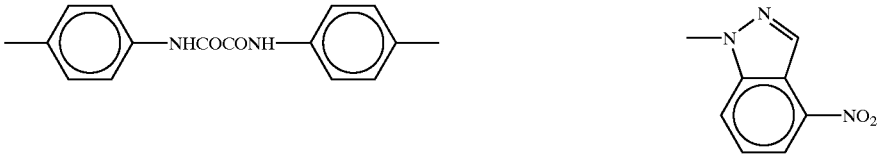
3-16
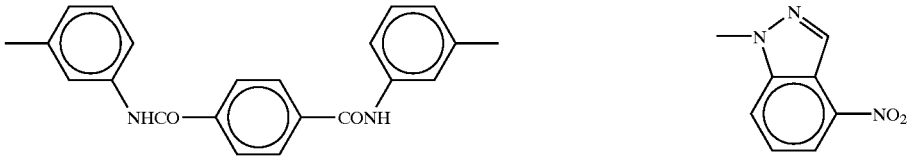
3-17
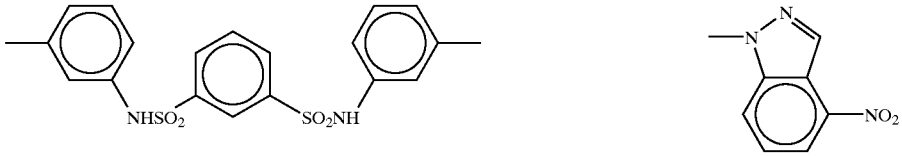
3-18
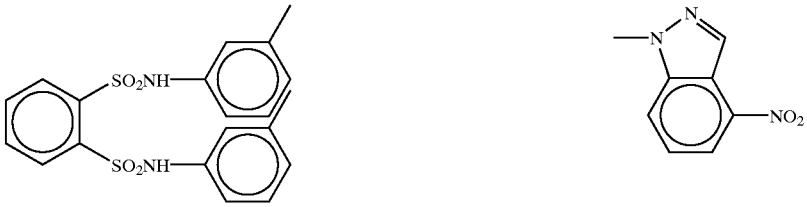
3-19
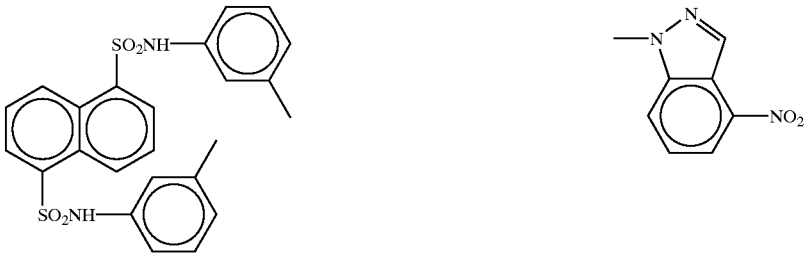

-continued
3-20
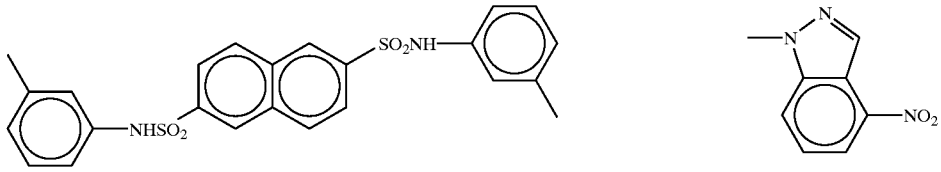
3-21
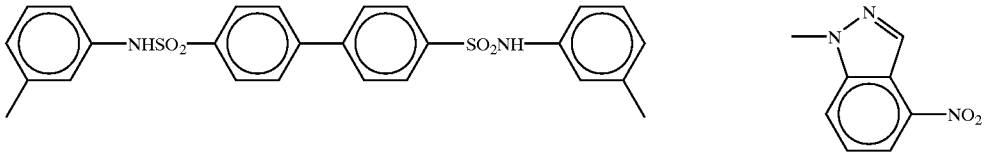
3-22
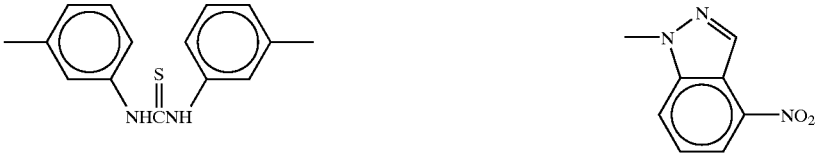
3-23
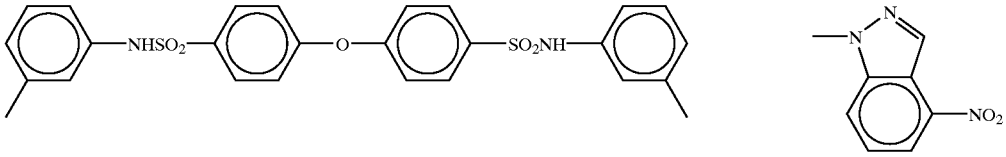
3-24
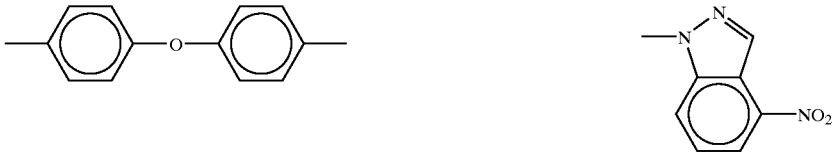
3-25
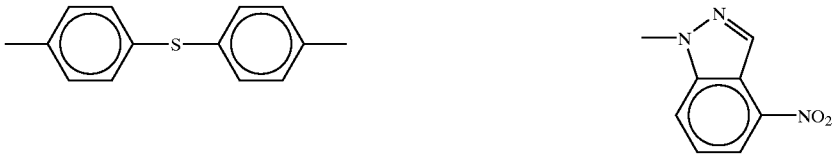
3-26
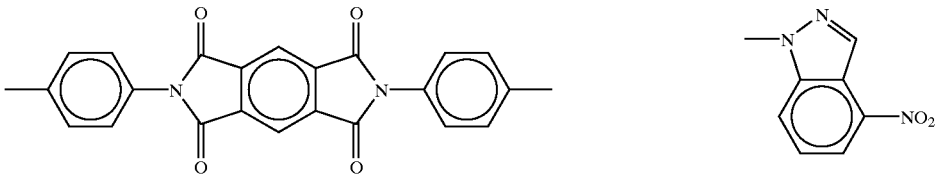
3-27
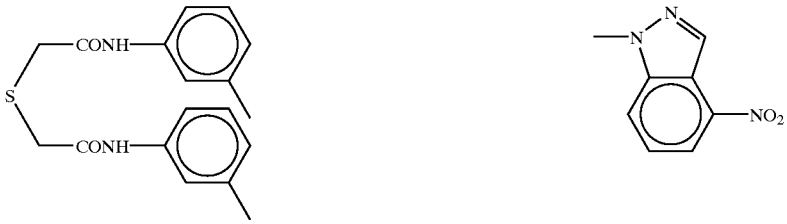

-continued
3-28
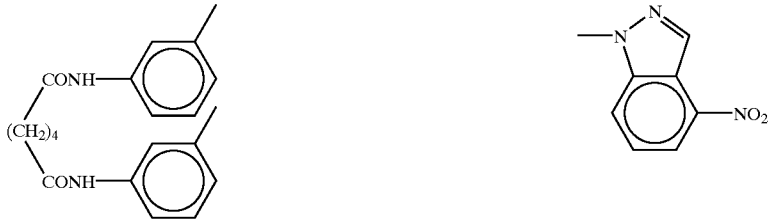
3-29
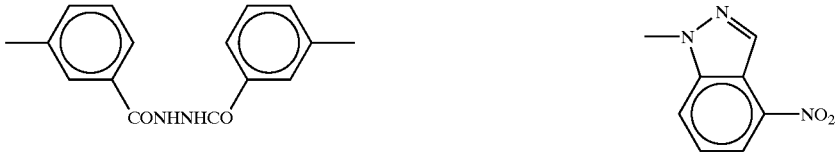
3-30
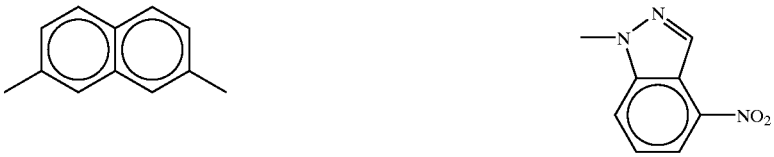
3-31
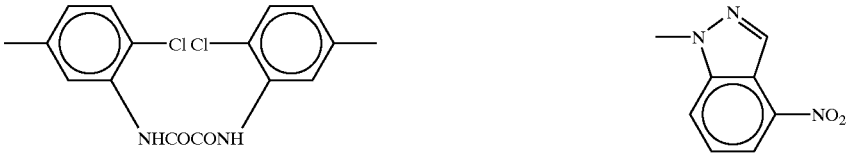
3-32
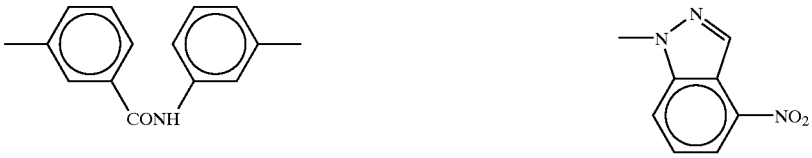
3-33
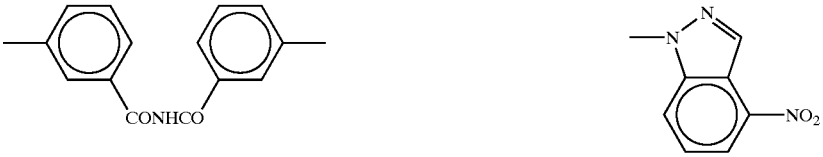
3-34
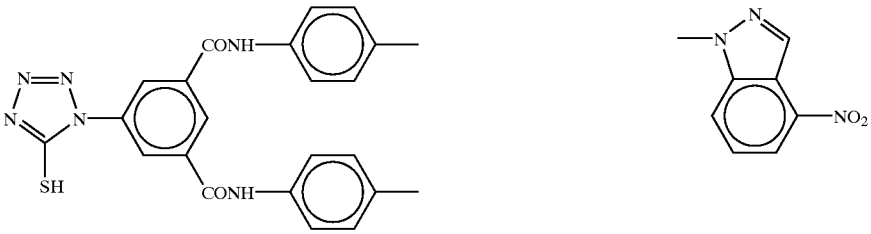
3-35
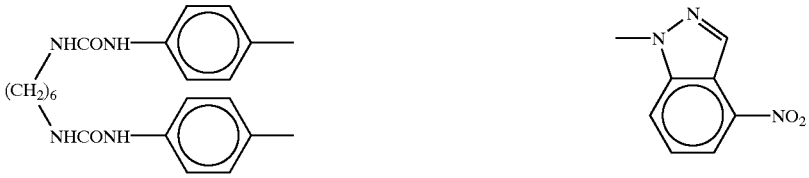

-continued
3-36
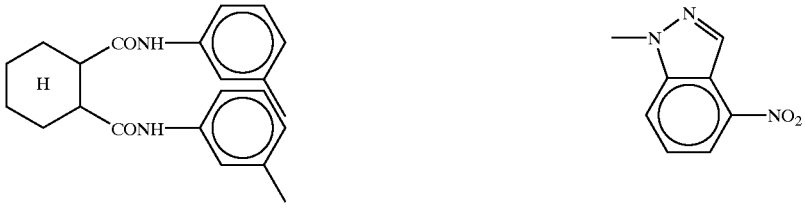
3-37
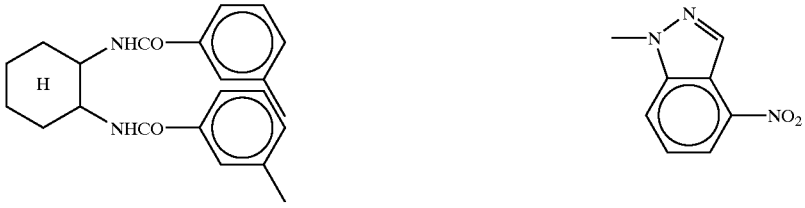
3-38
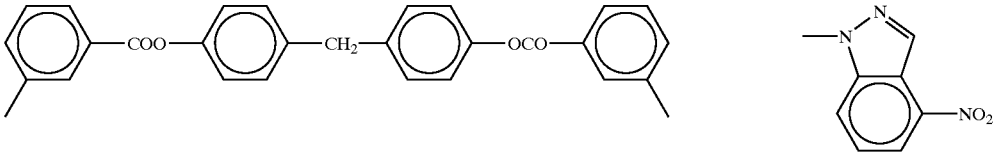
3-39
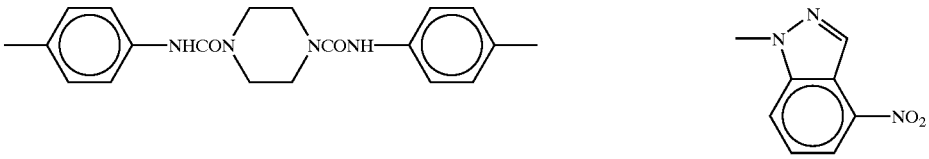
3-40
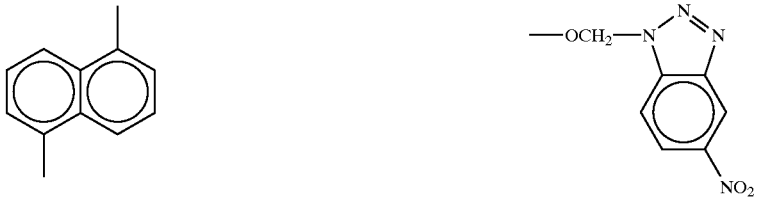
3-41
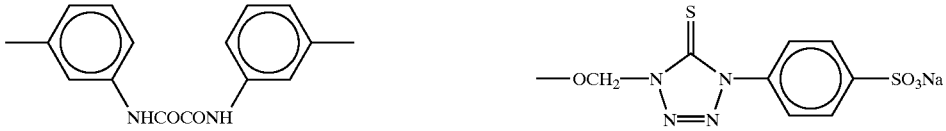
3-42
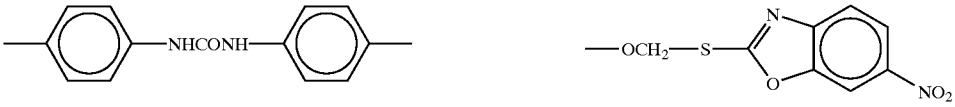
3-43
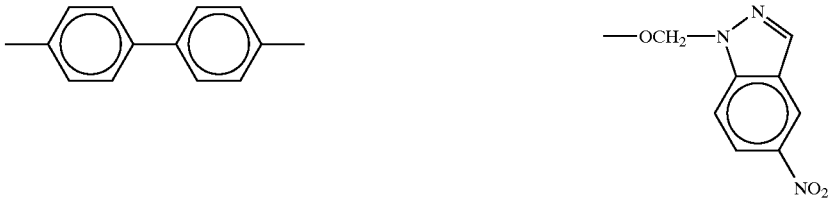

-continued
3-44
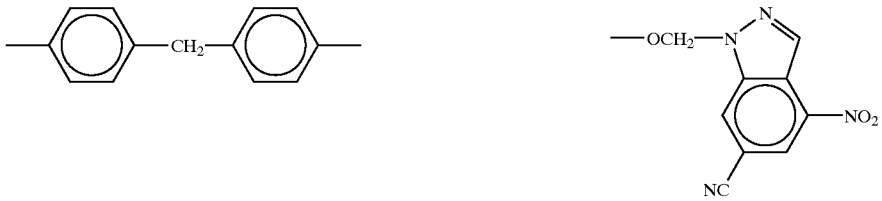
3-45
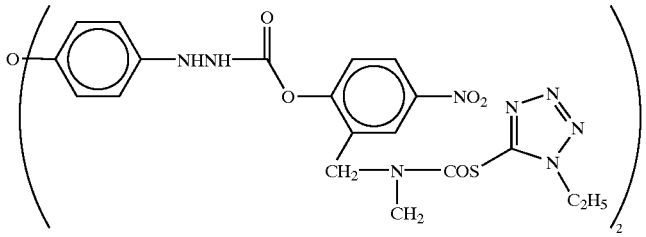
3-46
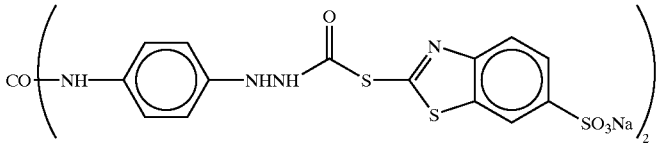
3-47
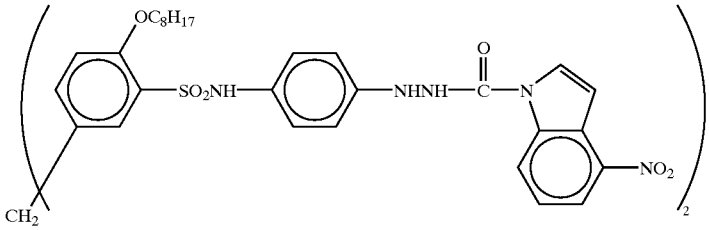
3-48
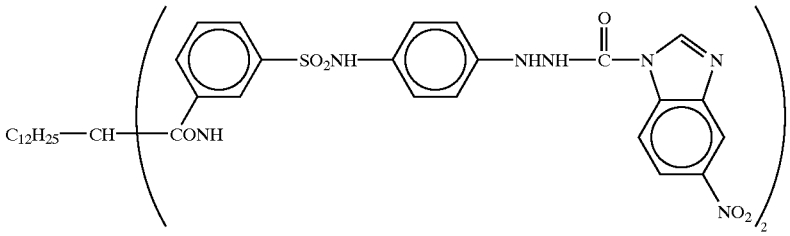
3-49
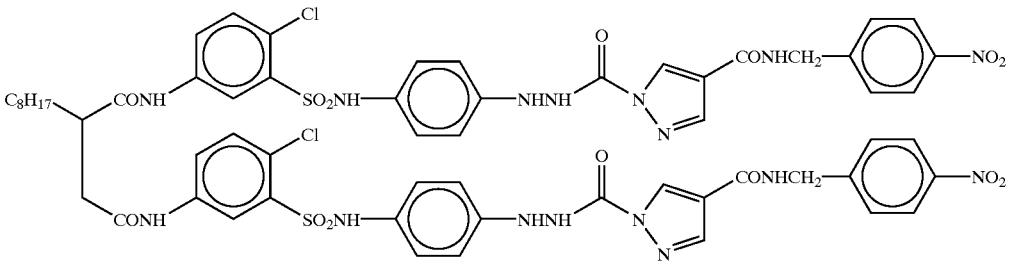

-continued
3-50
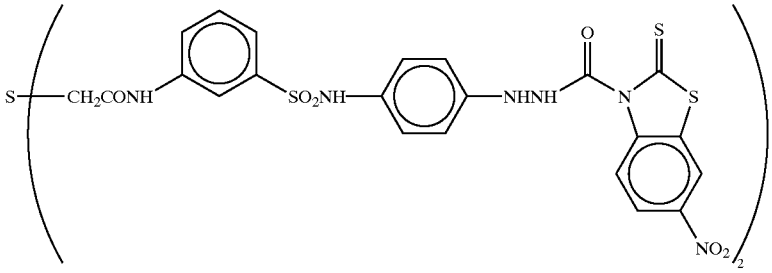
3-51
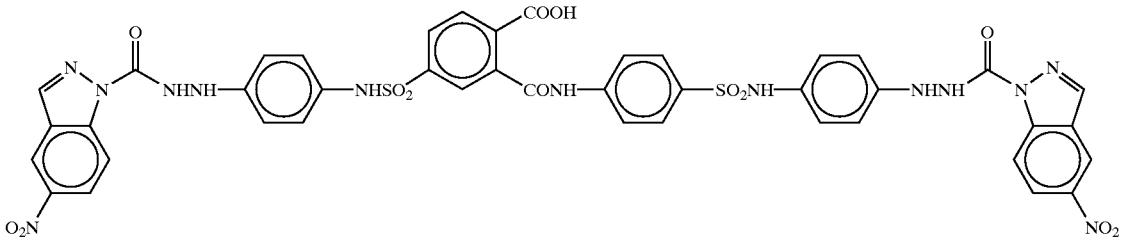
3-52
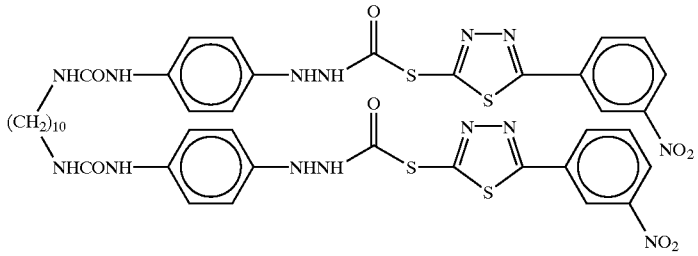
3-53
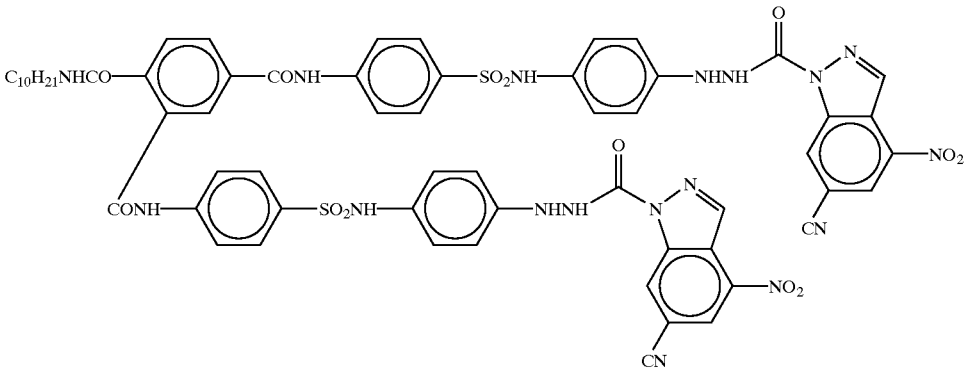
3-54
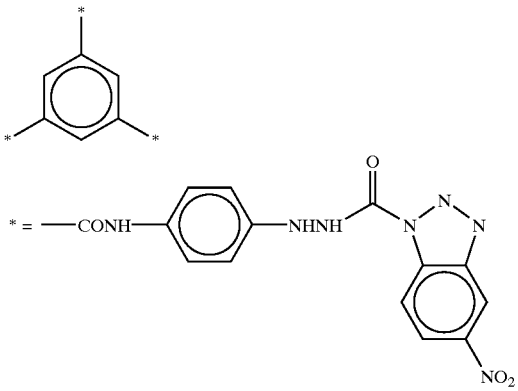

-continued
3-55
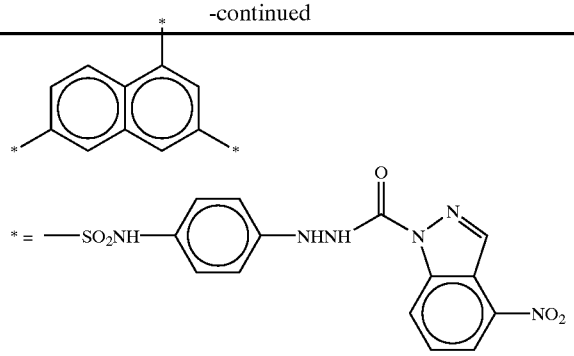
3-56
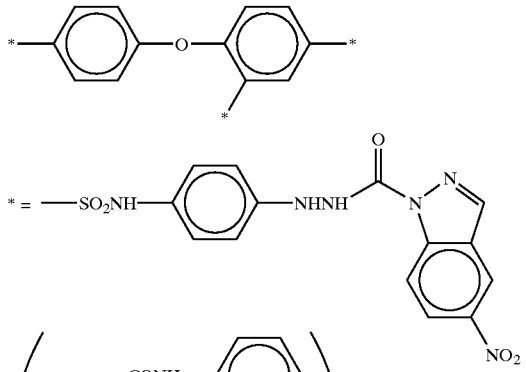
3-57
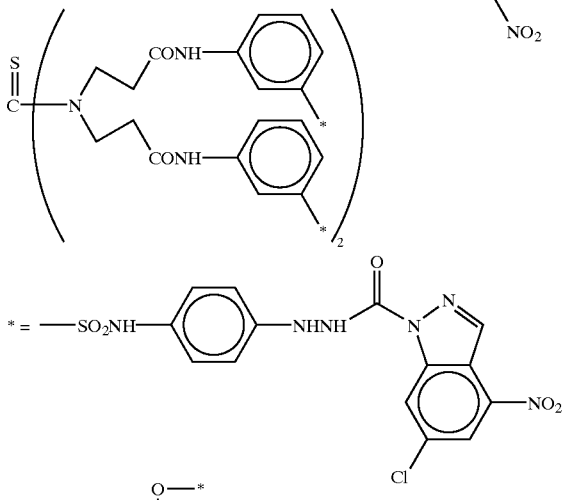
3-58
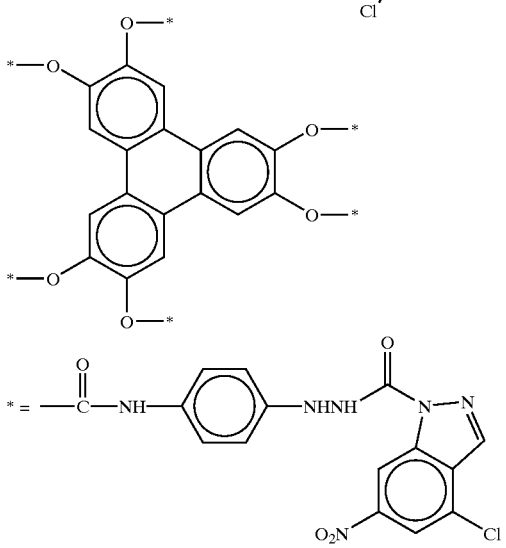

-continued
3-59
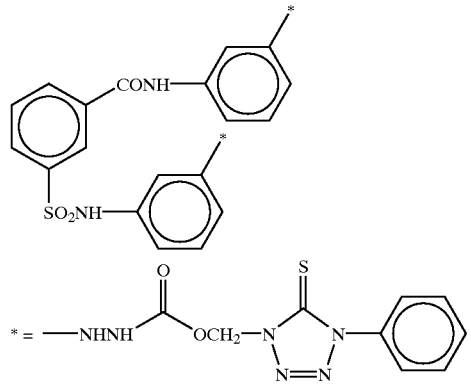
3-60
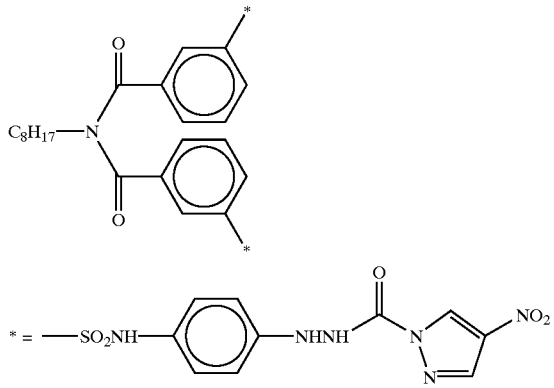
3-61
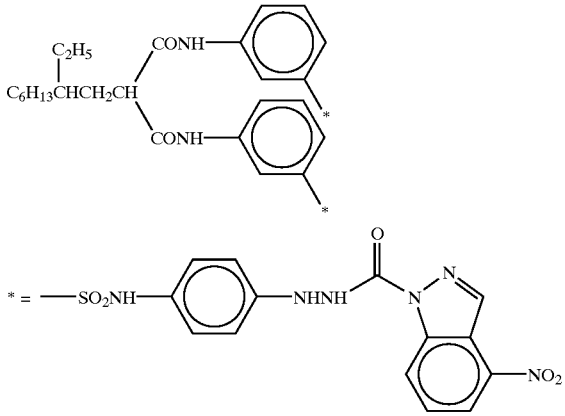
3-62
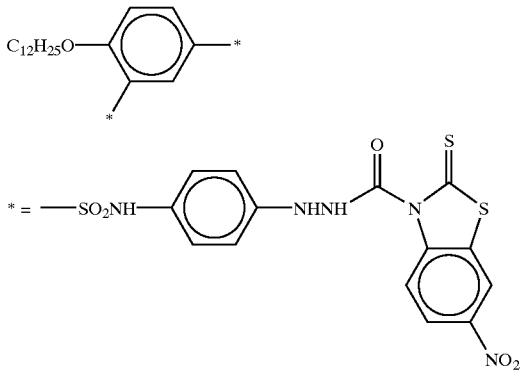

-continued
3-63
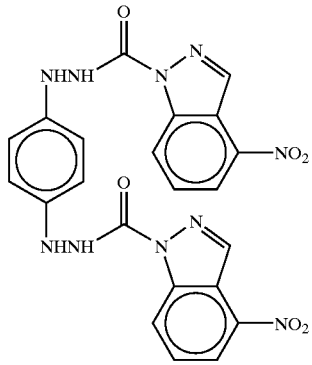
3-64
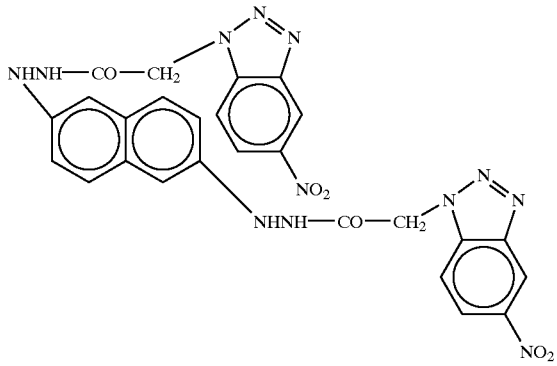
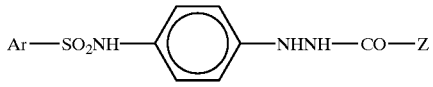
| No. | Ar = | Z = |
|---|---|---|
| R-1 | 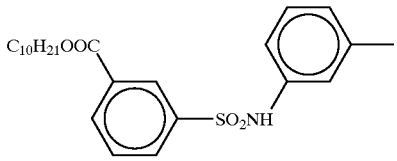 | 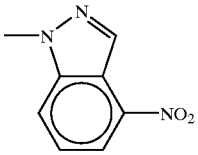 |
| R-2 | 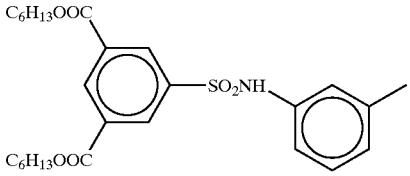 | 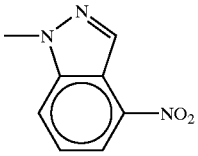 |
| R-3 | 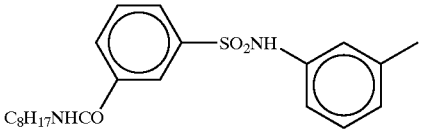 | 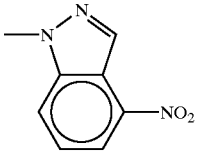 |
| R-4 | 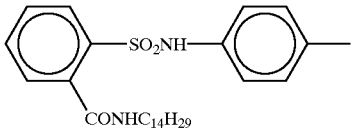 | 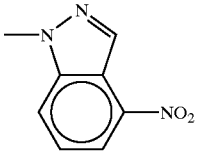 |

-continued
| | | |
|---|---|---|
| R-5 | 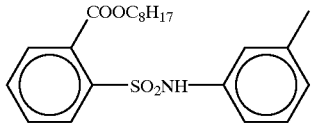 | 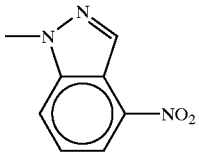 |
| R-6 | 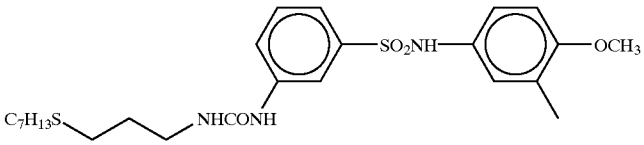 | 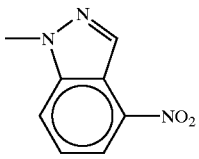 |
| R-7 | 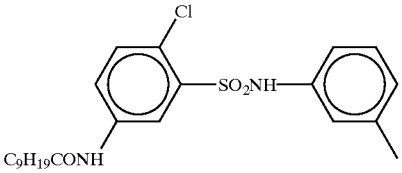 | 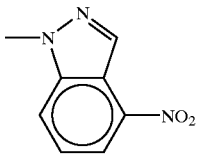 |
| R-8 | 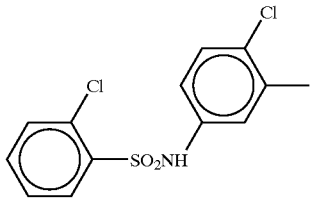 | 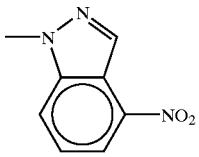 |
| R-9 | 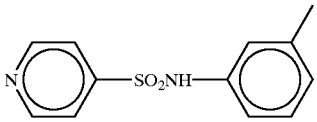 | 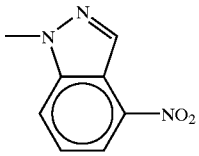 |
| R-10 | 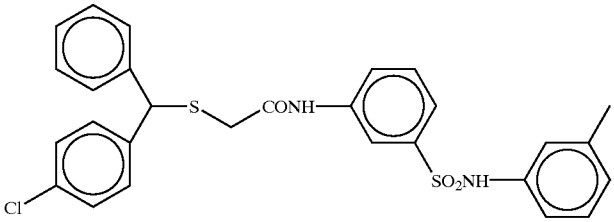 | 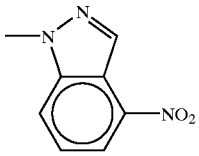 |
| R-11 | 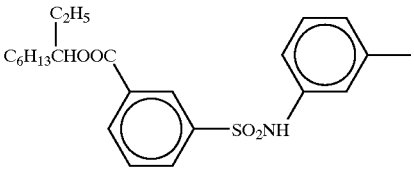 | 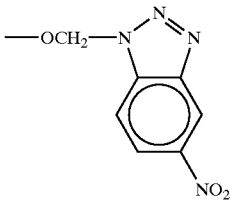 |
| R-12 | 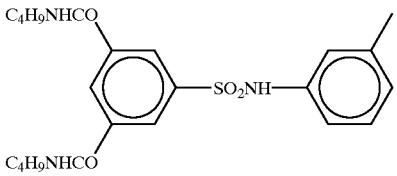 | 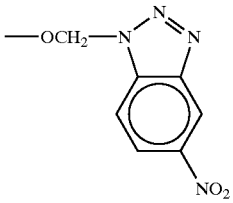 |

-continued
R-13
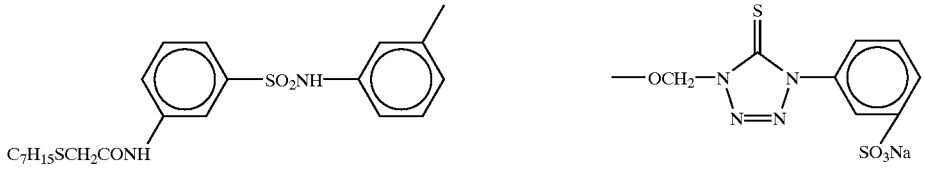
R-14
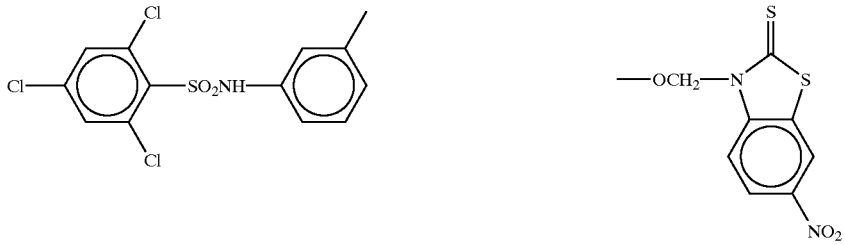
R-15
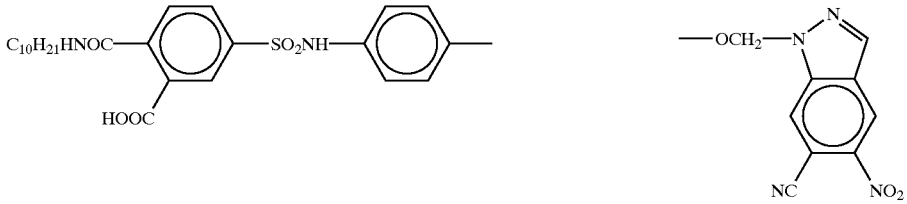
R-16
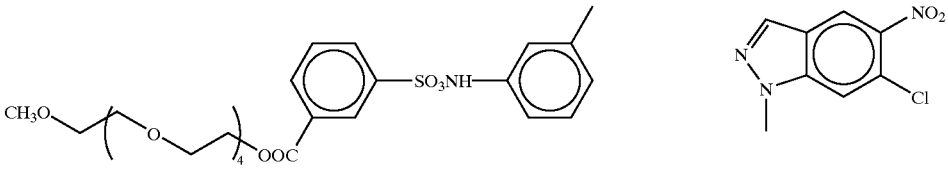
R-17
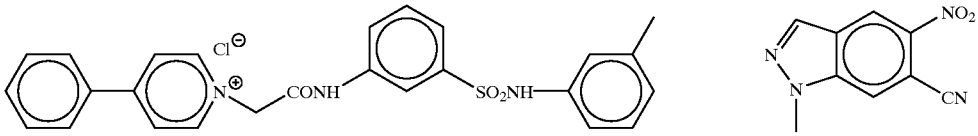
R-18
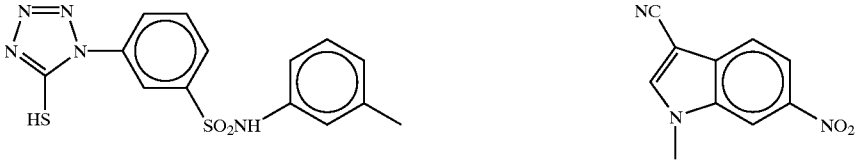
R-19
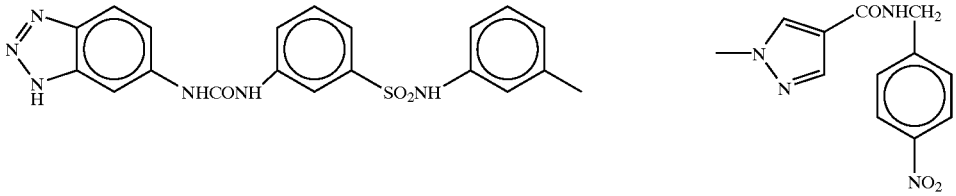
R-20
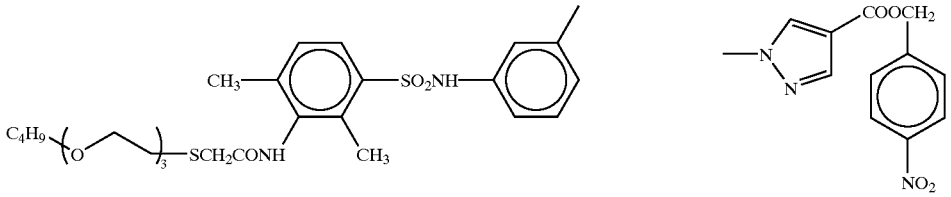

-continued
| | | |
|---|---|---|
| R-21 | 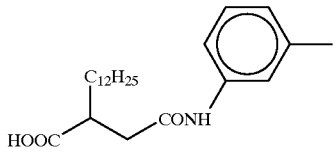 | 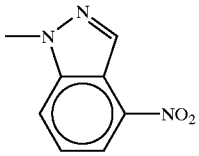 |
| R-22 | 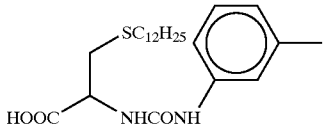 | 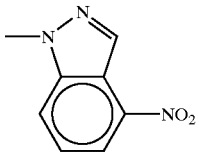 |
| R-23 | 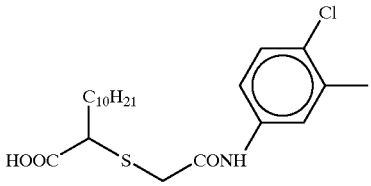 | 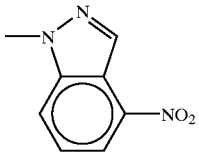 |
| R-24 | 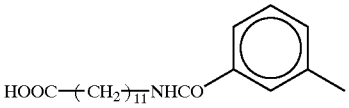 | 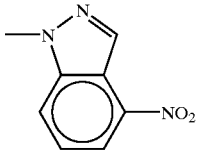 |
| R-25 | 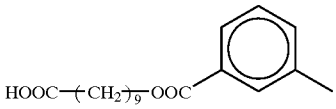 | 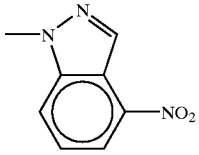 |
| R-26 | 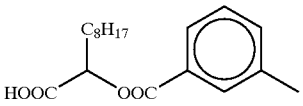 | 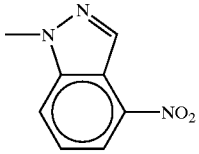 |
| R-27 | 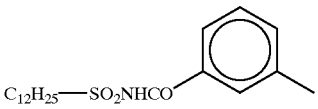 | 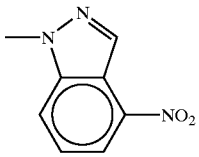 |
| R-28 | 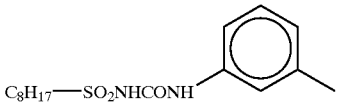 | 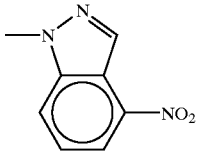 |
| R-29 | 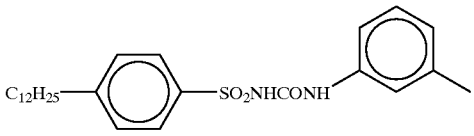 | 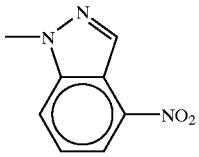 |

-continued
R-30
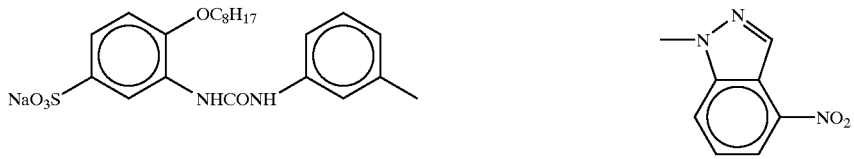
R-31
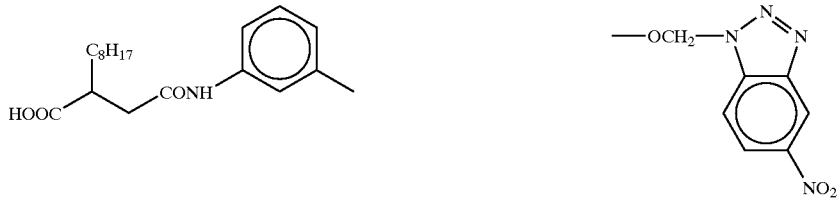
R-32
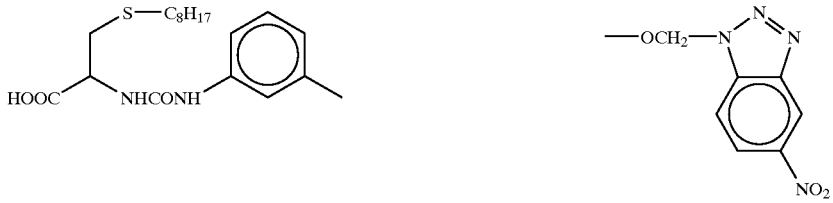
R-33
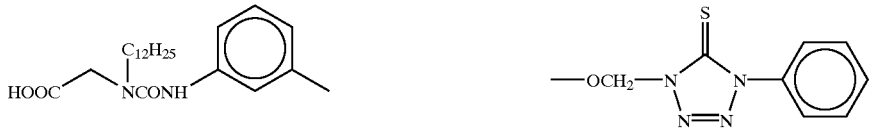
R-34
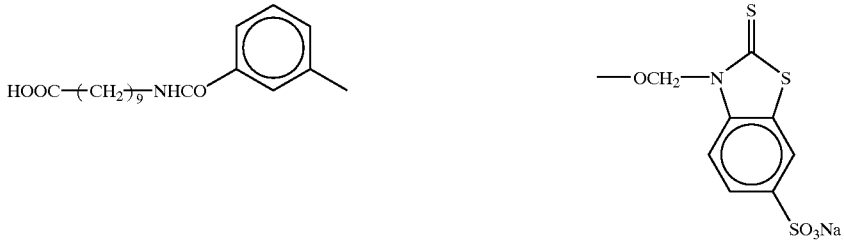
R-35
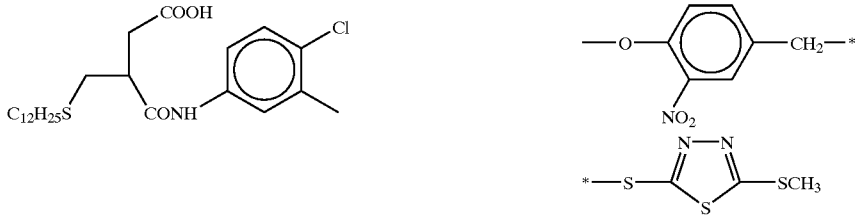
R-36
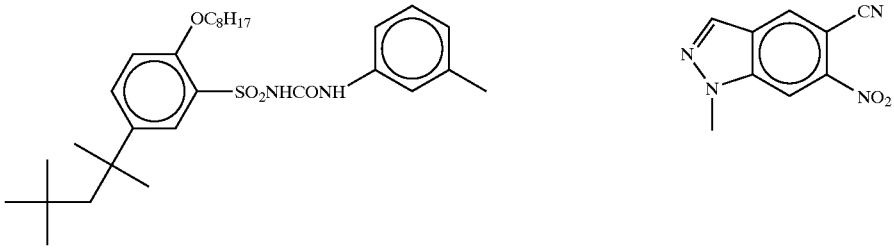

-continued
| | | |
|---|---|---|
| R-37 | 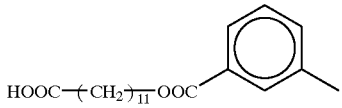 | 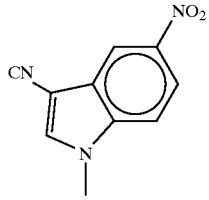 |
| R-38 | 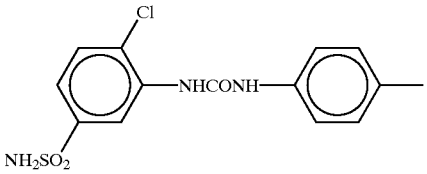 | 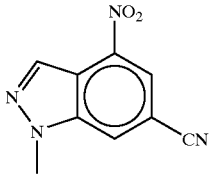 |
| R-39 | 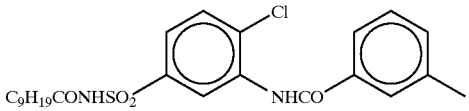 | 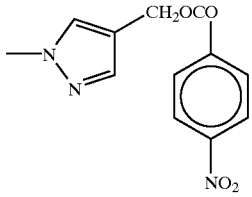 |
| R-40 | 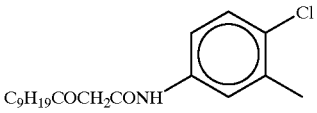 | 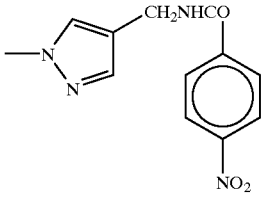 |
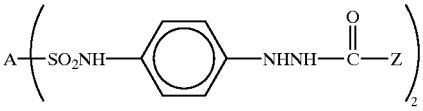
| No. | A = | Z = |
|---|---|---|
| R-41 | 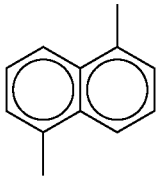 | 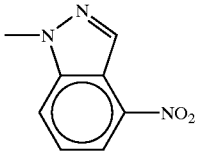 |
| R-42 | 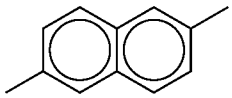 | 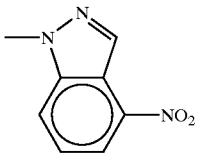 |
| R-43 | 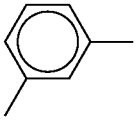 | 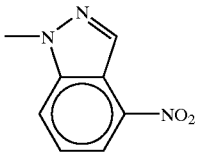 |

-continued
| | | |
|---|---|---|
| R-44 | 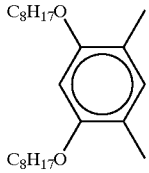 | 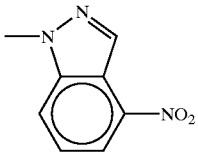 |
| R-45 | 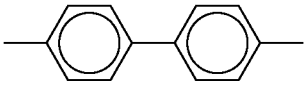 | 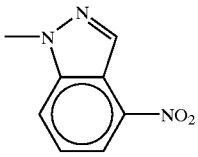 |
| R-46 | 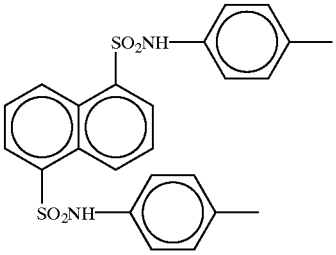 | 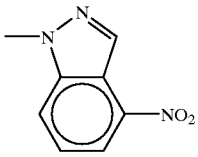 |
| R-47 | 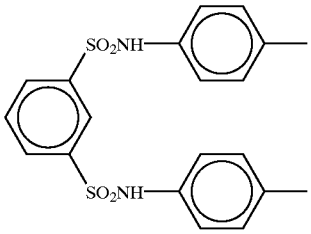 | 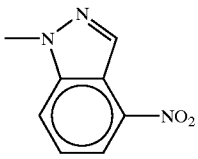 |
| R-48 | 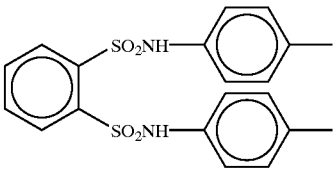 | 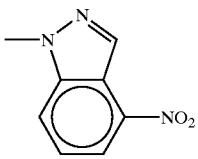 |
| R-49 | 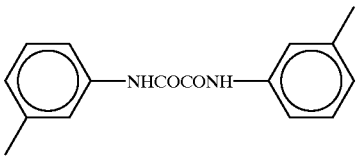 | 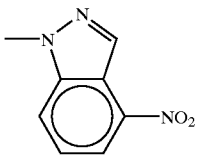 |
| R-50 | 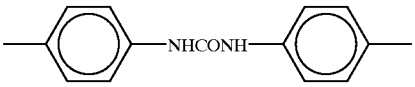 | 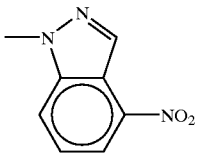 |
| R-51 | 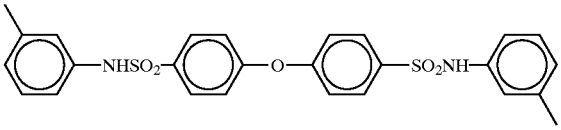 | 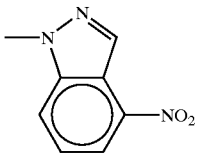 |

-continued
R-52
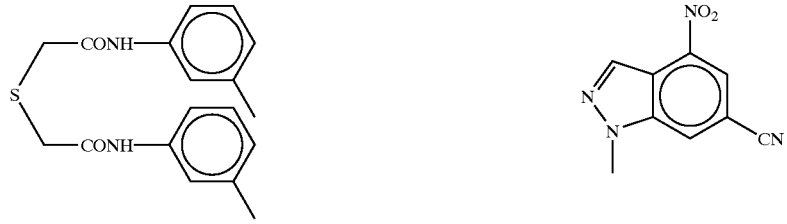
R-53
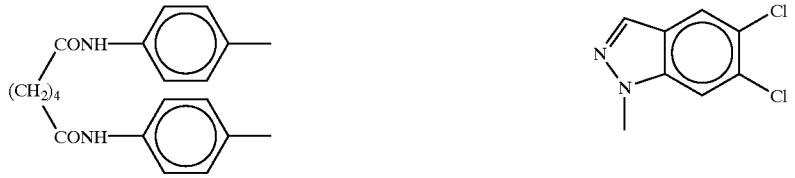
R-54
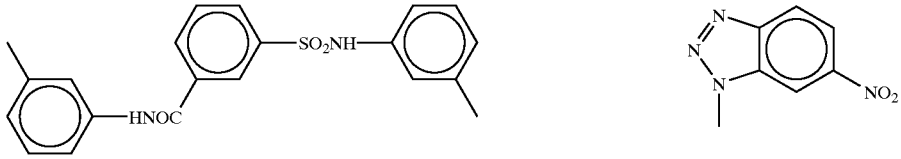
R-55
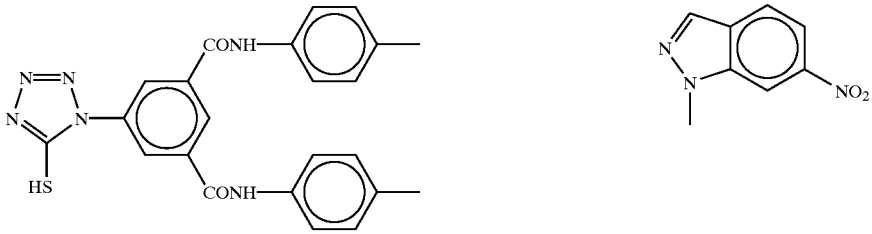
R-56
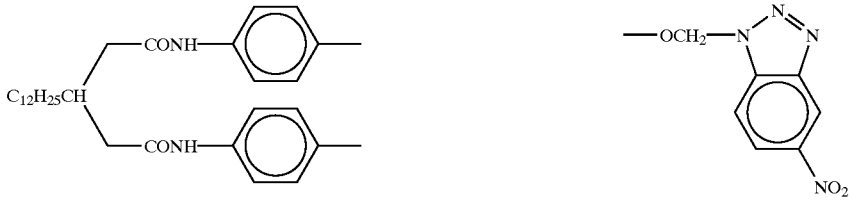
R-57
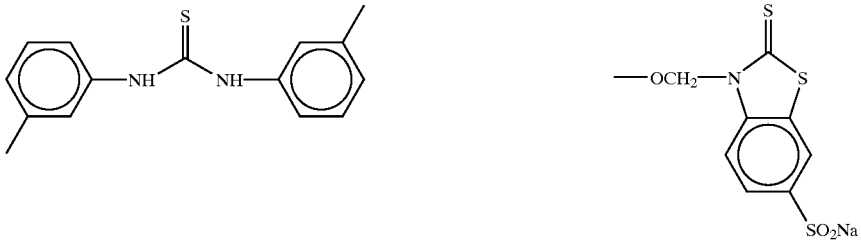
R-58
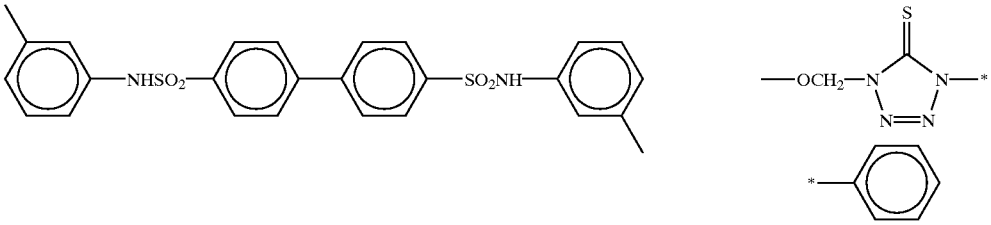

-continued
R-59
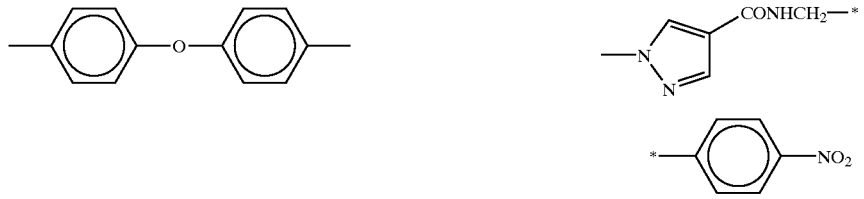
R-60
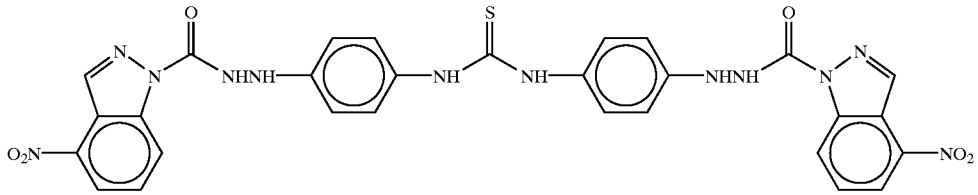
R-61
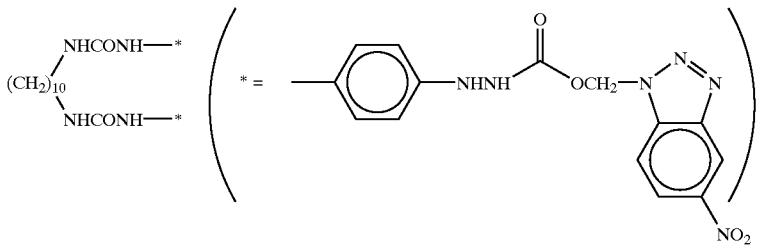
R-62
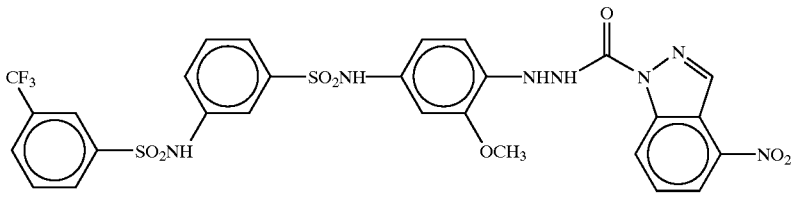
R-63
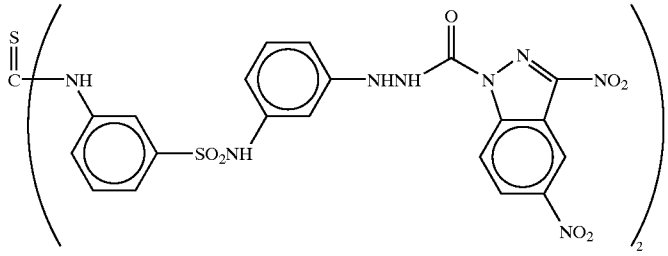
R-64
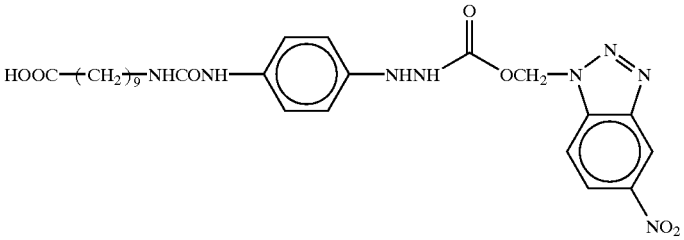

-continued
R-65
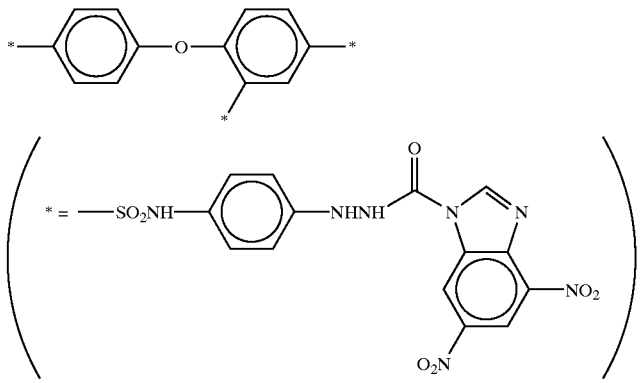
R-66
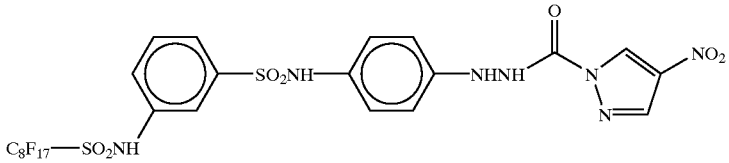
R-67
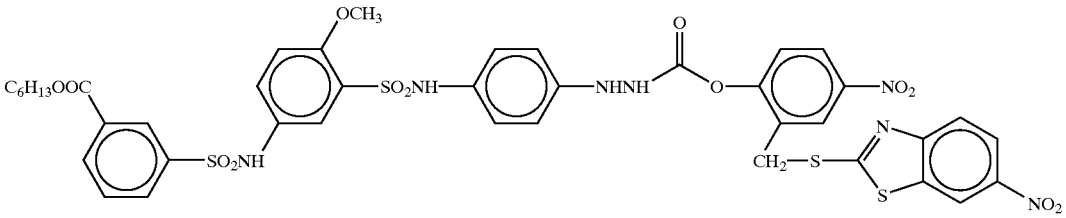
R-68
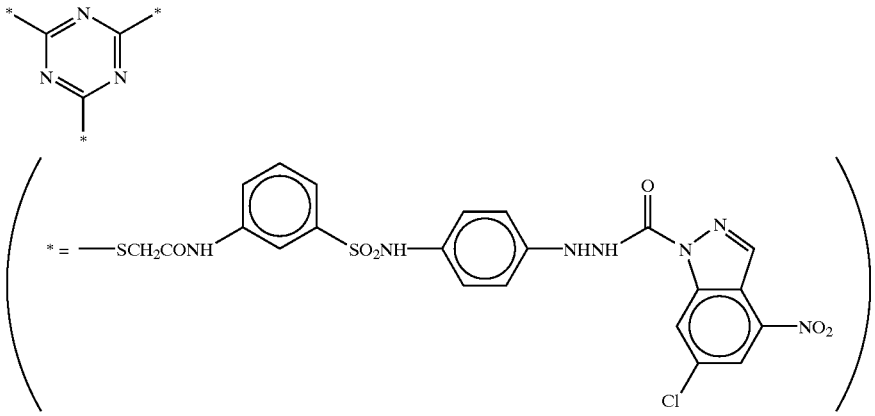
R-69
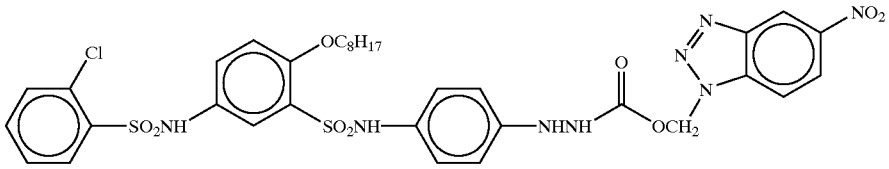

-continued

R-70

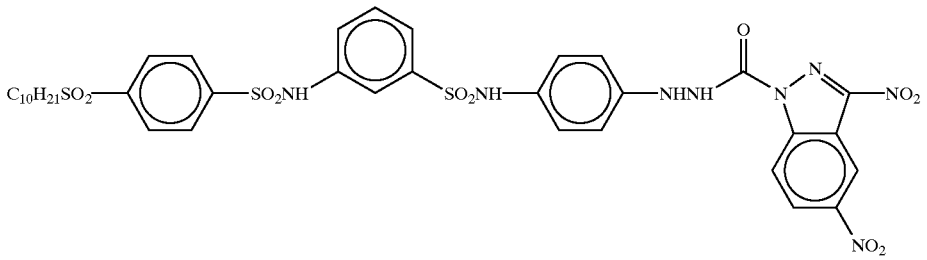

The redox compounds for use in the present invention can be easily synthesized by a known method. With regard to these synthetic methods for the compounds represented by formula (1) and (2) may be synthesized on referring to, for example, the methods described in Japanese Patent No. 2632056 and Japanese Patent No. 2725088. The compounds represented by formula (3) may be synthesized on referring to the synthetic methods, for example, described in Japanese Patent No. 2632056, Japanese Patent No. 2725088, JP-A-9-235264, JP-A-9-235265, JP-A-9-235266, JP-A-9-235267, partialy. Specfic synthesis examples are below.

SYNTHESIS EXAMPLE 1

Synthesis of the Exemplified Compound 1-1

14.8 ml of pyridine was added to a mixed solution of 40 ml of dimethylacetamide and 80 ml of acetonitrile containing 50. 9 g of 1-{4-(3-aminobenzenesulfonamide) phenyl}-2-formylhydrazine and the mixture was cooled to 0° C. 80 ml of an ethyl acetate solution containing 59.9 g of decyl 3-(chlorosulfonyl) benzoate was added dropwise to the mixture at 5° C. The resulting mixture was stirred at 20° C. for one hour, to which were then added 200 ml of ethyl acetate and 200 ml of 1N hydrochloric acid to carry out solution separation. The organic layer was washed with 200 ml of 1N hydrochloric acid and further with 200 ml of a 20% saline two times. The organic layer was then concentrated under reduced pressure to obtain an amorphous product.

The above amorphous product was dissolved in a mixed solvent consisting of 130 ml of acetonitrile and 130 ml of isopropyl alcohol, to which was added 35.9 g of naphthalene-1,5-disulfonic acid. The obtained mixed solution was stirred at 50° C. for 2 hours and then 260 ml of dimethylacetamide and 54.5 g of the synthesized intermediate X were added to the mixed solution at room temperature. The reaction solution was cooled to 10° C. and in succession, 53 ml of triethylamine was added dropwise to the reaction solution at 25° C. or less, followed by stirring at 25° C. for 2 hours. After the reaction was finished, 600 ml of ethyl acetate and 1300 ml of water were added to the resulting solution to carry out solution separation. The organic layer was washed with 500 ml of 1N hydrochloric acid and further with 500 ml of a 20% saline, followed by concentrating the solution under reduced pressure. 500 ml of methanol was added to the concentrate and the resulting concentrate was heated to 50° C. 50 ml of water was added to the resulting concentrate, which was then stirred at 500C for one hour and then cooled to 5° C. to separate the crystals by filtration, thereby obtaining the exemplified compound 1-1 in an amount of 92.0 g.

SYNTHESIS EXAMPLE 2

Synthesis of the Exemplified Compound 1-4

The exemplified compound 1-4 was synthesized in the same manner as in the above synthesis example 1 except that dodecyl 3-(chlorosulfonyl) benzoate was used in place of decyl 3-(chlorosulfonyl) benzoate.

SYNTHESIS EXAMPLE 3

Synthesis of the Exemplified Compound 1-7

The exemplified compound 1-7 was synthesized in the same manner as in the above synthesis example 1 except that dihexyl 5-(chlorosulfonyl)isophthalate was used in place of decyl 3-(chlorosulfonyl) benzoate.

SYNTHESIS EXAMPLE 4

Synthesis of the Exemplified Compound 2-2

The exemplified compound 2-2 was synthesized according to a synthetic scheme shown by the scheme 1.

scheme 1

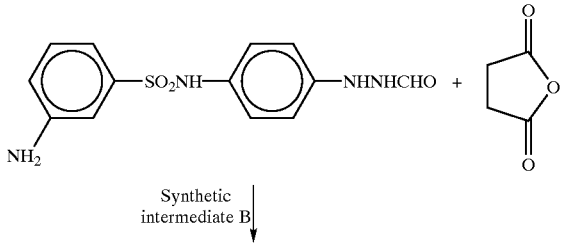

-continued

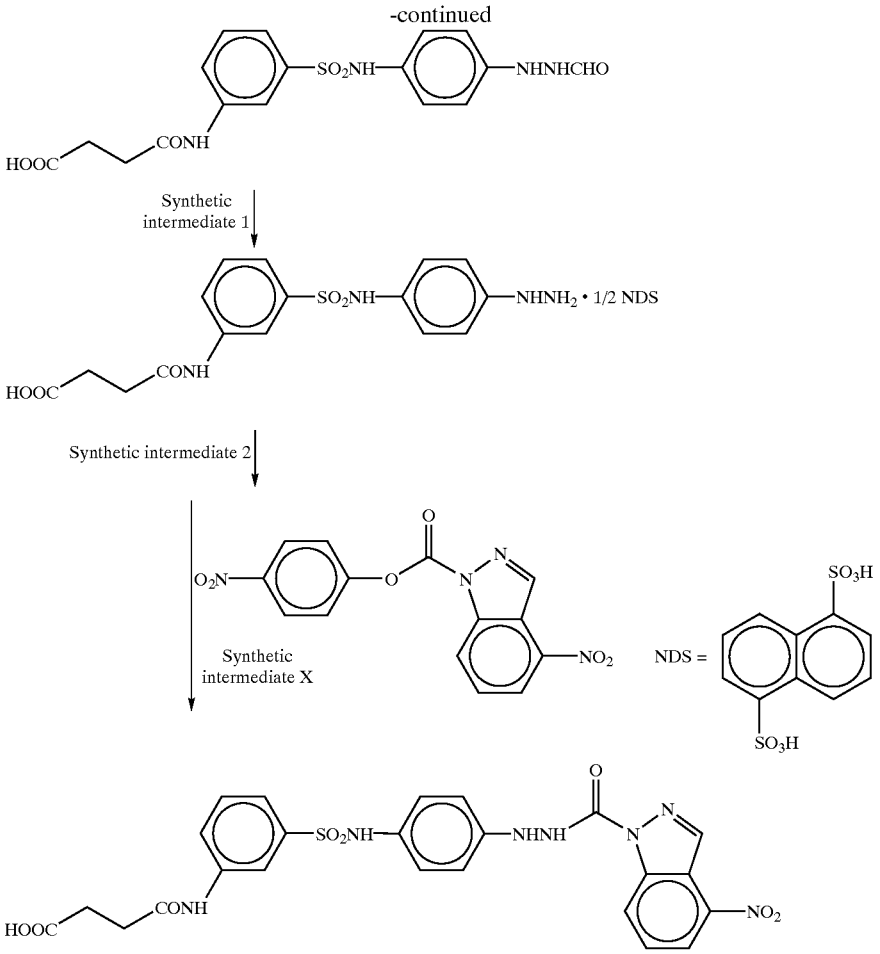

Exemplified compound 2-2

Preparation of Synthetic Intermediate B

N-4-aminophenyl-N'-formylhydrazine was reacted with m-nitrobenzenesulfonyl chloride and the resulting N-{4-(m-nitrobenzenesulfonamide)phenyl}—N'-formylhydrazine was reduced using iron to prepare a synthetic intermediate B.

Synthesis of Synthetic Intermediate 1

46.0 g (0.15 mol) of the synthetic intermediate B was dissolved in 30 ml of DMAc and 75 ml of acetonitrile. A solution obtained by dissolving 15.0 g (0.15 mol) of succinic acid anhydride in 75 ml of acetonitrile was added dropwise to the mixture at 10° C. or less. The resulting mixture was reacted at room temperature for 3 hours and thereafter ethyl acetate was added to the reaction mixture, which was then washed with 1N hydrochloric acid and further with a saline. The washed mixture was dried using mirabilite and subjected to filtration. The filtrate was concentrated under reduced pressure. Acetonitrile was added to the concentrated filtrate to form crystals, which were then collected by filtration to obtain a synthetic intermediate 1 in an amount of 44.3 g (yield: 73%).

Synthesis of Synthetic Intermediate 2

40.6 g (0.1 mol) of the synthetic intermediate 1 and 18.0 g (0.05 mol) of 1,5-naphthalene disulfonic acid were added to a solution containing 400 ml of acetonitrile and 60 ml of water. The mixture was stirred at 35° C. for 2 hours and cooled to 10° C. The crystals were collected by filtration to obtain a synthetic intermediate 2 in an amount of 38.2 g (yield: 73%).

Synthesis of the Exemplified Compound 2-2

A synthetic intermediate X: 1-(p-nitrophenoxycarbonyl)-4-nitroindazole was prepared from 4-nitroindazole and p-nitrophenyl chloroformate.

20.9 g (0.04 mol) of the synthetic intermediate 2 and 13.1 g (0.04 mol) of the synthetic intermediate X were added to 100 ml of N,N-dimethylacetamide. 5.6 ml (0.04 mol) of triethylamine was added dropwise to the mixture at room temperature. After the mixture solution was stirred for 3 hours, the reaction solution was poured into 1N hydrochloric acid, which was subjected to extraction using ethyl acetate. The extract was concentrated and methanol was added to the concentrated extract to crystallize. The product was collected by filtration to obtain the exemplified compound 2-2 in amount of 19.0 g (yield: 84%). Mp: 222° C. (dec.)

SYNTHESIS EXAMPLE 5

Synthesis of the Exemplified Compound 2-1)

The exemplified compound 2-1 could be synthesized in the same manner as in the above synthesis example 4 except that 2-dodecylsuccinic acid anhydride was used in place of succinic acid anhydride.

SYNTHESIS EXAMPLE 6

Synthesis of the Exemplified Compound 2-3

The exemplified compound 2-3 could be synthesized in the same manner as in the above synthesis example 4 except that 2-octylsuccinic acid anhydride was used in place of succinic acid anhydride and N-{4-(2-chloro-5-aminobenzenesulfonamide)phenyl}—N'-formylhydrazine was used in place of the synthetic intermediate B.

SYNTHESIS EXAMPLE 7

Synthesis of the Exemplified Compound 3-17

The exemplified compound 3-17 was synthesized according to a synthetic scheme shown by the scheme 2.

scheme 2

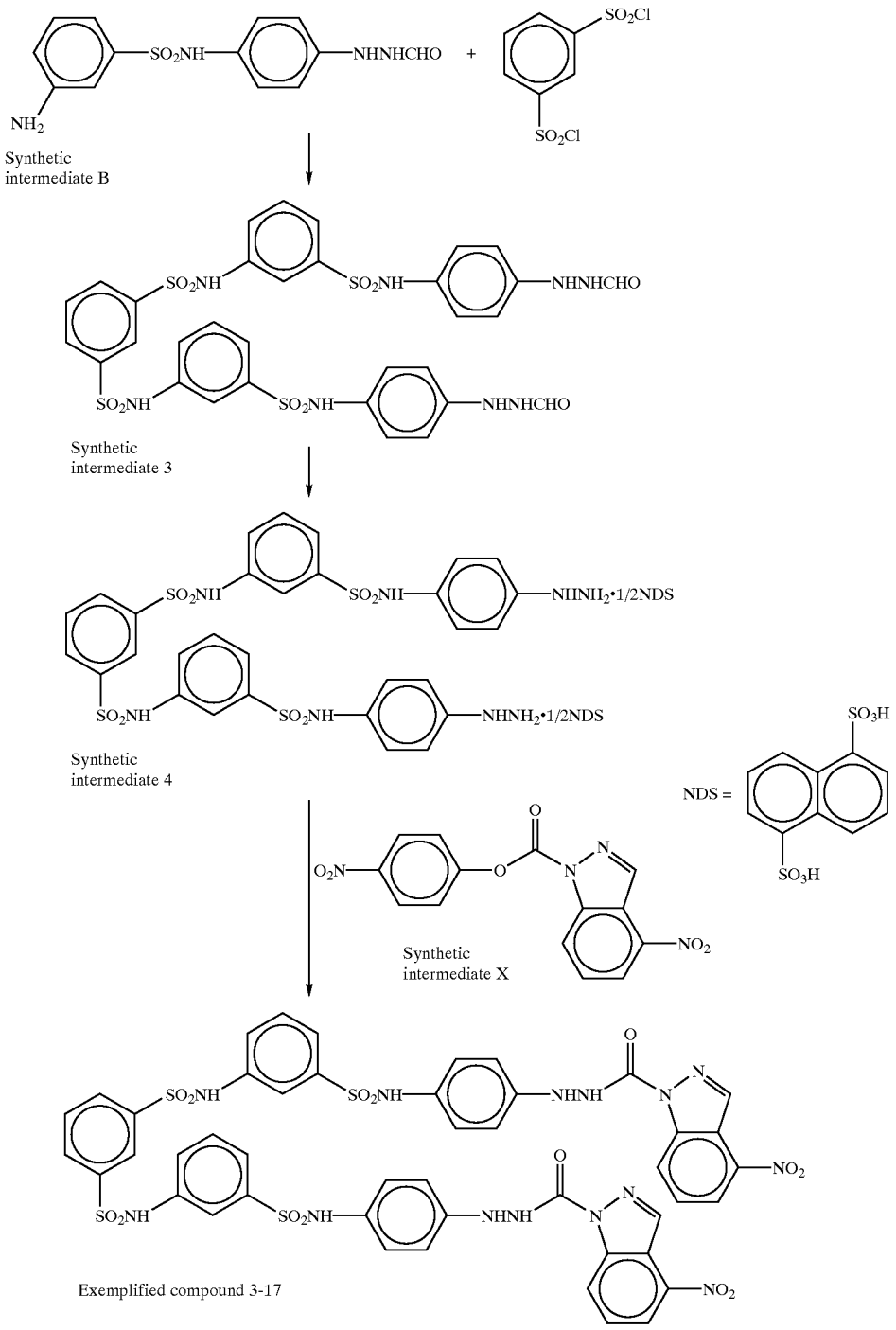

Preparation of a Synthetic Intermediate B

A synthetic intermediate B was prepared in the same manner as in synthesis example 4.

Preparation of a Synthetic Intermediate 3

11.1 g of the synthetic intermediate B was dissolved in 30 ml of DMAc and 75 ml of acetonitrile. 75 ml of an acetonitrile solution containing 5.0 g of 1,3-dichlorosulfonylbenzene was added dropwise to the mixture at 10° C. or less. The resulting mixture was reacted at room temperature for 3 hours and ethyl acetate was added to the reaction mixture. The resulting reaction mixture was washed with 1N hydrochloric acid and further with a saline. The washed mixture was dried using mirabilite and subjected to filtration. The filtrate was concentrated under reduced pressure to obtain an amorphous synthetic intermediate 3 in an amount of 14.6 g.

Synthesis of a Synthetic Intermediate 4

14.6 g of the synthetic intermediate 3 and 6.55 g of 1,5-naphthalenedisulfonic acid were added to 50 ml of methanol and the mixture was stirred at 50° C. for 2 hours. After the mixture was cooled to 10° C., acetonitrile was added in a proper amount to the mixture to crystallize. The product was collected by filtration to obtain white crystals of a synthetic intermediate 4 in an amount of 14.63 g (the yield was 77% in two steps).

Synthesis of the Exemplified Compound 3-17

A synthetic intermediate X: 1-(p-nitrophenoxycarbonyl)-4-nitroindazole was prepared from 4-nitroindazole and p-nitrophenyl chloroformate. 5.0 g of the synthetic intermediate 4 and 3.0 g of the synthetic intermediate X were added to 30 ml of N,N-dimethylacetamide. 1.4 ml of triethylamine was added dropwise to the mixture at room temperature. After the reaction solution was stirred for 3 hours, it was poured into 1N hydrochloric acid, which was subjected to extraction using ethyl acetate. The extract was concentrated and purified by column chromatography. The crude crystals were recrystallized from a mixed solvent of methylene chloride and n-hexane to obtain the exemplified compound 3-17 in an amount of 3.6 g (yield: 64.5%).

SYNTHESIS EXAMPLE 8

Synthesis of the Exemplified Compound 3-18

The exemplified compound 3-18 could be synthesized in the same manner as in the above synthesis example 7 except that 1,2-dichlorosulfonylbenzene was used in place of 1,3-dichlorosulfonylbenzene (yield: 66.3%).

SYNTHESIS EXAMPLE 9

Synthesis of the Exemplified Compound 3-3

The exemplified compound 3-1 could be synthesized in the same manner as in the above synthesis example 7 except that 1,5-naphthalenedisulfonic acid dichloride was used in place of 1,3-dichlorosulfonylbenzene.

The redox compounds represented by the formulae (1) to (3) are each used in an amount ranging from $1\times10^{-6}$ to $5\times10^{-2}$ mol and more preferably from $1\times10^{-5}$ to $1\times10^{\oplus 2}$ mol based on 1 mol of silver halide in all emulsion contained in the light-sensitive material. Also, two or more redox compounds may be used together. Each of the redox compounds represented by the formulae (1) to (3) may be dissolved in a proper water-miscible organic solvent, for example, alcohols (methanol, ethanol, propanol or fluorinated alcohol), ketones (acetone or methyl ethyl ketone), dimethylformamide, dimethyl sulfoxide or methyl cellosolve upon use.

The redox compound may be used in the form of an emulsified dispersion produced mechanically by dissolving it by using an auxiliary solvent such as dibutyl phthalate, tricresyl phosphate, oils such as glyceryl triacetate and diethyl phthalate, ethyl acetate or cyclohexanone according to a conventionally well-known emulsion dispersion method. Alternatively, a powder of the redox compound can be dispersed in water by using a ball mill, colloid mill or ultrasonic waves according to a method known as the solid dispersion method upon use. In the present invention, further, the redox compound may be used by carrying out dispersion (polymer dispersion) using a polymer in a dispersion medium as described in JP-A-11-15091, paragraphs 0046 to 0074.

The redox compounds represented by the formulae (1) to (3) are added to a silver halide emulsion layer or other hydrophilic colloidal layers. The redox compound may also be added to at least one of plural silver halide emulsion layers.

Several examples of the structure will be shown below. However, the present invention is not limited to these examples.

STRUCTURE EXAMPLE 1

This structure has a silver halide emulsion layer containing the above redox compound and a protective layer on a support. The emulsion layer or the protective layer may contain a hydrazine derivative described below as a nucleating agent.

STRUCTURE EXAMPLE 2

This structure has a first silver halide emulsion layer and a second silver halide emulsion layer in this order on a support. The first silver halide emulsion layer or a hydrophilic colloidal layer adjacent thereto contains the hydrazine derivative, and the second silver halide emulsion layer or a hydrophilic colloidal layer adjacent thereto contains the redox compound.

STRUCTURE EXAMPLE 3

This structure is the same as the Structure example 2) except that the order of two emulsion layers are reversed.

In the Structure examples 2) and 3), an intermediate layer containing a gelatin or a synthetic polymer (e.g., a polyvinyl acetate or a polyvinyl alcohol) may be provided between two light-sensitive emulsion layers.

STRUCTURE EXAMPLE 4

This structure has a silver halide emulsion layer containing the hydrazine derivative on a support and a hydrophilic colloidal layer containing the redox compound either on the emulsion layer or between the support and the silver halide emulsion layer.

A particularly preferable structure is the Structure example 2) or 3).

In the present invention, it is preferable to further contain at least one nucleating agent. Preferable nucleating agent is a hydrazine derivative represented by the formula (D).

formula (D)

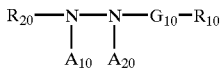

wherein $R_{20}$ represents an aliphatic group, an aromatic group, or a heterocyclic group; $R_{10}$ represents a hydrogen atom or a blocking group; $G_{100}$ represents a —CO—, —COCO—, —C(=S)—, —$SO_2$—, —SO—, or —PO($R_{30}$)— group (in which $R_{30}$ is selected from the same range of groups for $R_{10}$as defined below, and $R_{30}$ and $R_{10}$ is the same or different), or an iminomethylene group; $A_{10}$ and $A_{20}$ each represent a hydrogen atom, or one of them is a hydrogen atom and the other is a substituted or unsubstituted alkylsulfonyl group, a substituted or unsubstituted arylsulfonyl group, or a substituted or unsubstituted acyl group.

In formula (D), the aliphatic group represented by $R_{20}$ is preferably a substituted or unsubstituted straight-chain, branched-chain, or cyclic alkyl, alkenyl, or alkynyl group, each having 1 to 30 carbon atoms.

In formula (D), the aromatic group represented by $R_{20}$ is a monocyclic or condensed-ring aryl group. Examples of the ring include a benzene ring and a naphthalene ring. The heterocyclic group represented by $R_{20}$ is a monocyclic or condensed-ring, saturated or unsaturated, aromatic or non-aromatic heterocyclic group. Examples of the ring include a pyridine, a pyrimidine, an imidazole, a pyrazole, a quinoline, an isoquinoline, a benzimidazole, a thiazole, a benzothiazole, a piperidine, and a triazine ring.

$R_{20}$ is preferably an aryl group, and especially preferably a phenyl group.

$R_{20}$ may be substituted with a substituent. Typical examples of the substituent include a halogen atom (fluorine, chlorine, bromine, or iodine), an alkyl group, which includes an aralkyl group, a cycloalkyl group, and an active methine group; an alkenyl group, an alkynyl group, an aryl group, a heterocyclic group, a quaternary nitrogen atom-containing heterocyclic group (e.g. a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group; an alkoxy group, which group contains a group containing a repeating unit of an ethyleneoxy group or a propyleneoxy group; an aryloxy group, a heterocyclic oxy group, an acyloxy group, an,(alkoxy or aryloxy)carbonyloxy group, a carbamoyloxy group, a sulfonyloxy group, an amino group, an (alkyl, aryl, or heterocyclic)amino group, an N-substituted nitrogen-containing heterocyclic group, an acylamino group, a sulfonamide group, a ureido group, a thioureido group, an isothioureido group, an imido group, an (alkoxy or aryloxy)-carbonylamino group, a sulfamoylamino group, a semicarbazido group, a thiosemicarbazido group, a hydrazino group, a quaternary ammonio group, an oxamoyl amino group, an (alkyl or aryl)sulfonylureido group, an acylureido group, an N-acylsulfamoylamino group, a nitro group, a mercapto group, an (alkyl, aryl, or heterocyclic)-thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group having a phosphonamide or phosphate structure.

These substitutes may be further substituted by any of the above substituents.

Preferable examples of the substituent that $R_{20}$ may have include an alkyl group having 1 to 30 carbon atoms, wherein an active methylene group is included; an aralkyl group, a heterocyclic group, a substituted amino group, an acrylamino group, a sulfonamide group, a ureido group, a sulfamoylamino group, an imido group, a thioureido group, a phosphonamide group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl, or heterocyclic)thio group, a sulfo group or a salt thereof, a sulfamoyl group, a halogen atom, a cyano group, and a nitro group.

In formula (D), $R_{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group, and a hydrazino group.

The alkyl group represented by $R_{10}$ is preferably an alkyl group having 1 to 10 carbon atoms. Specific examples of the alkyl group include a methyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a methanesulfonamidomethyl group, a benzenesulfonamidomethyl group, a hydroxymethyl group, a methoxymethyl group, a methylthiomethyl group, a phenylsulfonylmethyl group, and an o-hydroxybenzyl group. The alkenyl group is preferably an alkenyl group having 1 to 10 carbon atoms. Examples of the alkenyl group include a vinyl group, a 2,2-dicyanovinyl group, a 2-ethoxycarbonylvinyl group, and a 2-trifluoro-2-methoxycarbonylvinyl group. The alkynyl group is preferably an alkynyl group having 1 to 10 carbon atoms. Examples of the alkynyl group include an ethynyl group and a 2-methoxycarbonylethynyl group. The aryl group is preferably a monocyclic or condensed-ring aryl group, and especially preferably an aryl group containing a benzene ring. Examples of the aryl group include a phenyl group, a 3,5-dichlorophenyl group, a 2-methanesulfonamidephenyl group, a 2-carbamoylphenyl group, a 4-cyanophenyl group, and a 2-hydroxymethylphenyl group.

The heterocyclic group is preferably a 5- or 6-membered, saturated or unsaturated, monocyclic or condensed-ring heterocyclic group that contains at least one nitrogen, oxygen, or sulfur atom. Examples of the heterocyclic group include a morpholino group, a piperidino group (N-substituted), a piperazino group, an imidazolyl group, an indazolyl group (e.g. a 4-nitroindazolyl group), a pyrazolyl group, a triazolyl group, a benzimidazolyl group, a tetrazolyl group, a pyridyl group, a pyridinio group (e.g. a N-methyl-3-pyridinio group), a quinolinio group, and a quinolyl group. Among these, especially preferred are a morpholino group, a piperidino group, a pyridyl group, and a pyridinio group.

The alkoxy group is preferably an alkoxy group having 1 to 8 carbon atoms. Examples of the alkoxy group include a methoxy group, a 2-hydroxyethoxy group, and a benzyloxy group. The aryloxy group is preferably a phenyloxy group. The amino group is preferably an unsubstituted amino group, an alkylamino group having 1 to 10 carbon atoms, an arylamino group, or a saturated or unsaturated heterocyclic amino group, wherein a quaternary nitrogen atom-containing heterocyclic group is included. Examples of the amino group include a 2,2,6,6-tetramethylpiperidine-4-ylamino group, a propylamino group, a 2-hydroxyethylamino group, an anilino group, an o-hydroxyanilino group, a 5-benzotriazolylamino group, and an N-benzyl-3-piridinioamino group. The hydrazino group is especially preferably a substituted or unsubstituted hydrazino group, or a substituted or unsubstituted phenylhydrazino group (e.g. a 4-benzenesulfonamidophenylhydrazino group).

These groups represented by $R_{10}$ may be substituted with a substituent. Preferable examples of the substituent are the same as those mentioned as the substituent of $R_{20}$.

In formula (D), $R_{10}$ may be an atomic group capable of splitting a part of $G_{10}$-$R_{10}$ from the residual molecule, and subsequently of taking place cyclization reaction by which a cyclic structure containing atoms of the —$G_{10}$—$R_{10}$ part is formed. Examples of the atomic groups include those described, for example, in JP-A-63-29751.

The hydrazine derivatives represented by formula (D) may contain an adsorptive group capable of being adsorbed onto the silver halide. Examples of the adsorptive group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these adsorptive groups onto the silver halide may be modified into a precursor thereof. Examples of the precursor include those groups described in JP-A-2-285344.

$R_{10}$or $R_{20}$ of formula (D) may contain a polymer or a ballasting group that is usually used for immobile photographic additives, such as a coupler. The ballasting group in the present invention has 6 or more carbon atoms, and it is a group relatively inactive to photographic properties. The ballasting group can be selected from a straight-chain or branched, alkyl group (or alkylene group), alkoxy group (or alkyleneoxy group), alkylamino group (or alkyleneamino group), or alkylthio group, or a group having these groups as its partial structure. It is more preferable that the ballasting group is, having 7 or more but 24 or less carbon atoms, a straight-chain or branched, alkyl group (or alkylene group), alkoxy group (or alkyleneoxy group), alkylamino group (or alkyleneamino group), or alkylthio group, or a group having these groups as its partial structure. Examples of the polymer include those described, for example, in JP-A-1-100530.

$R_{10}$ or $R_{20}$ of formula (D) may contain a plurality of hydrazino groups as a substituent. At this time, the compound represented by formula (D) is a multimer of the hydrazino group. Specific examples of the compound include those described, for example, in JP-A-64-86134, JP-A-4-16938, JP-A-5-197091, WO95-32452, WO95-32453, JP-A-9-179229, JP-A-9-235264, JP-A-9-235265, JP-A-9-235266, and JP-A-9-235267.

$R_{10}$ or $R_{20}$ in the formula (D) may contain a cationic group (specifically, a group containing a quaternary ammonio group, a group containing a quaternary phosphorous atom or a nitrogen-containing heterocyclic group having a quaternary nitrogen atom), a group containing a repeating unit of an ethyleneoxy group or propyleneoxy group, an (alkyl, aryl or heterocyclic)thio group or a dissociating group (which means a group, or a partial structure, having a proton(s) of such low acidity that the proton is dissociable by an alkaline developer, or a salt of such a group or structure, specifically, for example, carboxy group/—COOH, sulfo group/—$SO_3H$, phosphonic acid group/—$PO_3H$, phosphoric acid group/—$OPO_3H$, hydroxy group/—OH, mercapto group/—SH, —$SO_2NH_2$, N-substituted sulfonamide group/—$SO_2NH$—, —$CONHSO_2$—, —$CONHSO_2NH$—, —$NHCONHSO_2$—, —$SO_2NHSO_2$—, —CONHCO—, an activated methylene group, —NH— inherent in a nitrogen-containing heterocyclic group, or salts of these groups). Examples of containing these groups include compounds described in JP-A-7-234471, JP-A-5-333466, JP-A-6-19032, JP-A-6-19031, JP-A-5-45761, U.S. Pat. No. 4,994,365, U.S. Pat. No. 4,988,604, JP-A-7-259240, JP-A-7-5610, JP-A-7-244348, German Patent No. 4,006,032, JP-A-11-7093.

In formula (D), $A_{10}$ and $A_{20}$ each represent a hydrogen atom or an alkyl or arylsulfonyl group having 20 or less carbon atoms (preferably, a phenylsulfonyl group, or a phenyl sulfonyl group substituted with a substituent(s) so that the total of the Hammett substituent constant of the substituent becomes −0.5 or more), or an acyl group having 20 or less carbon atoms (preferably, a benzoyl group, a benzoyl group substituted with a substituent(s) so that the total of the Hammett substituent constant of the substituent becomes −0.5 or more, or a straight-chain, branched, or cyclic, substituted or unsubstituted, aliphatic acyl group, wherein examples of the substituent include a halogen atom, an ether group, a sulfonamide group, a carbonamide group, a hydroxyl group, a carboxyl group, and a sulfo group). $A_{10}$ and $A_{20}$ each are most preferably a hydrogen atom.

Next, in the present invention, a particularly preferable hydrazine derivative will be explained.

As $R_{20}$, a substituted phenyl group is particularly preferably. As the substituent, a sulfonamide group, acylamino group, ureido group, carbamoyl group, thioureido group, isothioureido group, sulfamoylamino group or N-acylsulfamoylamino group is particularly preferable. A sulfonamide group or ureido group is more preferable and a sulfonamide group is most preferable.

In the hydrazine derivatives represented by the formula (D), $R_{20}$ or $R_{10}$ is particularly preferably substituted directly or indirectly with, as the substituent, at least one of the ballasting group, the group adsorptive onto the silver halide, the group containing the quaternary ammonio group, the nitrogen-containing heterocyclic group having a quaternary nitrogen atom, the group containing a repeating unit of an ethyleneoxy group, the (alkyl, aryl or heterocyclic)thio group, the dissociating group dissociable by an alkaline developer, and the hydrazino group that can form a multimer (e.g., the group represented by —NHNH—$G_{10}$-$R_{10}$, wherein $G_{10}$and $R_{10}$have the same meanings as those in the formula (D), respectively). Further $R_{20}$ preferably has at least one of the aforementioned groups as its substituent directly or indirectly. Most preferably, $R_{20}$ represents a phenyl group substituted with a benzenesulfonamide group, and the benzenesulfonamide group has any one of the aforementioned groups as the substituent on its benzene ring, directly or indirectly.

Among those groups represented by $R_{10}$ when $G_{10}$is a —CO— group, preferred are a hydrogen atom, an alkyl group, an alkenyl group, an alkynyl group, an aryl group, or a heterocyclic group, and more preferably a hydrogen atom, an alkyl group, or a substituted aryl group, wherein the substituent is especially preferably an electron-withdrawing group or an o-hydroxymethyl group. A hydrogen atom or an alkyl group is most preferred.

When $G_{10}$is a —COCO— group, an alkoxy group, an aryloxy group, and an amino group are preferred. Further, a substituted amino group, specifically an alkylamino group, an arylamino group, and a saturated or unsaturated heterocyclic amino group, is especially preferred.

Further, when $G_{10}$ is a —$SO_2$— group, $R_{10}$is preferably an alkyl group, an aryl group, or a substituted amino group.

In formula (D), $G_{10}$ is preferably a —CO— group or a —COCO— group and especially preferably a —CO-group.

Next, specific examples of the compound represented by formula (D) are illustrated below, but they are not intended to restrict the scope of the invention.

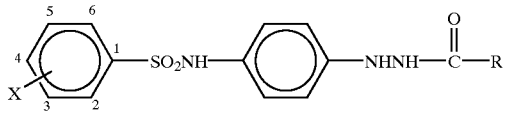
| | X = | R = —H | —$C_2F_4$—COOH (or —$C_2F_4$—$COO^{\ominus}K^{\oplus}$) | 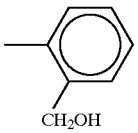 | 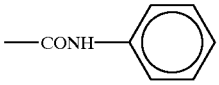 |
|---|---|---|---|---|---|
| D-1 | 3-$NHCOC_9H_{19}$(n) | 1a | 1b | 1c | 1d |
| D-2 | 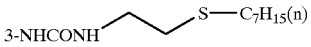 | 2a | 2b | 2c | 2d |
| D-3 | 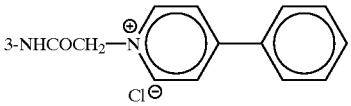 | 3a | 3b | 3c | 3d |
| D-4 | 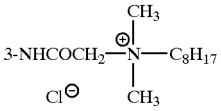 | 4a | 4b | 4c | 4d |
| D-5 | 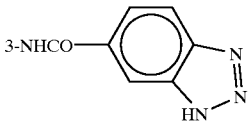 | 5a | 5b | 5c | 5d |
| D-6 | 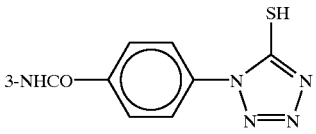 | 6a | 6b | 6c | 6d |
| D-7 | 2,4-$(CH_3)_2$-3-$SC_2H_4$-$(OC_2H_4)_4$—$OC_8H_{17}$ | 7a | 7b | 7c | 7d |
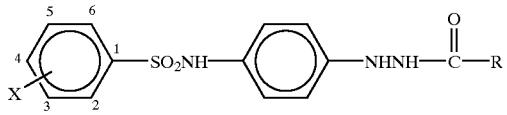
| | X = | R = —H | —$CF_2H$ | 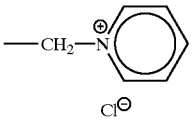 | 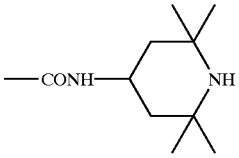 |
|---|---|---|---|---|---|
| D-8 | 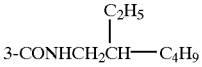 | 8a | 8e | 8f | 8g |
| D-9 | 6-$OCH_3$-3-$C_5H_{11}$(t) | 9a | 9e | 9f | 9g |
| D-10 | 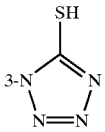 | 10a | 10e | 10f | 10g |

-continued
| | | | | | |
|---|---|---|---|---|---|
| D-11 | 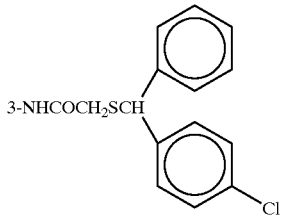 | 11a | 11e | 11f | 11g |
| D-12 | 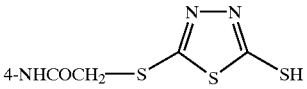 | 12a | 12e | 12f | 12g |
| D-13 | 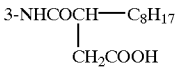 | 13a | 13e | 13f | 13g |
| D-14 | 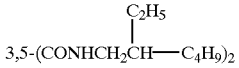 | 14a | 14e | 14f | 14g |
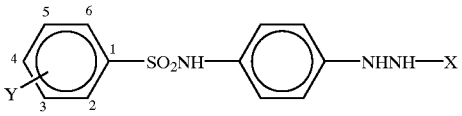
| | | X = | | | |
|---|---|---|---|---|---|
| | Y = | —CHO | —$COCF_3$ | —$SO_2CH_3$ | —$P(OC_2H_5)_2$ (O) |
| D-15 | 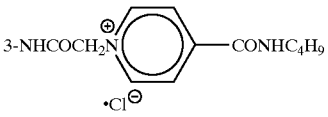 | 15a | 15h | 15i | 15j |
| D-16 | 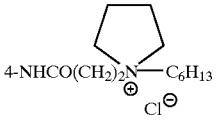 | 16a | 16h | 16i | 16j |
| D-17 | 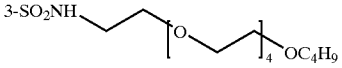 | 17a | 17h | 17i | 17j |
| D-18 | 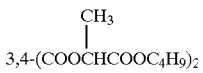 | 18a | 18h | 18i | 18j |
| D-19 | 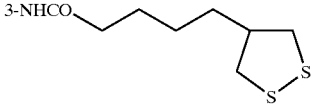 | 19a | 19h | 19i | 19j |
| D-20 | 3-$NHSO_2NH$—$C_8H_{17}$ | 20a | 20h | 20i | 20j |
| D-21 | 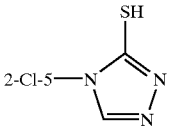 | 21a | 21h | 21i | 21j |

-continued
D-22
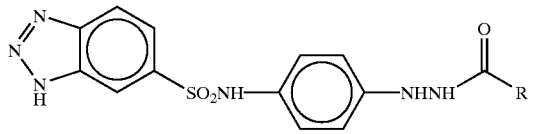
D-23
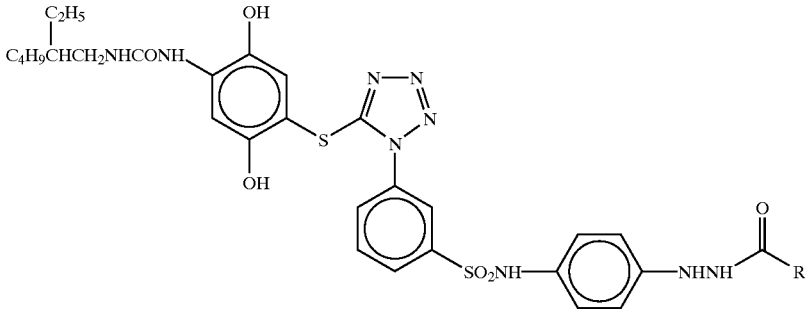
D-24
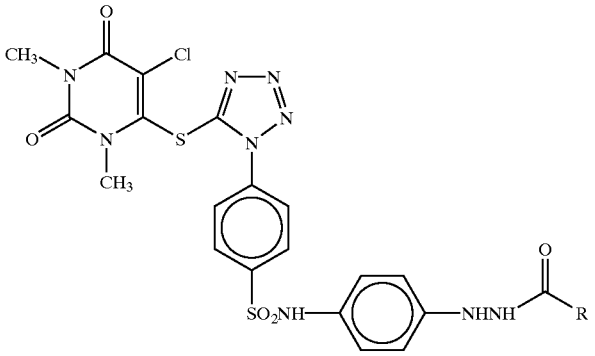
D-25
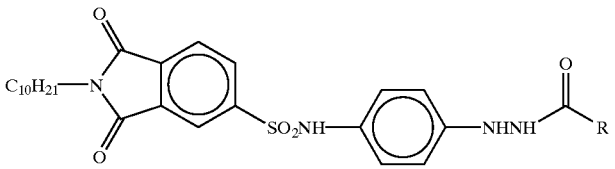
D-26
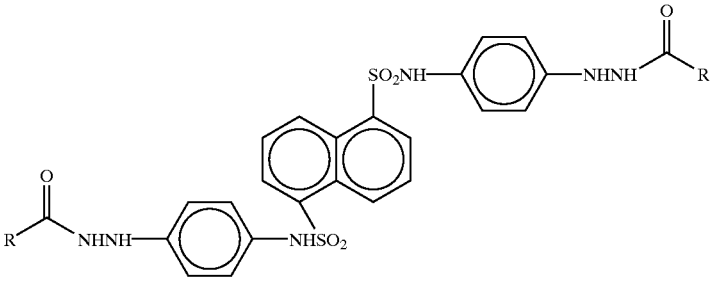
D-27
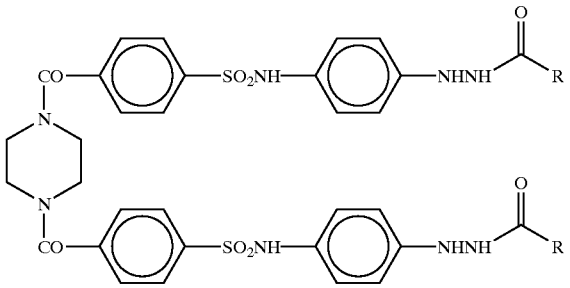

-continued
D-28
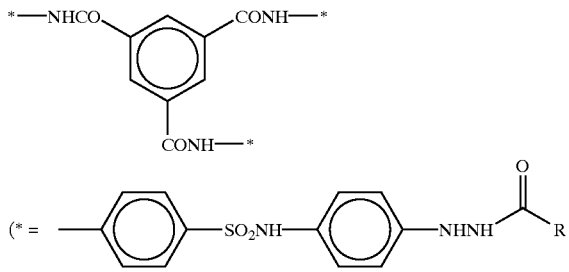
| | R = | | | |
|---|---|---|---|---|
| | —H | —$CF_2H$ | 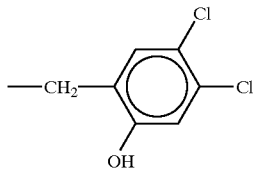 | —$CONHC_3H_7$ |
| D-22 | 22a | 22e | 22k | 22l |
| D-23 | 23a | 23e | 23k | 23l |
| D-24 | 24a | 24e | 24k | 24l |
| D-25 | 25a | 25e | 25k | 25l |
| D-26 | 26a | 26e | 26k | 26l |
| D-27 | 27a | 27e | 27k | 27l |
| D-28 | 28a | 28e | 28k | 28l |
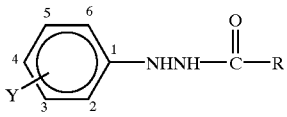
| | R = | | | |
|---|---|---|---|---|
| Y = | —H | —$CH_2OCH_3$ | 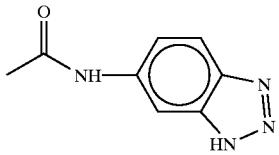 | 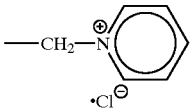 |
| D-29 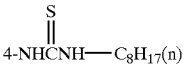 | 29a | 29m | 29n | 29f |
| D-30 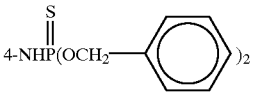 | 30a | 30m | 30n | 30f |
| D-31 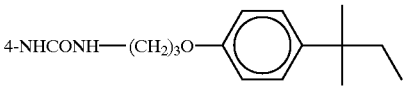 | 31a | 31m | 31n | 31f |
| D-32 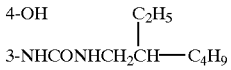 | 32a | 32m | 32n | 32f |
| D-33 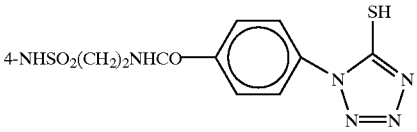 | 33a | 33m | 33n | 33f |

-continued
| | | | | | |
|---|---|---|---|---|---|
| D-34 | 4-$OCH_2$— 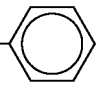 | 34a | 34m | 34n | 34f |
| D-35 | 4-NHCONHN—($CH_2$— 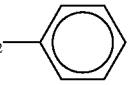 )$_2$ | 35a | 35m | 35n | 35f |
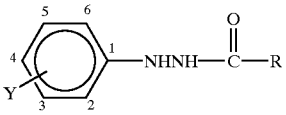
| | | R = | | | |
|---|---|---|---|---|---|
| | Y = | —H | —$C_3F_6$—COOH | —$CONHCH_3$ | 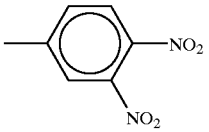 |
| D-36 | 2-$NHSO_2CH_3$— <br> 4-$NHCONH(CH_2)_3S$— 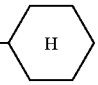 | 36a | 36o | 36p | 36q |
| D-37 | 2-$OCH_3$— <br> 4-$NHSO_2C_{12}H_{25}$ | 37a | 37o | 37p | 37q |
| D-38 | 3-$NHCOC_{11}H_{23}$— <br> 4-$NHSO_2CF_3$ | 38a | 38o | 38p | 38q |
| D-39 | 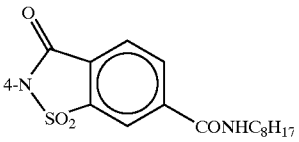 | 39a | 39o | 39p | 39q |
| D-40 | 4-$OCO(CH_2)_2COOC_6H_{13}$ | 40a | 40o | 40p | 40q |
| D-41 | 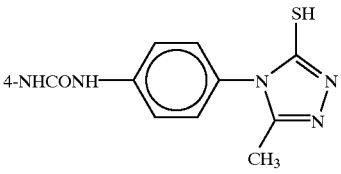 | 41a | 41o | 41p | 41q |
| D-42 | 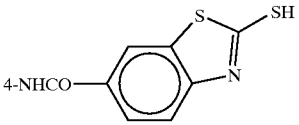 | 42a | 42o | 42p | 42q |
D-43
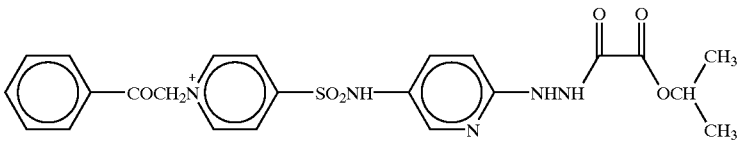

-continued
D-44
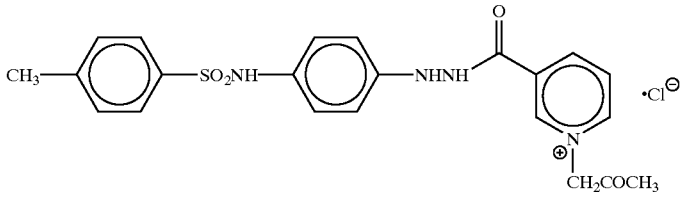
D-45
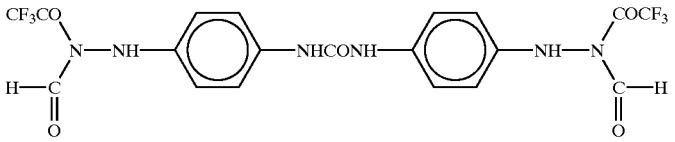
D-46
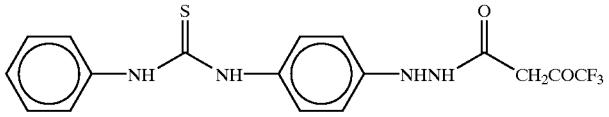
D-47
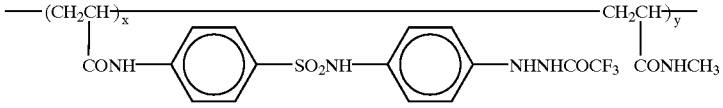
x:y = 3:97
average molecular weight ≈ a hundred thousand
D-48
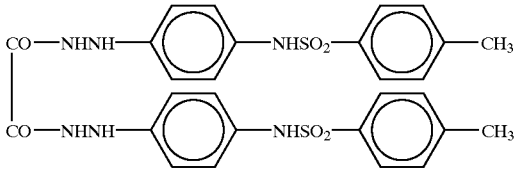
D-49
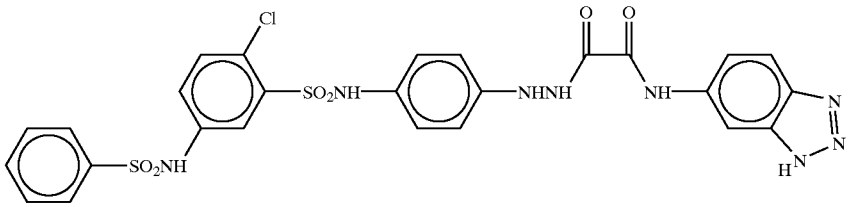
No.
D-50
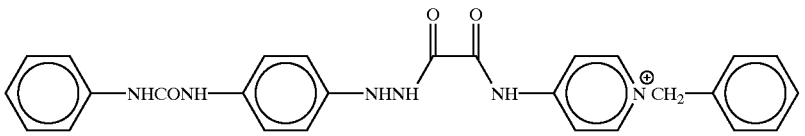
D-51
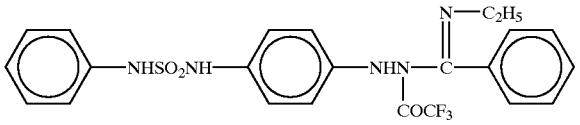
D-52
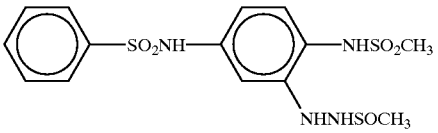

-continued
D-53
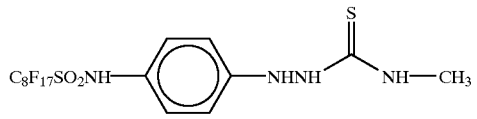
D-54
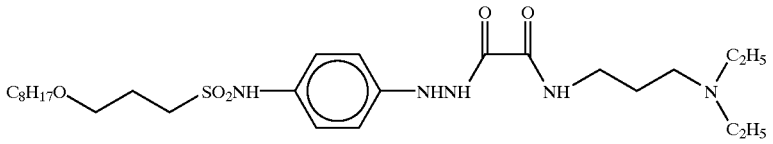
D-55
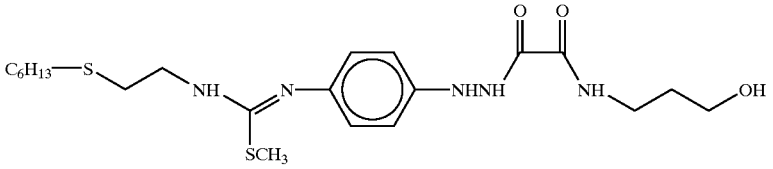
D-56
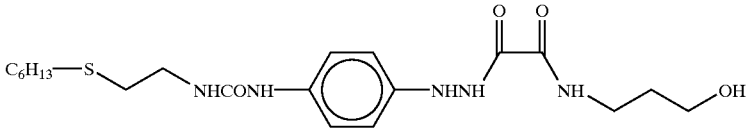
D-57
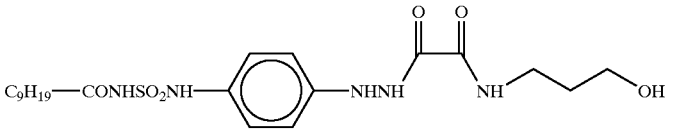
D-58
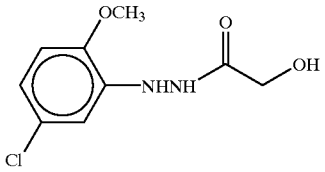
D-59
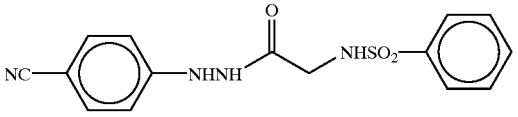
D-60
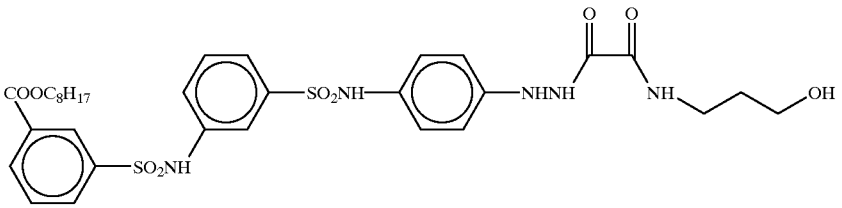
D-61
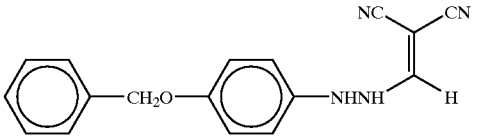
D-62
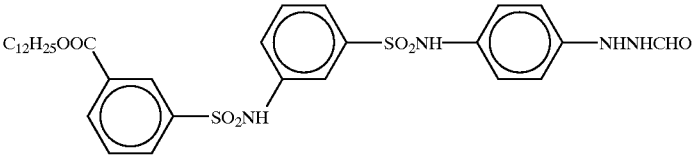

-continued

D-63

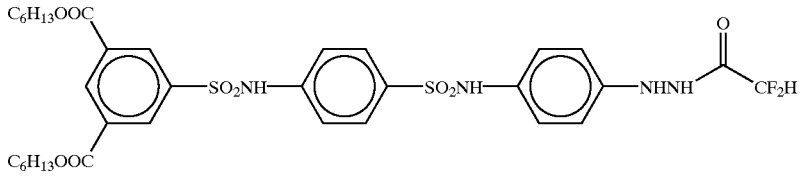

D-64

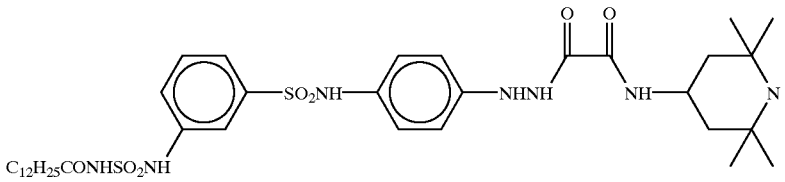

D-65

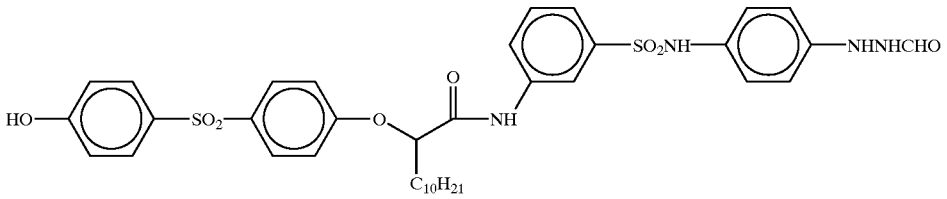

D-66

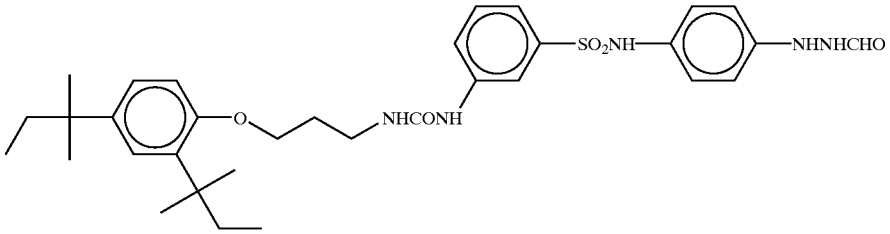

D-67

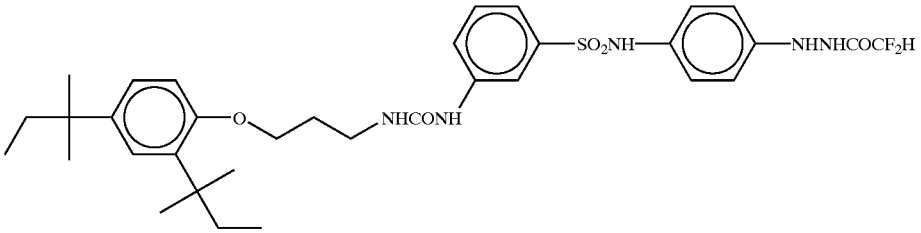

As the hydrazine derivatives for use in the present invention, in addition to the above, the following hydrazine derivatives can also preferably be used. The hydrazine derivatives for use in the present invention can be synthesized by various methods described in the following patents:

compounds represented by (Chemical formula 1) described in JP-B-6-77138 ("JP-B" means examined Japanese patent publication); specifically, compounds described on pages 3 and 4 of the publication; compounds represented by formula (I) described in JP-B-6-93082; specifically, Compounds 1 to 38 described on pages 8 to 18 of the publication;

compounds represented by formulae (4), (5), and (6) described in JP-A-6-230497; specifically, Compound 4-1 to Compound 4-10 described on pages 25 and 26, Compound 5-1 to Compound 5-42 described on pages 28 to 36, and Compound 6-1 to Compound 6-7 described on pages 39 and 40 of the publication, respectively; compounds represented by formulae (1) and (2) described in JP-A-6-289520;

specifically, Compounds 1-1) to 1-17) and 2-1) described on pages 5 to 7 of the publication; compounds represented by (Chemical formula 2) and (Chemical formula 3) described in JP-A-6-313936; specifically, compounds described on pages 6 to 19 of the publication; compounds represented by (Chemical formula 1) described in JP-A-6-313951;

specifically, compounds described on pages 3 to 5 of the publication; compounds represented by formula (I) described in JP-A-7-5610; specifically, Compounds I-1 to I-38 described on pages 5 to 10 of the publication;

compounds represented by formula (II) described in JP-A-7-77783; specifically, Compounds II-1 to II-102 described on pages 10 to 27 of the publication; compounds represented by formulae (H) and (Ha) described in JP-A-7-104426;

specifically, Compounds H-1 to H-44 described on pages 8 to 15 of the publication; compounds that have an anionic group in the vicinity of the hydrazine group or a nonionic group for forming an intramolecular hydrogen bond with the hydrogen atom of the hydrazine; and especially, compounds represented by formulae (A), (B), (C), (D), (E), and (F), described in JP-A-9-22082; specifically, Compounds N-1 to N-30 described in the specification thereof; and compounds represented by formula (1) described in JP-A-9-22082; specifically, Compounds D-1 to D-55 described in the specification thereof.

Besides, hydrazine derivatives described in WO 95-32452, WO 95-32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

The hydrazine-series nucleating agent for use in the present invention may be dissolved in an appropriate water-miscible organic solvent, such as an alcohol (e.g. methanol, ethanol, propanol, fluorinated alcohol), a ketone (e.g. acetone, methyl ethyl ketone), dimethylformamide, dimethylsulfoxide, or methyl cellosolve, before use.

Also, the hydrazine-series nucleating agent for use in the present invention may be dissolved using an oil, such as dibutyl phthalate, tricresyl phosphate, glyceryl triacetate, or diethyl phthalate; or using or an auxiliary solvent, such as ethyl acetate or cyclohexanone, by a conventionally well-known emulsion dispersion method, and mechanically processed into an emulsion dispersion before use. Alternatively, the hydrazine derivative powder may be dispersed in water by means of a ball mill, a colloid mill, or ultrasonic waves, according to a method known as a solid dispersion method, and used.

The hydrazine nucleating agent for use in the present invention may be added to a silver halide emulsion layer or to any of other hydrophilic colloid layers on the silver halide emulsion layer side of a support, but it is preferably added to the above-described silver halide emulsion layer or to a hydrophilic colloid layer adjacent thereto. Also, two or more kinds hydrazine-series nucleating agent may be used together.

The addition amount of the nucleating agent for use in the present invention is preferably from $1\times10_{-5}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver halide.

In the present invention, it is preferable to include a nucleation accelerator in the light-sensitive material. Examples of the nucleation accelerator (nucleating accelerator) for use in the present invention include an amine derivative, an onium salt, a disulfide derivative, and a hydroxymethyl derivative. Specific examples thereof are described below: compounds described in JP-A-7-77783, page 48, lines 2 to 37; specifically, Compounds A-1) to A-73) described on pages 49 to 58; compounds represented by (Chemical formula 21), (Chemical formula 22), and (Chemical formula 23) described in JP-A-7-84331; specifically, compounds described on pages 6 to 8 of the publication; compounds represented by formulae [Na] and [Nb] described in JP-A-7-104426; specifically, Compounds Na-1 to Na-22 and Compounds Nb-1 to Nb-12 described on pages 16 to 20 of the publication, the compounds represented by the formulae (1), (2), (3), (4), (5), (6) and (7) described in JP-A-8-272023, specifically, the compounds of 1-1 to 1-19, compounds of 2-1 to 2-22, compounds of 3-1 to 3-36, compounds of 4-1 to 4-5, compounds of 5-1 to 5-41, compounds of 6-1 to 6-58 and compounds of 7-1 to 7-38 described in the publication; the nucleation accelerators described in JP-A-9-297377, p55, column 108, line 8 to p69, column 136, line 44.

In the present invention, at least one of the quaternary salt compounds represented by the formulae (a) to (f) is preferably contained as the nucleation accelerator.

Examples of the aliphatic groups represented by $R_{100}$, $R_{110}$ and $R_{120}$ in the formula (a) include straight-chain or branched alkyl groups such as a methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; aralkyl groups such as a substituted or unsubstituted benzyl group; cycloalkyl groups such as a cyclopropyl group, cyclopentyl group and cyclohexyl group; alkenyl groups such as an aryl group, vinyl group and 5-hexenyl group; cycloalkenyl groups such as a cyclopentenyl group and cyclohexenyl group; and alkynyl groups such as a phenylethynyl group. Examples of the aromatic group include aryl groups such as a phenyl group, naphthyl group and phenanthryl group. Examples of the heterocyclic group include a pyridyl group, quinolyl group, furyl group, imidazolyl group, thiazolyl group, thiadiazolyl group, benzotriazolyl group, benzothiazolyl group, morpholyl group, pyrimidyl group and pyrrolidyl group.

Examples of the substituent substituted on these groups include the groups represented by $R_{100}$, $R_{110}$ and $R_{120}$, halogen atoms (such as a fluorine atom, chlorine atom, bromine atom and iodine atom), nitro groups, (alkyl or aryl)amino groups, alkoxy groups, aryloxy groups, (alkyl or aryl)thio groups, carbonamide groups, carbamoyl groups, ureido groups, thioureido groups, sulfonylureido groups, sulfonamide groups, sulfamoyl groups, hydroxyl groups, sulfonyl groups, carboxyl groups (including carboxylato groups), sulfo groups (including sulfonato groups), cyano groups, oxycarbonyl groups, acyl groups, and heterocyclic groups (including heterocyclic groups containing a quaternary nitrogen atom). These substituents may be further substituted with these substituents.

The groups represented by $R_{100}$, $R_{110}$ and $R_{120}$ of the formula (a) may be combined with each other to form a cyclic structure.

Examples of the group represented by M in the formula (a) include groups having the same meanings as $R_{100}$, $R_{110}$ or $R_{120}$ when $m_{10}$ represents 1. When $m_{10}$ represents an integer of 2 or more, M represents a connecting group with $m_{10}$ valences which connects to $Q_1^+$ by a carbon atom contained in M. Specifically, M represents an $m_{10}$-valent connecting groups which are formed by combining groups such as an alkylene group, arylene group, heterocyclic group, with a —CO— group, —O— group, —N($R_N$)— group, —S— group, —SO— group, —$SO_2$— group, or —P═O— group ($R_N$ represents a hydrogen atom or a group having the same meaning as $R_{100}$, $R_{110}$ or $R_{120}$. When plural $R_N$s are present in a molecule, they may be the same or different and further they may be combined with each other). M may have an optional substituent. Examples of the optional substituent include the same substituents as those which the group represented by $R_{100}$, $R_{110}$ or $R_{120}$ may have.

In the formula (a), $R_{100}$, $R_{110}$ and $R_{120}$ are preferably groups having 20 or less carbon atoms. When $Q_1$ represents a phosphorous atom, $R_{100}$, $R_{110}$ and $R_{120}$ are particularly preferably aryl groups having 15 or less carbon atoms. When $Q_1$ represents a nitrogen atom, they are particularly preferably alkyl, aralkyl, or aryl groups, having 15 or less carbon atoms. Preferably, $m_{10}$ is 1 or 2. When $m_{10}$represents 1, M is preferably a group having 20 or less carbon atoms and particularly preferably an alkyl, aralkyl or aryl group, having a total carbon number of 15 or less. When $m_{10}$ represents 2, the divalent organic group represented by M is preferably an alkylene group, arylene group, or a divalent group which is formed by combining these groups with a —CO— group, —O— group, —N($R_N$)— group, —S— group, or —$SO_2$— group ($R_N$ is the same meanings as the above $R_N$). When $m_{10}$ represents 2, M is preferably a divalent group that connects to $Q_1^+$ by a carbon atom contained in M and that has a total carbon number of 20 or less. In addition, the preferable range of the total carbon number is not limited to the above range, when M, or $R_{100}$, $R_{110}$ or $R_{120}$ contains plural repeating units of an ethyleneoxy group or propyleneoxy group. Also, when $m_{10}$ represents an integer of 2 or more, $R_{100}$, $R_{110}$ and $R_{120}$ are each present in plural in a molecule. In this case, these plural $R_{100}$s, $R_{110}$s or $R_{120}$s may be the same or different respectively.

The quaternary salt compound represented by the formula (a) has 20 or more repeating units of an ethyleneoxy or propyleneoxy group in total in its molecule. These repeating units either may be substituted on one position or may be substituted so as to extend over plural positions. When $m_{10}$ represents an integer of 2 or more, more preferably the connecting group represented by M has 20 or more repeating units of an ethyleneoxy or propyleneoxy group.

In the formula (b), (c) or (d), $A_1$, $A_2$, $A_3$, $A_4$, and $A_5$ respectively represent an organic moiety necessary to form a substituted or unsubstituted unsaturated heterocyclic ring that contains a quaternary nitrogen atom. The organic moiety may contain a carbon atom, oxygen atom, nitrogen atom, sulfur atom, and hydrogen atom. The heterocyclic ring may be further condensed with a benzene ring.

Examples of the unsaturated hetero ring formed by $A_1$, $A_2$, $A_3$, $A_4$, and $A_5$ include a pyridine ring, quinoline ring, isoquinoline ring, imidazole ring, thiazole ring, thiadiazole ring, benzotriazole ring, benzothiazole ring, pyrimidine ring and pyrazole ring. A pyridine ring, a quinoline ring, and an isoquinoline ring are particularly preferable.

The unsaturated hetero ring which Al, $A_2$, $A_3$, $A_4$, and $A_5$ form in combination with a quaternary nitrogen atom may have a substituent. Examples of the substituent in this case include the same substituents as those which the group represented by $R_{100}$, $R_{110}$ or $R_{120}$ of the formula (a) may have. Preferable examples of the substituent include halogen atoms (particularly a chlorine atom); and aryl groups, (preferably a phenyl group), alkyl groups, alkynyl groups, carbamoyl groups, (alkyl or aryl)amino groups, (alkyl or aryl)oxycarbonyl groups, alkoxy groups, aryloxy groups, (alkyl or aryl)thio groups, hydroxy groups, mercapto groups, carbonamide groups, sulfonamide groups, sulfo groups (including sulfonato groups), carboxyl groups (including carboxylato groups), and cyano groups, which have 20 or less carbon atoms. Particularly preferable examples include phenyl groups, alkylamino groups, carbonamide groups, a chlorine atom, and alkylthio groups, and most preferable examples include phenyl groups.

The divalent connecting groups represented by $L_{10}$ or $L_{20}$ are preferably those constituted by singly, an alkylene group, arylene group, alkenylene group, alkynylene group, divalent heterocyclic group, —$SO_2$—, —SO—, —O—, —S—, —N($R_N$')— (wherein $R_N$' represents an alkyl group, aralkyl group, aryl group, or hydrogen atom), —C(=O)—, or —P(=O)—; or by a combination of these groups. The divalent connecting groups represented by $L_{10}$ or $L_{20}$ may have an optional substituent. Examples of the substituent include the same substituents as those which the group represented by $R_{100}$, $R_{110}$ or $R_{120}$ of the formula (a) may have. Particularly preferable examples of $L_{10}$ or $L_{20}$ include those constituted by singly, the alkylene group, the arylene group, —C(=O)—, —O—, —S—, —$SO_2$ or —N($R_N$'), or by a combination of these groups.

$R_{111}$, $R_{222}$, or $R_{333}$ is preferably an alkyl or aralkyl group, having 1 to 20 carbon atoms, and $R_{111}$, $R_{222}$, or $R_{333}$ may be the same or different. $R_{111}$, $R_{222}$, or $R_{333}$ may have a substituent. Examples of the substituent include the same substituents as those which the group represented by $R_{100}$, $R_{110}$ or $R_{120}$ of the formula (a) may have. Particularly preferably, $R_{111}$, $R_{222}$, and $R_{333}$ respectively are an alkyl or aralkyl group, having 1 to 10 carbon atoms. Preferable examples of the substituent include carbamoyl groups, oxycarbonyl groups, acyl groups, aryl groups, sulfo groups (including sulfonato groups), carboxyl groups (including carboxylato groups), hydroxy groups, (alkyl or aryl)amino groups, and alkoxy groups.

In addition, the preferrable range of the total carbon number is not limited to the above range, when $R_{111}$, $R_{222}$, or $R_{333}$ contains plural repeating units of an ethyleneoxy group or propyleneoxy group.

The quaternary salt compound represented by the formula (b) or (c) has 20 or more repeating units of an ethyleneoxy or propyleneoxy group in total in its molecule. Although these repeating units may be substituted either on one position or on plural positions and may also be substituted on any of $A_1$, $A_2$, $A_3$, $A_4$, $R_{111}$, $R_{222}$, $L_{10}$and $L_{20}$, preferably the connecting group represented by $L_{10}$ or $L_{20}$ has 20 or more of total repeating units of an ethyleneoxy or propyleneoxy group.

The quaternary salt compound represented by the formula (d) has 20 or more of total repeating units of an ethyleneoxy or propyleneoxy group in its molecule. Although these repeating units may be substituted either on one position or on plural positions and may also be substituted on any of $A_5$ and $R_{333}$, preferably the group represented by $R_{333}$ has 20 or more of total repeating units of an ethyleneoxy or propyleneoxy group.

The quaternary salt compounds represented by the formulae (a), (b), (c) and (d) may include an ethyleneoxy group and a propyleneoxy group repeatedly at the same time. In the case of including plural repeating units of an ethyleneoxy or propyleneoxy group, the number of repetitions may be given either by taking one value strictly or as an average. In the latter case, the quaternary salt compound is a mixture having a certain degree of distribution of molecular weight.

In the present invention, the case of having 20 or more of total repeating units of an ethyleneoxy group is more preferable and the case of having 20 to 67 repeating units of an ethyleneoxy group in total is most preferable.

In the formula (e), $Q_2$, $R_{200}$, $R_{210}$ and $R_{220}$ respectively represent groups having the same meanings as those of $Q_1$, $R_{100}$, $R_{110}$ and $R_{120}$ of the formula (a). Each preferable range is also the same.

In the formula (f), $A_6$ represents groups having the same meanings as those represented by $A_1$ or $A_2$ of the formula (b) and its preferable range is also the same, provided that the nitrogen-containing unsaturated hetero ring which $A_6$ of the formula (f) forms in combination with the quaternary nitrogen atom may have a substituent but never contains a substituent having a primary hydroxyl group.

In the formulae (e) and (f), $L_{30}$ represents an alkylene group. The alkylene group has preferably 1 to 20 carbon atoms, and may be a straight-chain, branched, and/or comprising cyclic structure. Also, the alkylene group may be not only a saturated alkylene group, for example, an ethylene group, but also a alkylene group containing an unsaturated group, for example, by $—CH_2C_6H_4CH_2—$ or $—CH_2CH{=}CHCH_2—$. $L_{30}$ may have a substituent which $R_{100}$, $R_{110}$, or $R_{120}$ of the formula (a) may have.

$L_{30}$ includes preferably a straight-chain or branched saturated group having 1 to 10 carbon atoms, further preferably a substituted or unsubstituted, methylene, ethylene, or trimethylene group, particularly preferably a substituted or unsubstituted, methylene or ethylene group, and most preferably a substituted or unsubstituted methylene group.

In the formulae (e) and (f), $L_{40}$ represents a divalent connecting group having at least one hydrophilic group. Here, the hydrophilic group represents a group represented by $—SO_2—$, —SO—, —O—, —P(=O)=, —C(=O)—, —CONH—, $—SO_2NH—$, $—NHSO_2NH—$ or —NHCONH—, an amino group, a guanidino group, an anmonio group, a nitrogen-containing heterocyclic group containing a quarternary nitrogen atom, or a group obtained by combining these groups. These hydrophilic groups are properly combined with an alkylene group, alkenylene group, arylene group, or heterocyclic group, to constitute $L_{40}$.

The groups, such as an alkylene group, arylene group, alkenylene group, and heterocyclic group, which constitute $L_{40}$, may have a substituent. Examples of the substituent include the same substituents as those which $R_{100}$, $R_{110}$ and $R_{120}$ of the formula (a) may have.

The hydrophilic group in $L_{40}$ may be present either in such a state as to dividing $L_{40}$ into parts or as a part of substituents on $L_{40}$. For example, —C(=O)—, $—SO_2—$, —SO—, —O—, —P(=O)=, —CONH—, $—SO_2NH—$, $—NHSO_2NH—$ or —NHCONH—, or cationic group (specifically, a quaternary salt structure of nitrogen or phosphorous, or a nitrogen-containing hetero ring containing a quaternary nitrogen atom), amino group, guanidino group, or divalent group obtained by combining these groups, may be present in such a state as to dividing $L_{40}$ into parts.

One of preferable examples of the hydrophilic group which $L_{40}$ has, is a group combining an ether linkage and an alkylene group, having plural repeating units of an ethyleneoxy group or a propyleneoxy group. The polymerization degree or average polymerization degree is preferably the range of 2 to 67.

As the hydrophilic group contained in $L_{40}$, those including a dissociating group as a result of combining the group represented by $—SO_2—$, —SO—, —O—, —P(=O)=, —C(=O)—, —CONH—, $—SO_2NH—$, $—NHSO_2NH—$, —NHCONH—, the amino group, the guanidino group, the anmonio group, or the nitrogen-containing heterocyclic group containing a quarternary nitrogen atom, or those including a dissociating group as a substituent which $L_{40}$ has are also preferable. Here, the dissociating group means a group, or a partial structure, having a proton(s) of such low acidity that the proton is dissociable by an alkaline developer, or a salt of such a group or structure. Specific examples of the dissociating group include carboxy group/—COOH, sulfo group/$—SO_3H$, phosphonic acid group/$—PO_3H$, phosphoric acid group/$—OPO_3H$, hydroxy group/—OH, mercapto group/—SH, $—SO_2NH_2$, N-substituted sulfonamide group/$—SO_2NH—$ group, $—CONHSO_2—$ group, $—SO_2NHSO_2—$ group, —CONHCO— group, an activated methylene group, —NH— group present in a nitrogen-containing heterocyclic group, or salts of these groups.

As $L_{40}$, those obtained by properly combining an alkylene group or an arylene group with a group represented by the formula —C(=O)—, $—SO_2—$, —O—, —CONH—, $—SO_2NH—$, $—NHSO_2NH—$, —NHCONH—, or an amino group, are preferably used. More preferably those obtained by combining an alkylene group having 2 to 5 carbon atoms with a group represented by the formula —C(=O)—, $—SO_2—$, —O—, —CONH—, $—SO_2NH—$, $—NHSO_2NH—$ or —NHCONH— are used.

Y represents —C(=O)— or $—SO_2—$. Preferably —C(=O)— is used.

Examples of the counter anion represented by $X^{n-}$ in the formulae (a) to (f) include halogen ions such as a chlorine ion, bromine ion and iodine ion, carboxylate ions such as an acetate ion, oxalate ion, fumarate ion and benzoate ion, sulfonate ions such as p-toluene sulfonate, methane sulfonate, butane sulfonate and benzene sulfonate, sulfuric acid ion, perchloric acid ion, carbonic acid ion and nitric acid ion.

As the counter anion represented by $X^{n-}$, a halogen ion, carboxylate ion, sulfonate ion or sulfuric acid ion is preferable. Preferably n is 1 or 2. As $X^{n-}$, a chlorine ion or bromine ion is particularly preferable and a chlorine ion is most preferable.

However, $X^{n-}$ can be omitted when another anionic group exists in a molecule and forms an intramolecular salt with $Q_1^+$, $Q_2^+$, or $N^+$.

As the quaternary salt compound used in the present invention, quaternary salt compounds represented by the formulae (b), (c) and (f) are more preferable. Among these quaternary salt compounds, quaternary salt compounds represented by the formulae (b) and (f) are particularly preferable. Further, in the formula (b), the case where the connecting group represented by $L_{10}$. has 20 or more repeating units of an ethyleneoxy group is preferable and the case where the connecting group has 20 to 67 repeating units of an ethyleneoxy group is particularly preferable. In the formula (f), the unsaturated heterocyclic compound which $A_6$ forms is particularly preferably 4-phenylpyridine, isoquinoline or quinoline.

Next, specific examples of the quaternary salt compounds represented by the formulae (a) to (f) will be shown (in the following formulae, Ph represents phenyl groups.). The present invention is not limited by the following compound examples.

| No. | Q = | $Q^+—L_0—Q^+.2X^-$ $L_0$ = | X = |
|---|---|---|---|
| 1 | 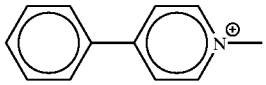 | $—C_2H_4—(OC_2H_4)_n—OC_2H_4—$ n = 20 | $Cl^{\ominus}$ |
| 2 | 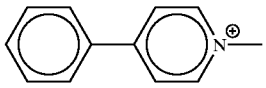 | $—C_2H_4—(OC_2H_4)_n—OC_2H_4—$ n ≈ 32 | $Cl^{\ominus}$ |
| 3 | 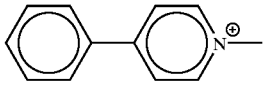 | $—C_2H_4—(OC_2H_4)_n—OC_2H_4—$ n ≈ 43 | $Cl^{\ominus}$ |
| 4 | 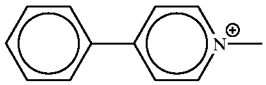 | $—C_2H_4—(OC_2H_4)_n—OC_2H_4—$ n ≈ 62 | $Cl^{\ominus}$ |
| 5 | 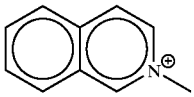 | $—C_2H_4—(OC_2H_4)_n—OC_2H_4—$ n ≈ 21 | $Cl^{\ominus}$ |
| 6 | 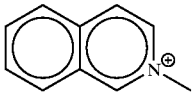 | $—C_2H_4—(OC_2H_4)_n—OC_2H_4—$ n ≈ 43 | $Cl^{\ominus}$ |
| 7 | 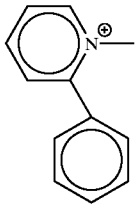 | $—C_2H_4—(OC_2H_4)_n—OC_2H_4—$ n = 20 | $Cl^{\ominus}$ |
| 8 | 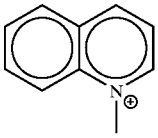 | $—C_2H_4—(OC_2H_4)_n—OC_2H_4—$ n ≈ 43 | $Cl^{\ominus}$ |
| 9 | 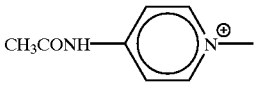 | $—C_2H_4—(OC_2H_4)_n—OC_2H_4—$ n ≈ 21 | $Cl^{\ominus}$ |
| 10 | 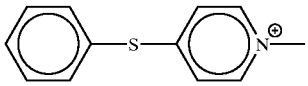 | $—C_2H_4—(OC_2H_4)_n—OC_2H_4—$ n ≈ 43 | $Cl^{\ominus}$ |
| 11 | 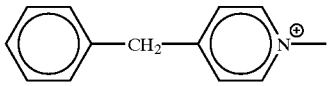 | $—C_2H_4—(OC_2H_4)_n—OC_2H_4—$ n ≈ 67 | $Cl^{\ominus}$ |
| 12 | 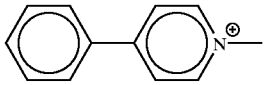 | 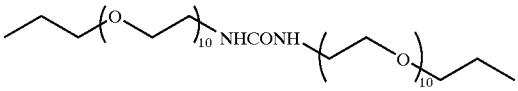 | $Cl^{\ominus}$ |
| 13 | 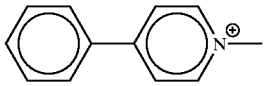 | 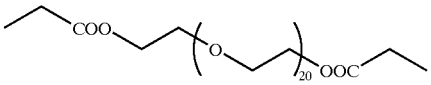 | $Cl^{\ominus}$ |

-continued
| | | | |
|---|---|---|---|
| 14 | 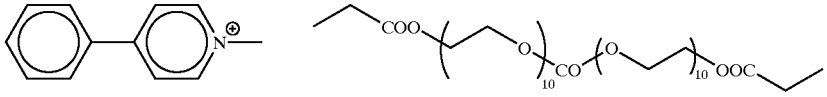 | | $Cl^{\ominus}$ |
| 15 | 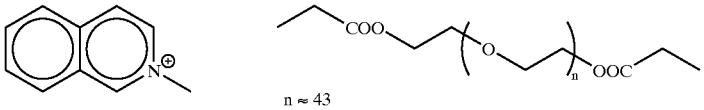 | n ≈ 43 | $Cl^{\ominus}$ |
| 16 | 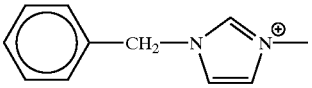 | $—C_2H_4—(OC_2H_4)_n—OC_2H_4—$ n ≈ 42 | $Cl^{\ominus}$ |
| 17 | 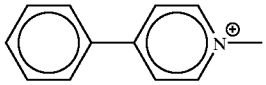 | $—C_2H_4—(OC_2H_4)_n—OC_2H_4—$ n ≈ 62 | 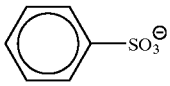 |
| 18 | 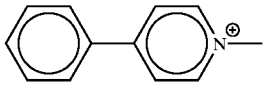 | $—C_2H_4—(OC_2H_4)_n—OC_2H_4—$ n ≈ 43 | $Br^{\ominus}$ |
| 19 | 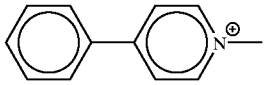 | $—C_2H_4—(OC_2H_4)_n—OC_2H_4—$ n = 20 | $(COO)_2^{2\ominus}$ |
| 20 | 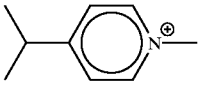 | $—C_2H_4—(OC_2H_4)_n—OC_2H_4—$ n ≈ 34 | $Cl^{\ominus}$ |
| 21 | 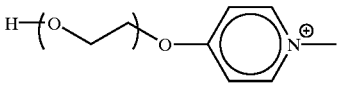 | $—(CH_2)_5—$ | $CH_3SO_3^{\ominus}$ |
| 22 | 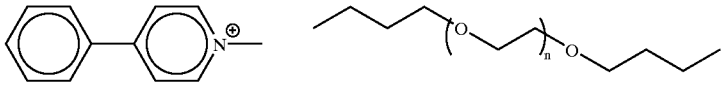 | | Cl |
23
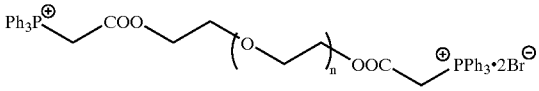
n ≈ 43
24
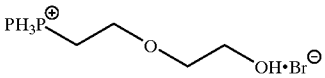
n ≈ 33
25
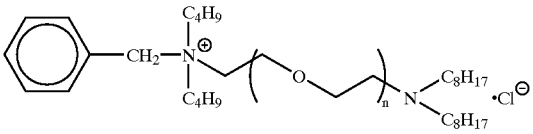
n ≈ 33
26
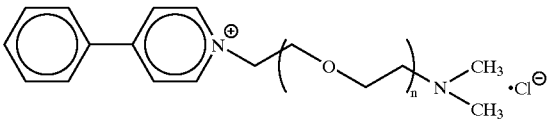
n ≈ 43

-continued
27
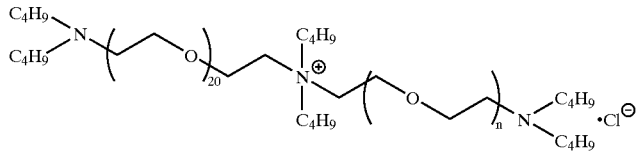
28
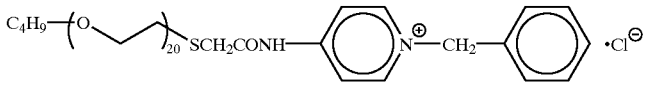
29
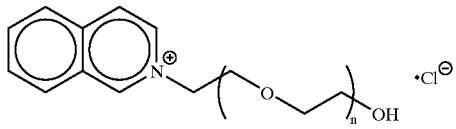
n ≈ 67
30
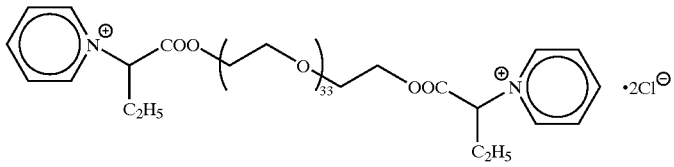
31
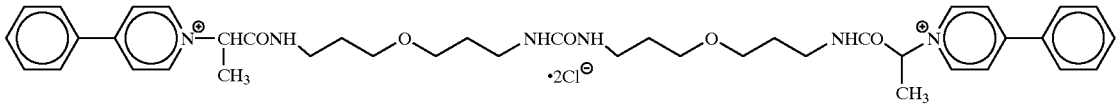
$Q^+—L_o—Q^+.2X^-$
| No. | Q = | $L_o$ = | X = |
|---|---|---|---|
| 32 | 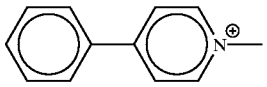 | 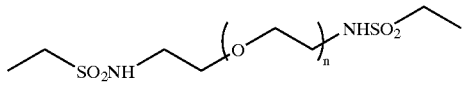 n =12 | Cl |
| 33 | 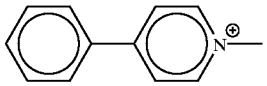 | 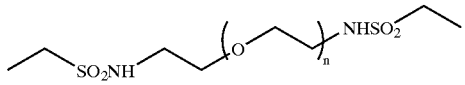 n ≈ 24 | Br |
| 34 | 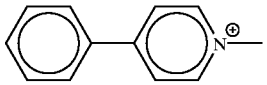 | 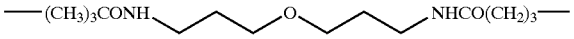 | Cl |
| 35 | 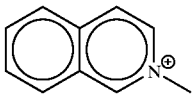 | 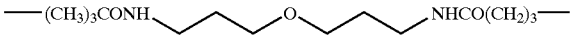 | Cl |
| 36 | 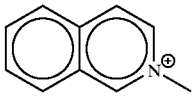 | 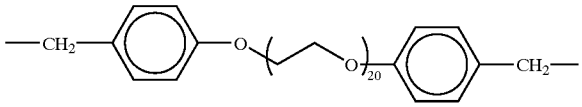 | Cl |
| 37 | 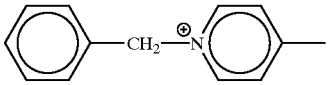 | 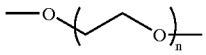 n ≈ 33 | Cl |

-continued

| | | | |
|---|---|---|---|
| 38 | 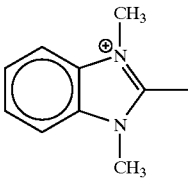 | 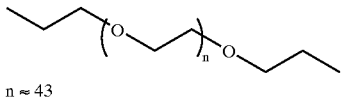 n ≈ 43 | Cl |
| 39 | $(C_4H_9)N^{\oplus}$— | 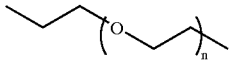 n = 20 | Cl |
| 40 | 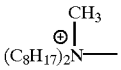 | 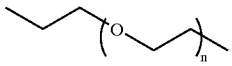 n ≈ 43 | Cl |
| 41 | $Ph_3P^{\oplus}$— | 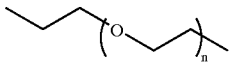 n = 20 | Cl |
| 42 | $Ph_3P^{\oplus}$— | 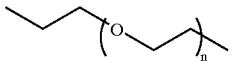 n ≈ 33 | $Br^{\ominus}$ |

$Q^+$—$CH_2CONH$—L—$NHCOCH_2$—$Q^+.2X^-$

| No. | Q = | L = | X = |
|---|---|---|---|
| 43 | $PhP^{\oplus}$— | —$C_2H_4$—$(OC_2H_4)_n$— n = 3 | Cl |
| 44 | $PhP^{\oplus}$— | —$C_2H_4$—$(OC_2H_4)_n$— n = 20 | Br |
| 45 | $PhP^{\oplus}$— | —$C_2H_4$—$(OC_2H_4)_n$— n ≈ 34 | Cl |
| 46 | $PhP^{\oplus}$— | —$C_2H_4$—$(OC_2H_4)_n$— n ≈ 67 | Cl |
| 47 | 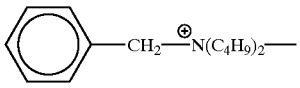 | —$C_2H_4$—$(OC_2H_4)_n$— n = 12 | Cl |
| 48 | 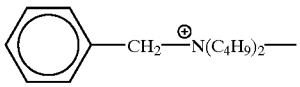 | —$C_2H_4$—$(OC_2H_4)_n$— n = 30 | Br |
| 49 | 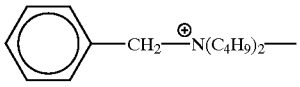 | —$C_2H_4$—$(OC_2H_4)_n$— n ≈ 43 | 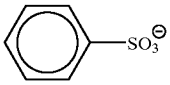 |
| 50 | 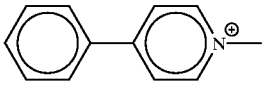 | —$C_2H_4$—$(OC_2H_4)_n$— n = 3 | Cl |
| 51 | 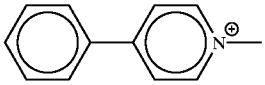 | —$C_2H_4$—$(OC_2H_4)_n$— n = 12 | Cl |
| 52 | 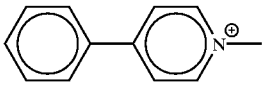 | —$C_2H_4$—$(OC_2H_4)_n$— n = 20 | Cl |
| 53 | 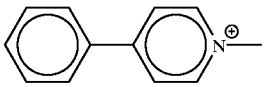 | —$C_2H_4$—$(OC_2H_4)_n$— n ≈ 43 | Cl |

-continued
| | | | |
|---|---|---|---|
| 54 | 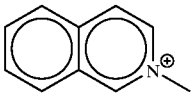 | $—C_2H_4—(OC_2H_4)_n—$<br>n = 2 | Cl |
| 55 | 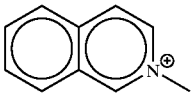 | $—C_2H_4—(OC_2H_4)_n—$<br>n = 12 | Br |
| 56 | 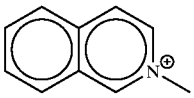 | $—C_2H_4—(OC_2H_4)_n—$<br>n = 30 | 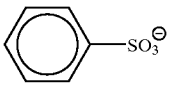 |
| 57 | 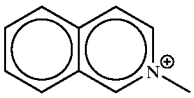 | $—C_2H_4—(OC_2H_4)_n—$<br>n ≈ 67 | $(COO)_2^{2\ominus}$ |
| 58 | 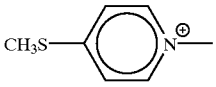 | $—C_2H_4—(OC_2H_4)_n—$<br>n = 12 | Cl |
| 59 | 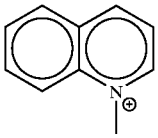 | $—C_2H_4—(OC_2H_4)_n—$<br>n = 20 | Cl |
| 60 | 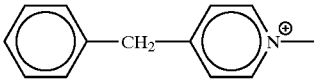 | $—C_2H_4—(OC_2H_4)_n—$<br>n = 30 | Cl |
| 61 | 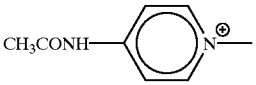 | $—C_2H_4—(OC_2H_4)_n—$<br>n ≈ 67 | Cl |
| 62 | 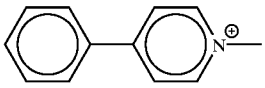 | $—C_2H_4—(OC_2H_4)_n—$<br>n = 2 | Cl |
| 63 | 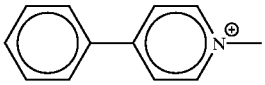 | n = 20 | Cl |
| 64 | 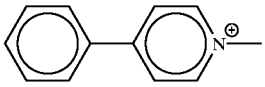 | n ≈ 43 | Cl |
| 65 | $Ph_3P^{\oplus}—$ | $—C_3H_6—(OC_2H_4)_n—OC_3H_6—$<br>n = 2 | Cl |
| 66 | $Ph_3P^{\oplus}—$ | $—C_3H_6—(OC_2H_4)_n—OC_3H_6—$<br>n = 12 | Cl |
| 67 | 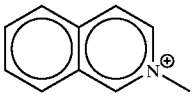 | $—C_3H_6—(OC_2H_4)_n—OC_3H_6—$<br>n = 20 | Cl |
| 68 | 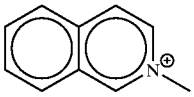 | $—C_3H_6—(OC_2H_4)_n—OC_3H_6—$<br>n ≈ 43 | Cl |
| 69 | $(C_3H_7)_3N^{\oplus}—$ | $—C_3H_6—(OC_2H_4)_n—OC_3H_6—$<br>n ≈ 67 | Cl |

-continued
| | | | |
|---|---|---|---|
| 70 | $(C_3H_7)_3N^{\oplus}$— | $-CH(CH_3)CH_2-(OC_2H_4)_n-OCH_2CH(CH_3)-$ n = 12 | Cl |
| 71 | 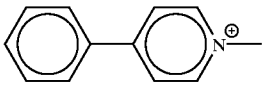 | $-CH(CH_3)CH_2-(OC_2H_4)_n-OCH_2CH(CH_3)-$ n ≈ 18 | Cl |
| 72 | 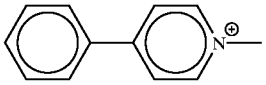 | $-CH(CH_3)CH_2-(OC_2H_4)_n-OCH_2CH(CH_3)-$ n = 20 | Cl |
| 73 | 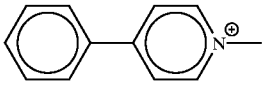 | $-C_2H_4-(O-CH(CH_3)-)_n$ n = 4 | Cl |
| 74 | 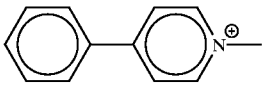 | $-C_2H_4-(O-CH(CH_3)-)_n$ n ≈ 13 | Cl |
| 75 | 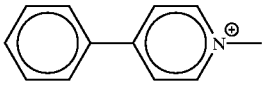 | $-(CH_2)_3-(O-CH_2)_3-NHCONH-(CH_2-O)_3-(CH_2)_3-$ | Cl |
| 76 | 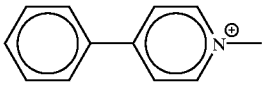 | $-(CH_2)_4-NHSO_2NH-(CH_2)_4-$ | Cl |
| 77 | 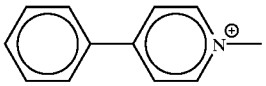 | $-(CH_2)_4-NHCONH-(CH_2)_4-$ | Cl |
| 78 | 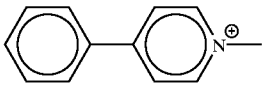 | $-(CH_2)_4-NH-C(=O)-C(=O)-NH-(CH_2)_4-$ | Cl |
| 79 | 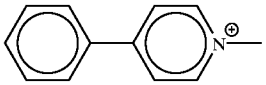 | $-(CH_2)_2-CONH-(CH_2)_2-CONH-(CH_2)_2-NHCO-(CH_2)_2-NHCO-(CH_2)_2-$ | Cl |
| 80 | 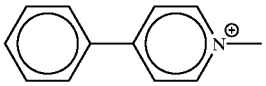 | $-(CH_2)_4-NHCO-(CH_2)_2-CONH-(CH_2)_4-$ | Cl |
| 81 | 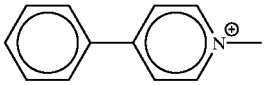 | $-(CH_2)_4-SO_2NHSO_2-(CH_2)_5-$ | Cl |
| 82 | 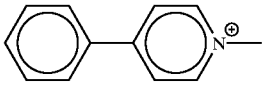 | $-(CH_2)_3-O-(CH_2)_2-CONHCO-(CH_2)_2-O-(CH_2)_3-$ | Cl |

-continued
| | | | |
|---|---|---|---|
| 83 | 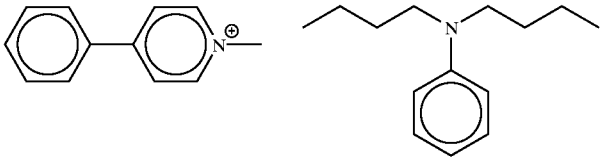 | | Cl |
| 84 | 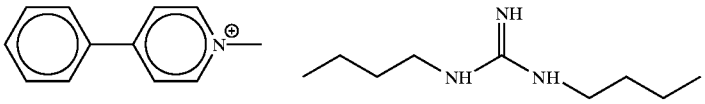 | | Cl |
| 85 | 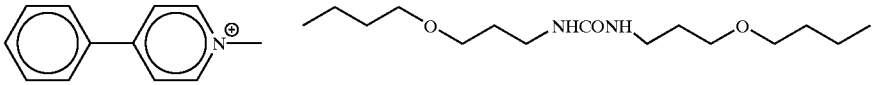 | | Cl |
| 86 | 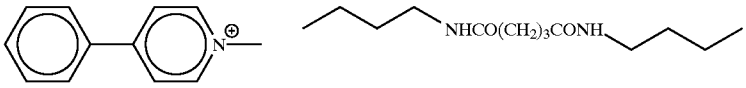 | | Cl |
E-1
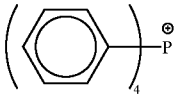
E-2
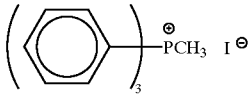
E-3
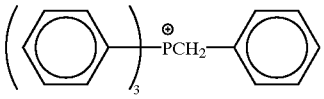
E-4
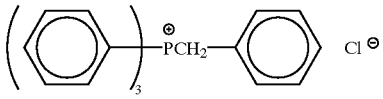
E-5
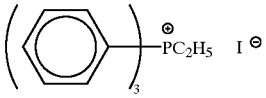
E-6
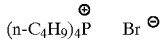
E-7
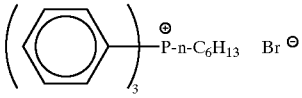
E-8
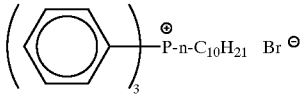
E-9
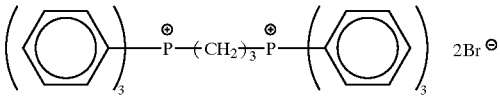
E-10
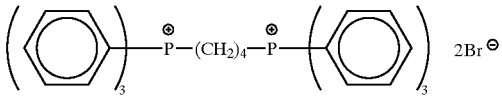
E-11
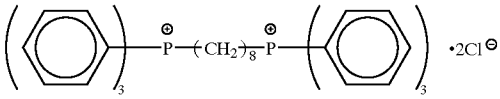
E-12
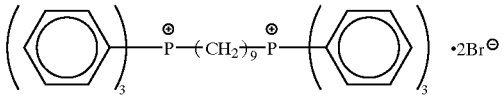
E-13
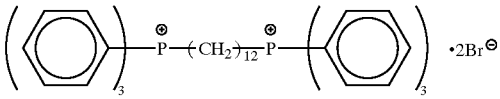
E-14
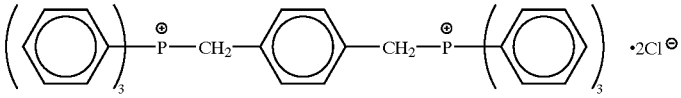
E-15
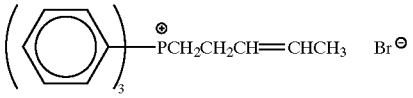
E-16
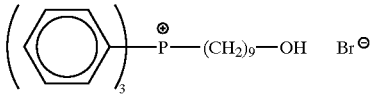

-continued
E-17
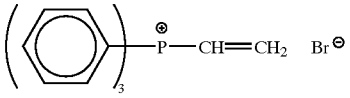
E-18
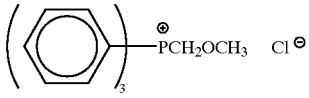
E-19
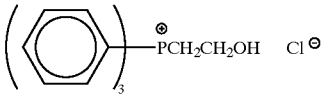
E-20
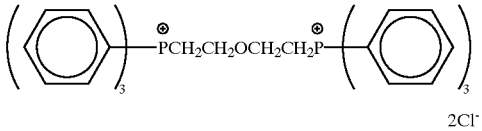
E-21
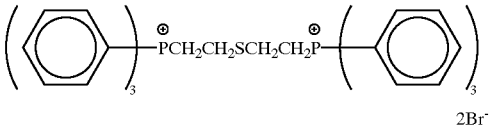
E-22
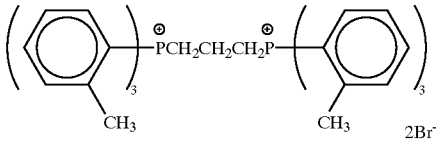
E-23
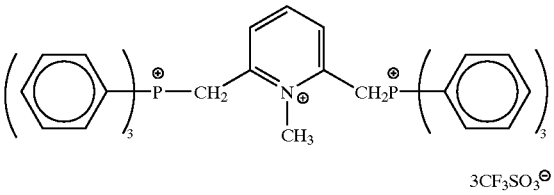
E-24
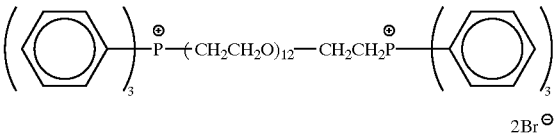
E-25
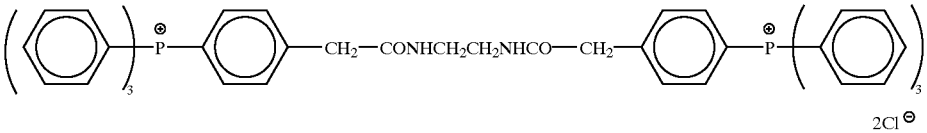
E-26
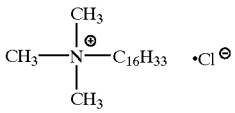
E-27
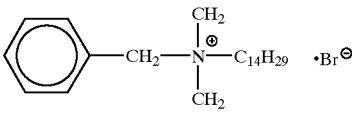
E-28
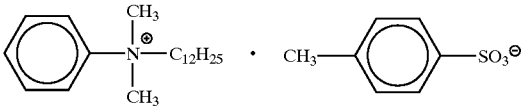
E-29
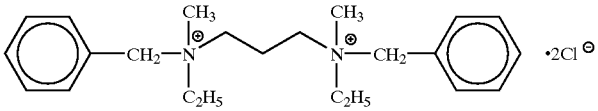
E-30
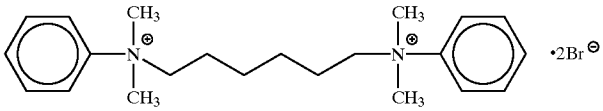
E-31
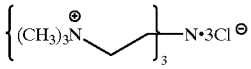
E-32
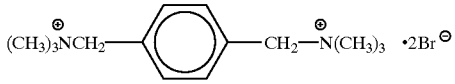

-continued
E-33
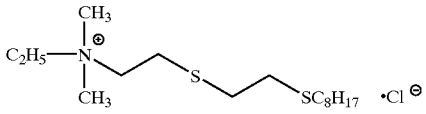
E-34
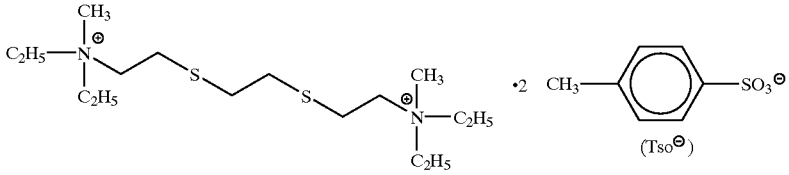
E-35
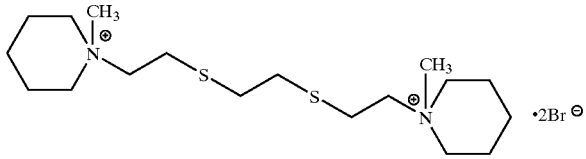
E-36
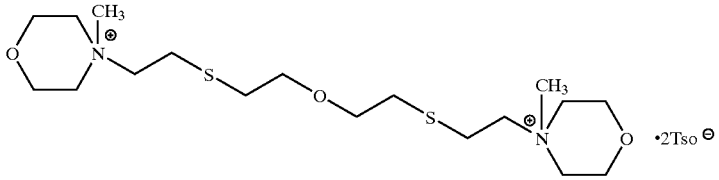
E-37
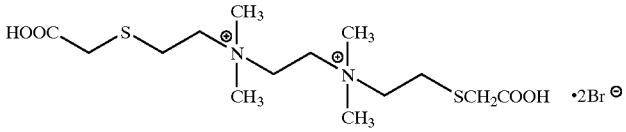
E-38
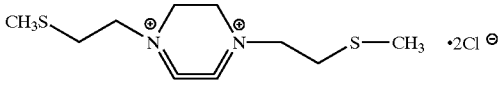
E-39
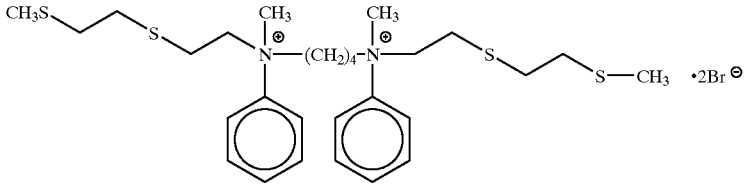
E-40
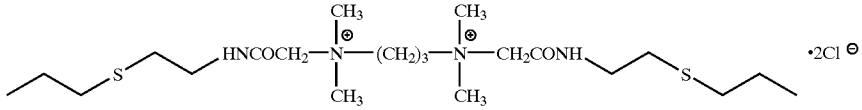
E-41
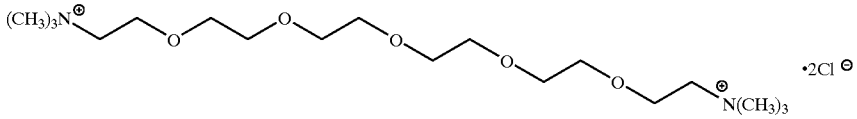
E-42
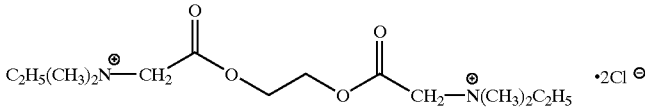

-continued
F-1
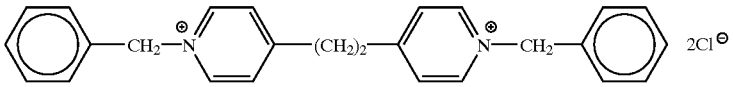
F-2
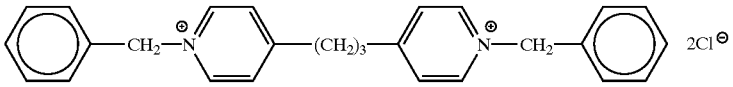
F-3
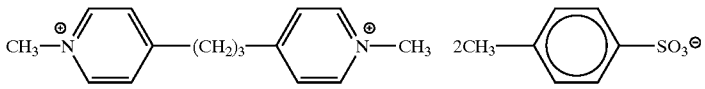
F-4
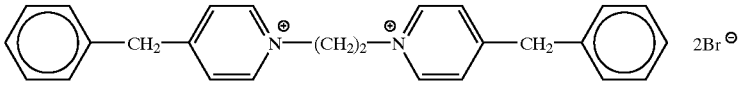
F-5
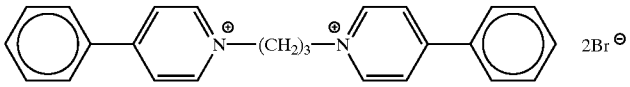
F-6
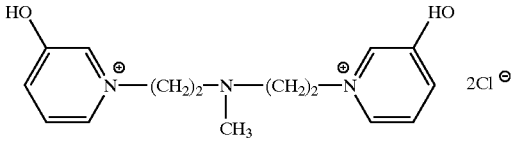
F-7
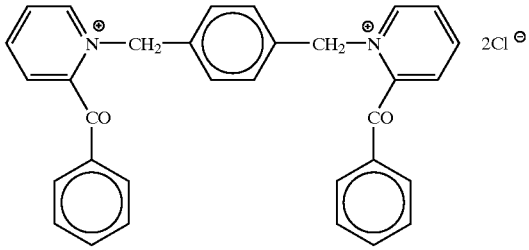
F-8
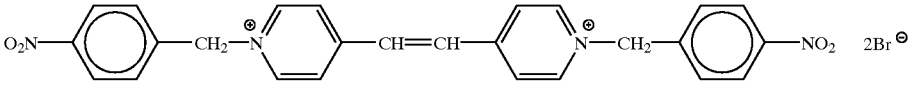
F-9
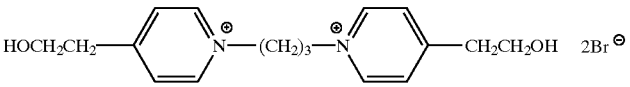
F-10
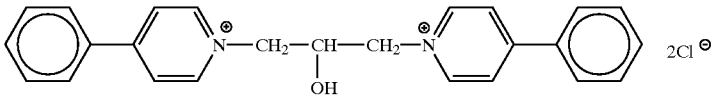
F-11
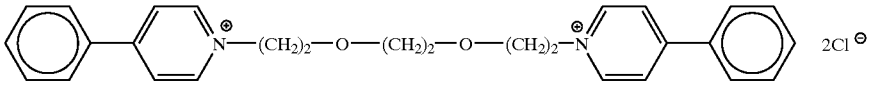
F-12
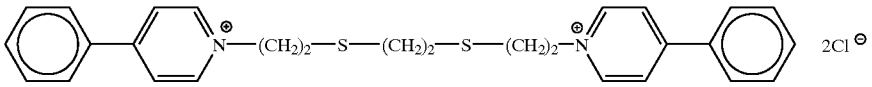
F-13
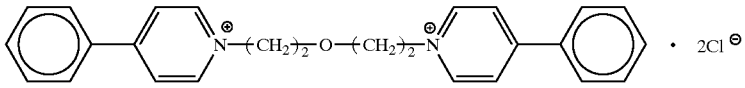
F-14
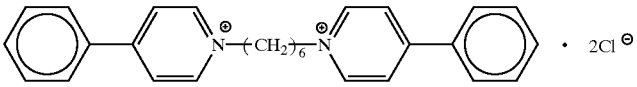

-continued
F-15
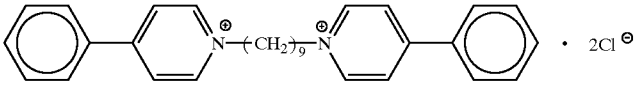
F-16
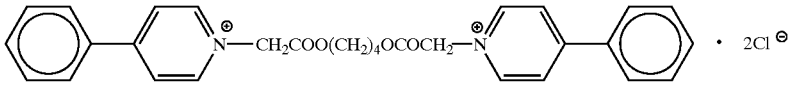
F-17
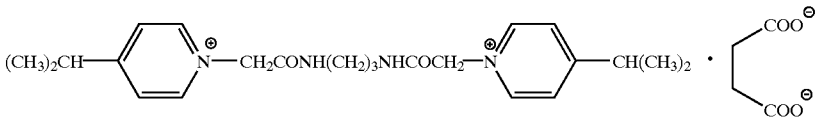
F-18
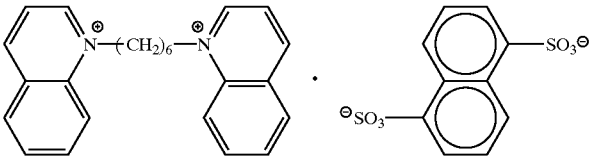
F-19
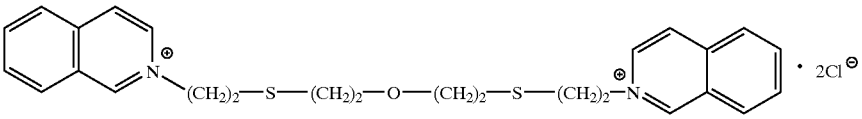
F-20
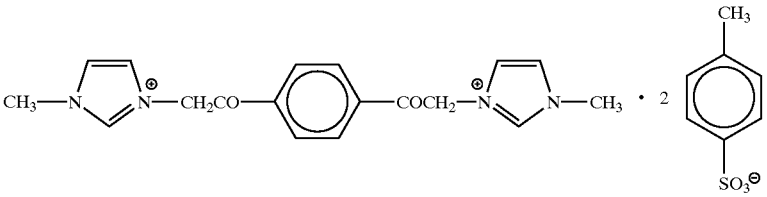
F-21
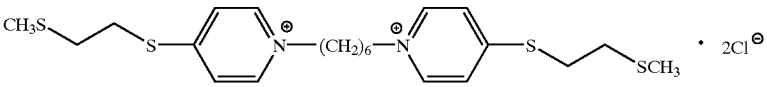
F-22
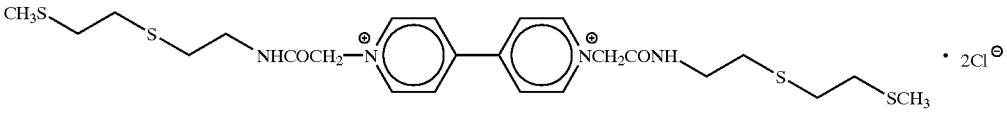
F-23
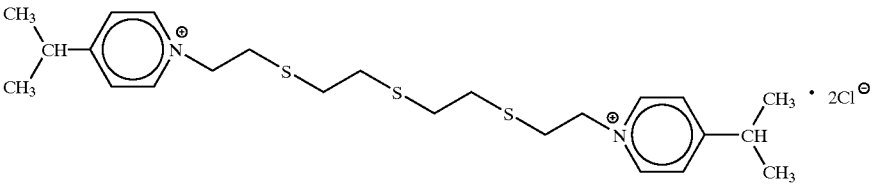
F-24
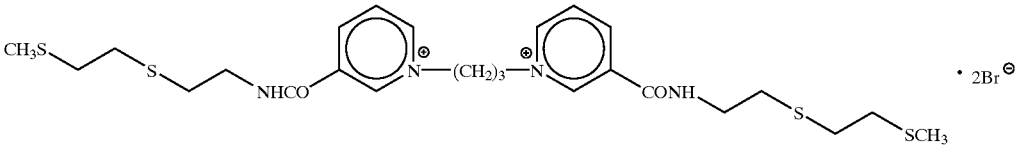

-continued
F-25
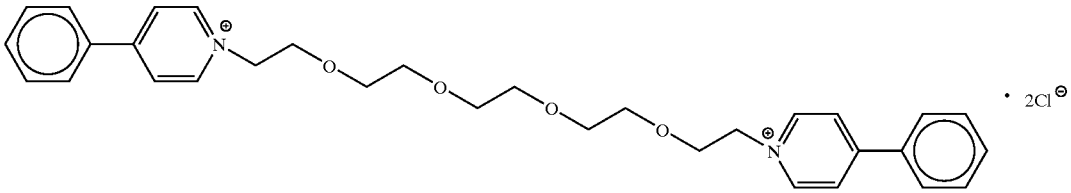
F-26
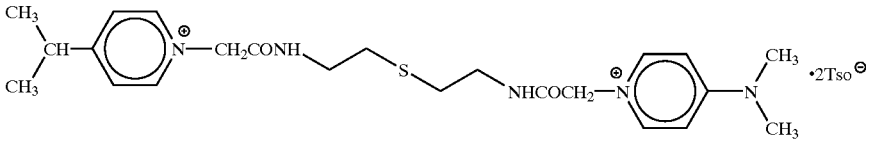
F-27
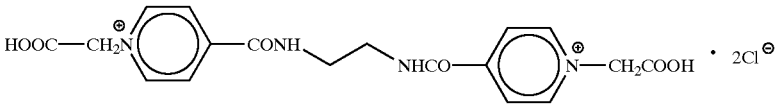
F-28
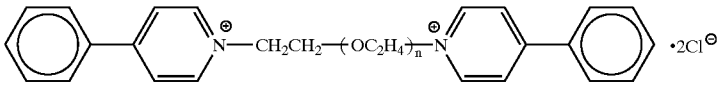
n ≈ 21
F-29
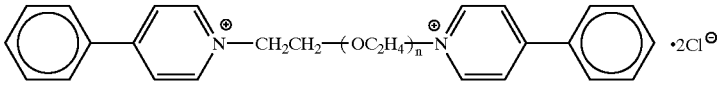
n ≈ 33
F-30
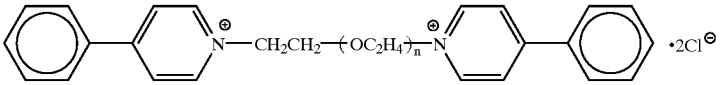
n ≈ 44
F-31
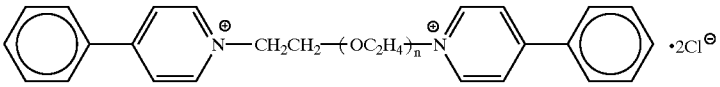
n ≈ 67
F-32
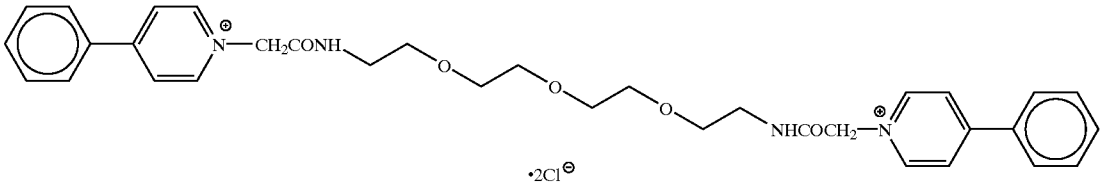
F-33
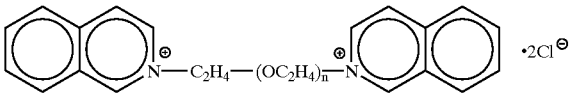
n ≈ 33
F-34
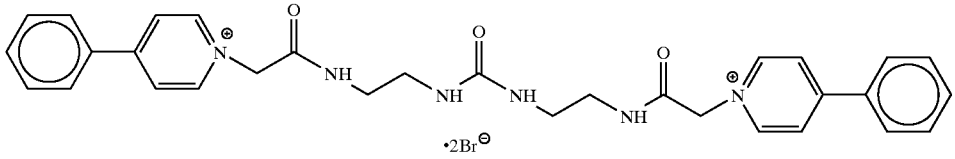

-continued
F-35
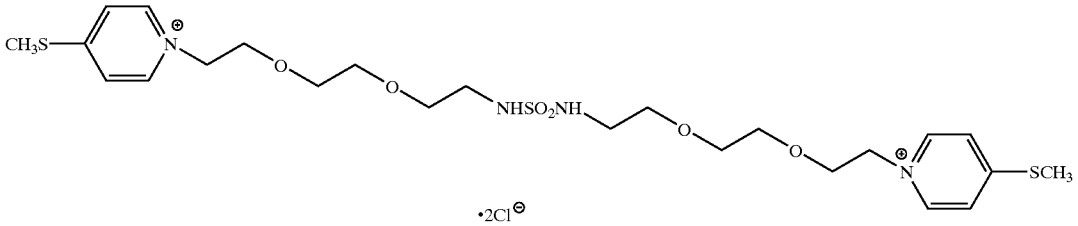
F-36
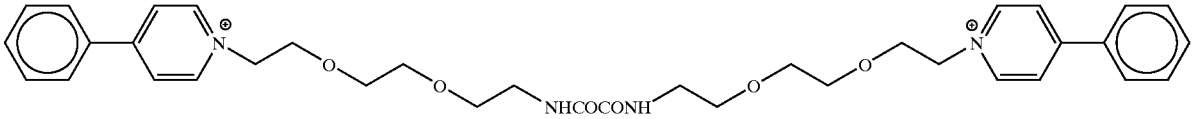
F-37
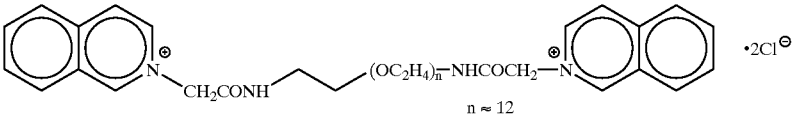
F-38
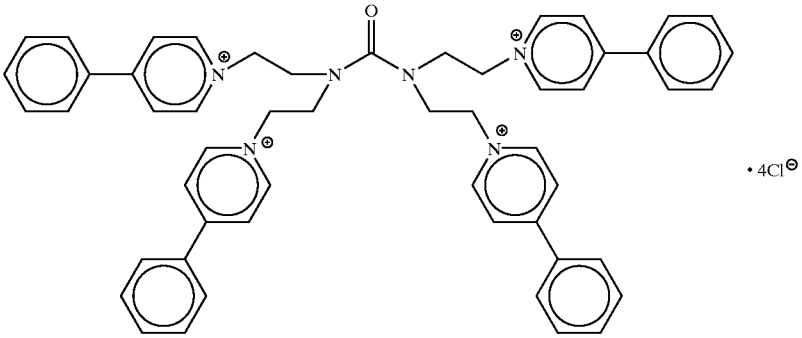
F-39
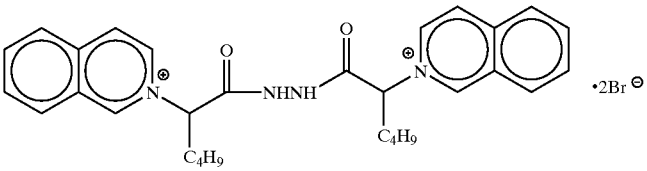
F-40
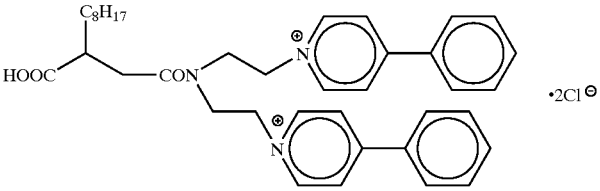
F-41
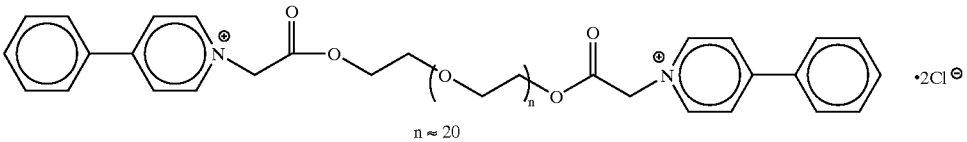
H-1
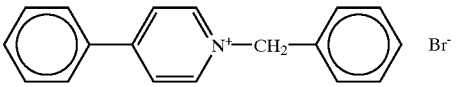
H-2
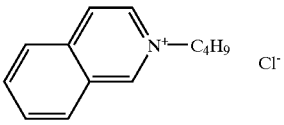

-continued
H-3
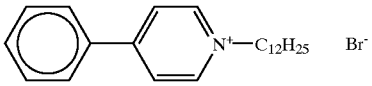
H-4
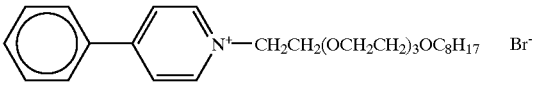
H-5
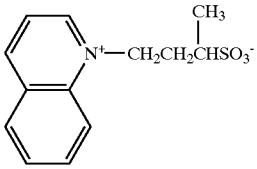
H-6
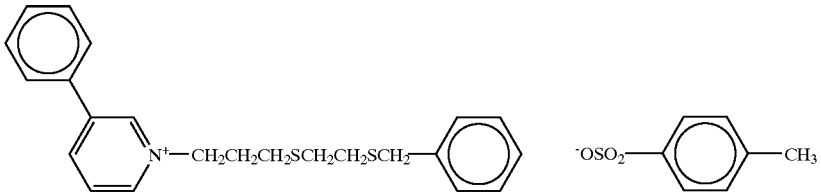
H-7
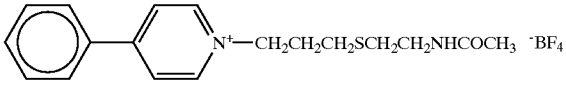
H-8
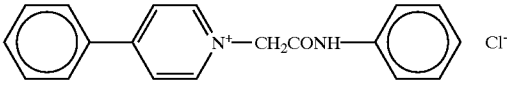
H-9
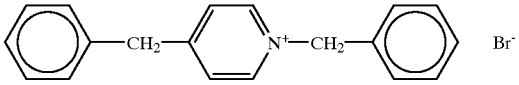
H-10
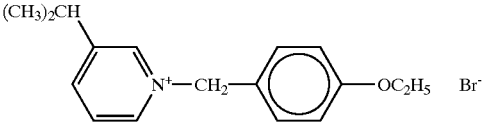
H-11
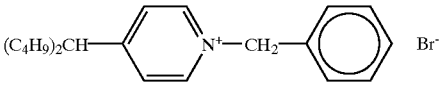
H-12
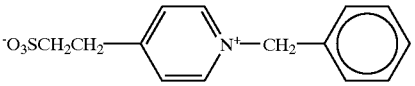
H-13
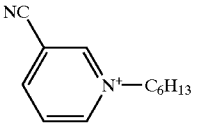
H-14
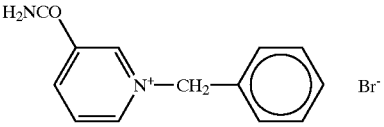
H-15
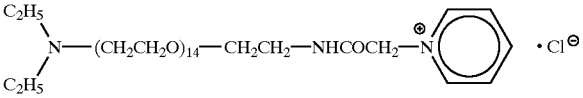
H-16
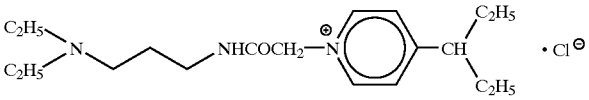
H-17
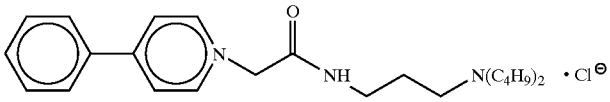
H-18
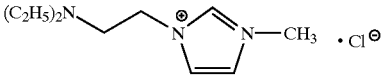
H-19
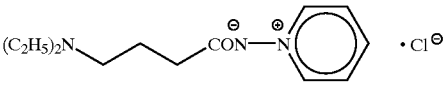
H-20
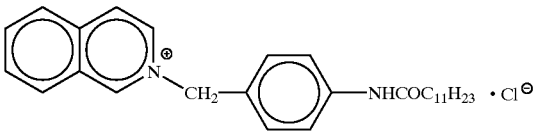

The quaternary salt compounds represented by the formulae (a) to (f) for use in the present invention can be synthesized with ease by known methods. Synthesis examples of these compounds will be shown below.

SYNTHESIS EXAMPLE 10

Synthesis of the Exemplified Compound 3

A polyethylene glycol (average molecular weight: 2000, 800 g), thionyl chloride (584 ml) and DMF (4 ml) were mixed at room temperature and the mixture was heated to 90° C. and stirred for 5 hours. After excess thionyl chloride was removed, 4-phenylpyridine (372 g) was added to the mixture, which was then reacted at 150° C. for 7 hours. An ethyl acetate/2-propanol (10:1) solution of the reaction mixture was prepared and cooled. The precipitated solid was collected by filtration and dried to obtain the target exemplified compound I-33 (584 g, yield: 62%).

SYNTHESIS EXAMPLE 11

Synthesis of the Exemplified Compound 6

A polyethylene glycol (average molecular weight: 2000, 10 g), thionyl chloride (7.3 ml) and DMF (0.1 ml) were mixed at room temperature and the mixture was heated to 90° C. and stirred for 5 hours. After excess thionyl chloride was removed, isoquinoline (4.0 g) was added to the mixture, which was then reacted at 150° C. for 7 hours. An ethyl acetate/2-propanol (10/1) solution of the reaction mixture was prepared and cooled. The precipitated solid was collected by filtration and dried to obtain the target exemplified compound 6 (7.1 g, yield: 60%).

SYNTHESIS EXAMPLE 12

Synthesis of the Exemplified Compound 4

The exemplified compound 4 was prepared in the same manner as in synthesis example 10 except that a polyethylene glycol (average molecular weight: 3000) was used in place of the polyethylene glycol (average molecular weight: 2000).

SYNTHESIS EXAMPLE 13

Synthesis of the Exemplified Compound 65

1,10-diamino-4,7-dioxadecane (17.6 g, 0.1 mol), potassium carbonate (27.6 g, 0.2 mol), ethyl acetate (100 ml) and water (50 ml) were vigorously stirred at room temperature. Chloroacetyl chloride (34 g, 0.3 mol) was added dropwise to the mixture. The reaction solution was subjected to liquid separation. The ethyl acetate layer was dried using sodium sulfate and concentrated to obtain 1,10-bis(chloroacetylamino)-4,7-dioxadecane (23 g, yield: 70%). 3.3 g of the resulting compound and triphenylphosphine (7.9 g) were mixed and heated at 150° C. for 5 hours. The reaction mixture was washed three times with ethyl acetate after being cooled to obtain the exemplified compound 65 as a brown viscous liquid in an amount of 5.4 g (yield: 63%).

SYNTHESIS EXAMPLE 14

Synthesis of the Exemplified Compound 62

The exemplified compound 62 was prepared in the same operation as in synthesis example 13 except that 4-phenylpyridine was used in place of triphenylphosphine.

SYNTHESIS EXAMPLE 15

Synthesis of the Exemplified Compound 71

The exemplified compound 71 was prepared in the same operation as in synthesis example 13 except that 0,0'-bis(2-aminopropyl)polyethylene glycol 800 was used in place of 1,10-diamino-4,7-dioxadecane and 4-phenylpyridine was used in place of triphenylphosphine.

The nucleation accelerator for use of the present invention may be used after it is dissolved in a proper water-miscible organic solvent such as alcohols (methanol, ethanol, propanol or fluorinated alcohol), ketones (acetone or methyl ethyl ketone), dimethylformamide, dimethylsulfoxide or methyl cellosolve.

Also, the nucleation accelerator may be used after it is dissolved using an auxiliary solvent such as dibutylphthalate, tricresyl phosphate, an oil such as glyceryl triacetate or diethyl phthalate, ethyl acetate, or cyclohexanone according to an already well-known emulsion-dispersion method to produce an emulsion-dispersion mechanically. Alternatively, the nucleation accelerator may be used by dispersing a powder of the nucleation accelerator in water by using a ball mill, colloid mill or ultrasonic waves.

In the present invention, although the nucleation accelerator may be added to any layer of the silver halide emulsion layer and other hydrophilic colloidal layers on the side of the silver halide emulsion layer with respect to a support, it is preferably added to the silver halide emulsion layer or a hydrophilic layer adjacent to the silver halide emulsion layer.

In the present invention, the amount of the nucleation accelerator to be added is preferably $1\times10^{-6}$ to $2\times10^{-2}$ mol more preferably $1\times10^{-5}$ to $2\times10^{-3}$ mol and most preferably $2\times10^{-5}$ to $1\times10^{-2}$ mol. These nucleation accelerators may be used in combinations of two or more.

No particular limitation is imposed on the silver halide of the silver halide emulsion for use in the silver halide photographic light-sensitive material of the present invention. As the silver halide, although silver chloride, silver chlorobromide, silver bromide, silver chlorobromoiodide or silver bromoiodide may be used, silver chlorobromide or silver chlorobromoiodide containing 50 mol % or more of silver chloride is preferable. The silver halide particle may have any form, e.g., a cubic, tetradecahedron, octahedron, undefined shape and plate shape with a cubic being desirable. The average particle diameter of the silver halide is preferably 0.1 $\mu$m to 0.7 $\mu$m and more preferably 0.1 to 0.5 $\mu$m. Silver halide particles whose coefficient of variation given by the formula {(standard deviation of particle diameter)/(average particle diameter)}×100 is generally 15% or less and preferably 10% or less and the silver halide particles having a narrow distribution of particle diameter are preferred.

The silver halide particle may have a structure in which the inside and the surface are made of either uniform phases or different phases. The silver halide particle may also have a localized layer different in halogen composition in the inside or on the surface of the particle.

The photographic emulsion for use in the present invention can be prepared using methods described, for example, by P. Glafkides, in *Chimie et Physique Photographique*, Paul Montel (1967); by G. F. Duffin, in *Photographic Emulsion Chemistry*, The Focal Press (1966); and by V. L. Zelikman et al., in *Making and Coating hotographic Emulsion*, The Focal Press (1964).

More specifically, either an acid process or a neutral process may be used. Further, a method of reacting a soluble silver salt and a soluble halogen salt may be carried out by any of a single jet method, a double jet method, and a combination thereof.

A method of forming particles in the presence of excessive silver ion (the so-called reverse-mixing method) may also be used.

As one form of the double jet method, a method of maintaining the pAg constant in the liquid phase where silver halide is produced, namely, a so-called controlled double jet method, may be used. Further, it is preferred to form particles using a so-called silver halide solvent, such as ammonia, thioether, or tetra-substituted thiourea, more preferably using a tetra-substituted thiourea compound, and this is described in JP-A-53-82408 and JP-A-55-77737. Preferred examples of the thiourea compound include tetramethylthiourea and 1,3-dimethyl-2-imidazolidinethione. The amount of silver halide solvent added varies depending on the kind of the compound used or the particle size and the halogen composition expected, but it is preferably from 10 to $10^{-2}$ mol per mol of silver halide.

According to the controlled double jet method or the method of forming particles using a silver halide solvent, a silver halide emulsion comprising particles having a regular crystal form and a narrow particle size distribution can be easily prepared. These methods are useful means for preparing the silver halide emulsion for use in the present invention.

In order to render the particle size uniform, it is preferred to rapidly grow particles within the range not exceeding the critical saturation degree, using a method of changing the addition rate of silver nitrate or alkali halide according to the particle growth rate, as described in British Patent No. 1,535,016, JP-B-48-36890, and JP-B-52-16364, or a method of changing the concentration of the aqueous solution, as described in British Patent No. 4,242,445 and JP-A-55-158124.

The silver halide emulsion for use in the present invention may contain a metal that belongs to the group VIII. It is especially preferred that a light-sensitive material suitable for a high intensity exposure such as a scanner exposure and a light-sensitive material for a line image photographing each contain such a metal compound as a rhodium compound, an iridium compound and a ruthenium compound, to thereby attain a high contrast and a low fog. Meanwhile, the silver halide particles are advantageously doped with a metal complex hexacyanide such as $K_4[Fe(CN)_6]$, $K_4[Ru(CN)_6]$ or $K_3[Cr(CN)_6]$.

As a rhodium compound for use in the present invention, a water-soluble rhodium compound can be used. Examples of the rhodium compound include rhodium (III) halide compounds, or rhodium coordination complex salts having a halogen atom, amines, oxalato, or aqua, etc., as a ligand, such as a hexachloro rhodium (III) complex salt, a pentachloroaqua rhodium (III) complex salt, a tetrachlorodiaqua rhodium (III) complex salt, a hexabromo rhodium (III) complex salt, a hexamine rhodium (III) complex salt, and a trioxalato rhodium (III) complex salt. The above-described rhodium compound is dissolved in water or an appropriate solvent before use, and a method generally, commonly used for stabilizing a solution of the rhodium compound, namely, a method of adding an aqueous solution of hydrogen halogenide (e.g. hydrochloric acid, hydrobromine acid, hydrofluoric acid) or an alkali halide (e.g. KCl, NaCl, KBr, NaBr), may be used. It is also possible to add and dissolve separately prepared silver halide particles that are previously doped with rhodium, in place of a water-soluble rhodium compound, at the preparation of silver halide.

A rhenium, ruthenium, and osmium for use in the present invention can be added in the form of water-soluble complex salts of them, described in JP-A-63-2042, JP-A-1-285941, JP-A-2-20852, and JP-A-2-20855, etc. Among these, particularly preferred are hexa-coordination metal complexes represented by the following formula:

$$[M'L'_6]^{n'-}$$

wherein M' represents Ru, Re, or Os; L' represents a ligand, and n' represents 0, 1, 2, 3, or 4. A counter ion for the above-described complex may be any cation. Examples of the counter ion include an ammonium ion and an alkali metal ion. Further, preferable examples of the ligand include a halide ligand, a cyanide ligand, a cyanate ligand, a nitrosyl ligand, and a thionitrosyl ligand. Specific examples of the complex for use in the present invention are illustrated below, but they are not intended to limit the scope of the invention.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CO)_3Cl_3]^{2-}$ | |
| $[Ru(CO)Cl_5]^{2-}$ | $[Ru(CO)Br_5]^{2-}$ | |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_4]^{4-}$ |

The addition amount of these compounds is preferably from $1\times10^{-9}$ mol to $1\times10^{-5}$ mol, and especially preferably from $1\times10^{-8}$ mol to $1\times10^{-6}$ mol, per mol of silver halide.

Examples of the iridium compound for use in the present invention include hexachloro iridium, hexabromo iridium, hexaammine iridium, and pentachloro nitrosyl iridium. Examples of the iron compound for use in the present invention include potassium hexacyano ferrate (II) and ferrous thiocyanate.

The silver halide emulsion for use in the present invention is preferably subjected to chemical sensitization. The chemical sensitization may be performed using a known method, such as sulfur sensitization, selenium sensitization, tellurium sensitization, or noble metal sensitization, and these sensitization methods may be used individually or in combination. When these sensitization methods are used in combination, a combination of sulfur sensitization and gold sensitization; a combination of sulfur sensitization, selenium sensitization, and gold sensitization; and a combination of sulfur sensitization, tellurium sensitization, and gold sensitization, are preferred.

The sulfur sensitization for use in the present invention is usually performed by adding a sulfur sensitizer and stirring the emulsion at a high temperature of 40° C. or higher for a predetermined time. The sulfur sensitizer to be used may be a known compound, and examples thereof include, in addition to the sulfur compound contained in gelatin, various sulfur compounds, such as thiosulfates, thioureas, thiazoles, and rhodanines. Preferred sulfur compounds are a thiosulfate and a thiourea compound. The addition amount of the sulfur sensitizer varies depending on various conditions, such as the pH and the temperature at the time of chemical ripening and the size of silver halide particles, but it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is generally performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-109240, JP-A-4-324855, and among these, particularly preferred are the compounds represented by formula (VIII) or (IX) of JP-A-4-324855.

The tellurium sensitizer for use in the present invention is a compound for forming silver telluride, which is presumed to become a sensitization nucleus, on the surface of or inside a silver halide particle. The formation rate of silver telluride in a silver halide emulsion can be examined according to a method described in JP-A-5-313284.

Specific examples of the tellurium sensitizer to be used include the compounds described in U.S. Pat. Nos. 1,623,499, 3,320,069, and 3,772,031, British Patent Nos. 235,211, British Patent Nos. 1,121,496, British Patent Nos. 1,295,462, and British Patent Nos. 1,396,696, Canadian Patent No. 800,958, JP-A-4-204640, JP-A-4-271341, JP-A-4-333043, JP-A-5-303157, *J. Chem. Soc. Chem. Commun.*, 635(1980); ibid., 1102 (1979); ibid., 645 (1979); *J. Chem. Soc. Perkin. Trans.*, 1, 2191 (1980); S. Patai (compiler), *The Chemistry of Organic Serenium and Tellunium Compounds*, Vol. 1 (1986); and ibid., Vol. 2 (1987). The compounds represented by formulae (II), (III), and (IV) of JP-A-4-324855 are particularly preferred.

The amount to be used of the selenium sensitizer or the tellurium sensitizer for use in the present invention varies depending on the silver halide particles used or the chemical ripening conditions, but it is generally from in the order of $10^{-8}$ to $10^{-2}$ mol, preferably from $10^{-7}$ to $10^{-3}$ mol, per mol of silver halide. The conditions of chemical sensitization in the present invention are not particularly restricted, but the pH is generally from 5 to 8, the pAg is generally from 6 to 11, preferably from 7 to 10, and the temperature is generally from 40 to 95° C., preferably from 45 to 85° C.

Examples of the noble metal sensitizer for use in the present invention include gold, platinum, palladium, and iridium, and gold sensitization is particularly preferred. Specific examples of the gold sensitizer for use in the present invention include chloroauric acid, potassium chloroaurate, potassium auric thiocyanate, and gold sulfide. The gold sensitizer can be used in an amount of approximately from $10^{-7}$ to $10^{-2}$ mol per mol of silver halide.

In the silver halide emulsion for use in the present invention, a cadmium salt, a sulfite, a lead salt, or a thallium salt may be present together during formation or physical ripening of silver halide particles.

In the present invention, reduction sensitization may be used. Examples of the reduction sensitizer to be used include stannous salts, amines, formamidinesulfinic acid, and silane compounds.

To the silver halide emulsion for use in the present invention, a thiosulfonic acid compound may be added, according to the method described in European Unexamined Patent Publication (EP)-293,917.

As the silver halide emulsion in the light-sensitive material used in the present invention, only one type may be used or two or more types (for example, those different in average particle size, in halogen composition, in crystal habit or in the condition of chemical sensitization) may be used together. To obtain, particularly, high contrast, it is preferable to apply an emulsion with a higher sensitivity as the emulsion is closer to a support as described in JP-A-6-324426.

Although the light-sensitive silver halide emulsion for use in the present invention may be spectrally sensitized to blue light, green light, red light or infrared light having relatively long wavelengths, by a sensitizing dye preferably it is spectrally sensitized by a spectrally sensitizing dye having a maximum absorption wavelength ranging from 450 nm to 600 nm. As the sensitizing dye, the compounds of the formula [I] described in JP-A-55-45015 and the compounds of the formula [I] described in JP-A-9-160185 are preferable and the compounds of the formula [I] described in JP-A-9-160185 are particularly preferable. Specific examples include the compounds (1) to (19) described in JP-A-55-45015 and the compounds (I-1) to (I-40) and (I-56) to (I-85) described in JP-A-9-160185.

Examples of the sensitizing dye that can be used also include a cyanine dye, a merocyanine dye, a complex cyanine dye, a complex merocyanine dye, a holopolar cyanine dye, a styryl dye, a hemicyanine dye, an oxonol dye, and a hemioxonol dye.

Useful sensitizing dyes for use in the present invention are described, for example, in *Research Disclosure*, Item 17643, IV-A (December, 1978, page 23); ibid., Item 18341 X (August 1979, page 437), and publications cited therein. In particular, sensitizing dyes having spectral sensitivity suitable for spectral characteristics of various light sources in a scanner, an image setter, or a photomechanical camera, can be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, Compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, besides the above-described compounds, Compounds I-41 to I-55 and I-86 to I-97 described in JP-A-9-160185, Compounds 4-A to 4-S, 5-A to 5-Q, and 6-A to 6-T described in JP-A-6-242547, may be advantageously selected.

These sensitizing dyes may be used individually or in combination, and a combination of sensitizing dyes is often used for the purpose of, particularly, supersensitization. In combination with the sensitizing dye, a dye which itself has no spectral sensitization effect, or a material that absorbs substantially no visible light, but that exhibits supersensitization, may be incorporated into the emulsion.

Useful sensitizing dyes, combinations of dyes that exhibit supersensitization, and materials that show supersensitzation are described, for example, in *Research Disclosure*, Vol. 176, 17643, page 23, Item IV-J (December 1978); JP-B-49-25500, JP-B-43-4933, JP-A-59-19032, and JP-A-59-192242.

The sensitizing dyes for use in the present invention may be used in a combination of two or more thereof. The sensitizing dye may be added to a silver halide emulsion by dispersing it directly in the emulsion, or by dissolving it in a sole or mixed solvent of such solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by a method disclosed in U.S. Pat. No. 3,469,987, in which a dye is dissolved in a volatile organic solvent, the solution is dispersed in water or a hydrophilic colloid, and the dispersion is added to the emulsion; a method disclosed, for example, in JP-B-44-23389, JP-B-44-27555, and JP-B-57-22091, in which a dye is dissolved in an acid, and the solution is added to the emulsion, or a dye is formed into an aqueous solution in the co-existence of an acid or base and then it is added to the emulsion; a method disclosed, for example, in U.S. Pat. Nos. 3,822,135 and 4,006,025, in which a dye is formed into an aqueous solution or a colloid dispersion in the presence of a surface-active agent together, and the solution or dispersion is added to the emulsion; a method disclosed in JP-A-53-102733 and JP-A-58-105141, in which a dye is directly dispersed in a hydrophilic colloid, and the dispersion is added to the emulsion; or a method disclosed in JP-A-51-74624, in which a dye is dissolved using a compound capable of red-shift, and the solution is added to the emulsion. Ultrasonic waves may also be used in the solution.

The sensitizing dye for use in the present invention may be added to a silver halide emulsion for use in the present invention at any step known to be useful during the preparation of a photographic emulsion. For example, the dye may be added at a step of formation of silver halide particles, and/or in a period before desalting, or at a step of desalting, and/or in a period between after desalting and before initiation of chemical ripening, as disclosed, for example, in U.S. Pat. Nos. 2,735,766, 3,628,960, 4,183,756, and 4,225,666, JP-A-58-184142, and JP-A-60-196749, or the dye may be added in any period or at any step before coating of the emulsion, such as immediately before or during chemical ripening, or in a period after chemical ripening but before coating, as disclosed, for example, in JP-A-58-113920. Also, a sole kind of compound alone, or compounds different in structure in combination, may be added in divided manner; for example, a part during particle formation, and the remaining during chemical ripening, or after completion of the chemical ripening; or a part before or during chemical ripening, and the remaining after completion of the chemical ripening, as disclosed, for example, in U.S. Pat. No. 4,225,666 and JP-A-58-7629. The kind of compounds added in divided manner, or the kind of the combination of compounds, may be changed.

The addition amount of the sensitizing dye for use in the present invention varies depending upon the shape, size, the halogen composition of silver halide particles, the method and degree of chemical sensitization, the kind of antifoggant, and the like, but the addition amount can be from $4\times10^{-6}$ to $8\times10^{-3}$ mol per mol of silver halide. For example, when the silver halide particle size is from 0.2 to 1.3 $\mu$m, the addition amount is preferably from $2\times10^{-7}$ to $3.5\times10^{-6}$ more preferably from $6.5\times10^{-7}$ to $2.0\times10^{-6}$ mol, per $m^2$ of the surface area of a silver halide particle.

Various additives for use in the light-sensitive material of the present invention are not particularly restricted, and, for example, those described in the following portions may be preferably used:

polyhydroxybenzene compounds described in JP-A-3-39948, from page 10, right lower column, line 11, to page 12, left lower column, line 5, specifically, Compound (III)-1 to 25 described in the publication;

Compounds represented by formula (I) and having substantially no maximum absorption in the visible region, described in JP-A-1-118832, specifically, Compounds I-1 to I-26 described in the publication;

antifogging agents described in JP-A-2-103536, page 17, right lower column, line 19, to page 18, right upper column, line 4;

polymer latexes described in JP-A-2-103536, page 18, left lower column, lines 12 to 20; polymer latexes having an activated methylene group represented by formula (I) described in JP-A-9-179228, specifically, Compounds I-1 to I-16 described in the specification thereof; polymer latexes having a core/shell structure described in JP-A-9-179228, specifically, Compounds P-1 to P-55 described in the specification thereof; An acidic polymer latex described in the publication of JP-A-7-104413, page 14, left column, line 1 to right column, line 30, specifically the compounds II-1) to II-9) described in the same publication, page 15;

matting agents, slipping agents, and plasticizers described in JP-A-2-103536, from page 19, left upper column, line 15, to right upper column, line 15;

hardening agents described in JP-A-2-103536, page 18, right upper column, lines 5 to 17;

compounds having an acid group described in JP-A-2-103536, from page 18, right lower column, line 6, to page 19, left upper column, line 1;

electrically conductive materials described in JP-A-2-18542, from page 2, left lower column, line 13, to page 3, right upper column, line 7, specifically, metal oxides described in the publication, page 2, right lower column, lines 2 to 10, and electrically conductive high-molecular compounds of Compounds P-1 to P-7 described in the publication;

water-soluble dyes described in JP-A-2-103536, from page 17, right lower column, lines 1 to page 17, right upper column, line 18;

solid dispersion dyes represented by formulae (FA), (FA1), (FA2), and (FA3) described in JP-A-9-179243, specifically, Compounds F1 to F34 in the specification thereof, and Compounds (II-2) to (II-24), (III-5) to (III-18), and (IV-2) to (IV-7) described in JP-A-7-152112; solid dispersion dyes described in JP-A-2-294638 and JP-A-5-11382;

surface-active agents described in JP-A-2-12236, from page 9, right upper column, line 7 to page 9, right lower column, line 3; PEG-series surface-active agents described in JP-A-2-103536, page 18, left lower column, lines 4 to 7; fluoro surface-active agents described in JP-A-3-39948, from page 12, left lower column, line 6, to page 13, right lower column, line 5, specifically, Compounds VI-1 to VI-15 described in the publication;

Binders described in the publication of JP-A-2-18542, page 3, right lower column, line 1 to line 20.

The degree of swelling of the hydrophilic colloid layers of the silver halide photographic light-sensitive material of the present invention, including a silver halide emulsion layer and a protective layer, is preferably from 80 to 150%, and more preferably from 90 to 140%. The degree of swelling of the hydrophilic colloid layers is obtained by measuring the thickness ($d_0$) of the hydrophilic colloid layers, including a silver halide emulsion layer and a protective layer, of the silver halide photographic light-sensitive material, measuring the swollen thickness ($\Delta d$) of the said silver halide photographic light-sensitive material after it has been dipped in distilled water at 25° C. for 1 minute, and following the calculating equation set forth below.

$$\text{Degree of swelling } (\%) = (\Delta d) \div d_0 \times 100$$

The pH of a film surface on the side to which the silver halide emulsion layer of the silver halide photographic light-sensitive material of the present invention is applied is in a range of 4.5 to 7.5, preferably 4.8 to 7.0 and particularly preferably 5.0 to 6.0.

Examples of the support (base) that can be used in practice of the present invention include a baryta paper, a polyethylene-laminated paper, a polypropylene synthetic paper, a glass plate, cellulose acetate, cellulose nitrate, and polyester films, such as polyethylene terephthalate. These supports are properly selected in accordance with the use purpose of each silver halide photographic light-sensitive material.

Also, a support comprising a styrene-series polymer having a syndiotactic structure described in JP-A-7-234478 and U.S. Pat. No. 558,979 is preferably used.

The processing agents, such as the developer and the fixing solution, and the processing method for use in the present invention are described below, but the invention is by no means limited to the following description and specific examples.

The development for use in the present invention may be performed by any known method, and a known development processing solution may be used.

The developing agent for use in the developer (the development-initiating solution and the development replenisher are collectively called a developer, hereinafter the same) used in the present invention is not particularly restricted, but it preferably contains a dihydroxybenzene compound, or a hydroquinone monosulfonate, individually or in combination. Particularly, it is preferable for the developing agent to comprise a combination of a dihydroxybenzene-series developing agent with an auxiliary developing agent that shows superadditivity. Examples of the combination include combinations of dihydroxybenzenes and/or ascorbic acid derivatives with p-aminophenol compound.

Examples of the dihydroxybenzene developing agent for use in the present invention include hydroquinone, chlorohydroquinone, isopropylhydroquinone, and methylhydroquinone, with hydroquinone being particularly preferred. As an ascorbic acid derivative-type developing agent, ascorbic acid or isoascorbic acid or its salts may be used. Particularly sodium erysorbate is preferable in view of material costs.

Examples of the 1-phenyl-3-pyrazolidones or derivatives thereof as the developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol-series developing agent for use in the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, and o-methoxy-p-(N-methylamino)phenol, with N-methyl-p-aminophenol and aminophenols, described in JP-A-9-297377, and JP-A-9-297378, being preferred.

The dihydroxybenzene-series developing agent is preferably used in an amount of generally from 0.05 to 0.8 mol/l. When a dihydroxybenzene compound and a 1-phenyl-3-pyrazolidone compound or a p-aminophenol compound are used in combination, the former is preferably used in an amount of from 0.05 to 0.6 mol/l, more preferably from 0.10 to 0.5 mol/l, and the latter is preferably used in an amount of 0.06 mol/l or less, more preferably from 0.03 to 0.003 mol/l.

The ascorbic acid derivative-type developing agent is used in an amount of generally 0.01 mol/l to 0.5 mol/l and more preferably 0.05 mol/l to 0.3 mol/l. When a combination of an ascorbic acid derivative and 1-phenyl-3-pyrazolidones or p-aminophenols is used, preferably the ascorbic acid derivative is used in an amount of 0.01 mol/l to 0.5 mol/l and 1-phenyl-3-pyrazolidones or p-aminophenols are used in an amount of 0.005 mol/l to 0.2 mol/l.

The developer used in processing the light-sensitive material of the present invention may contain additives (e.g. a developing agent, an alkali agent, a pH buffer, a preservative, a chelating agent) that are commonly used. Specific examples thereof are described below, but the present invention is by no means limited thereto.

Examples of the buffer for use in the developer used in development-processing the light-sensitive material of the present invention include carbonates, boric acids described in JP-A-62-186259, saccharides (e.g. saccharose) described in JP-A-60-93433, oximes (e.g. acetoxime), phenols (e.g. 5-sulfosalicylic acid), and tertiary phosphates (e.g. sodium salt and potassium salt), with carbonates and boric acids being preferred. The buffer, particularly the carbonate, is preferably used in an amount of 0.1 mol/l or more, particularly preferably from 0.2 to 1.5 mol/l.

Examples of the preservative for use in the present invention include sodium sulfite, potassium sulfite, lithium sulfite, ammonium sulfite, sodium bisulfite, sodium methabisulfite, and formaldehyde-sodium bisulfite. The sulfite is used in an amount of preferably 0.2 mol/l or more, particularly preferably 0.3 mol/l or more, but if it is added too excessively, silver staining in the developer is caused. Accordingly, the upper limit is preferably 1.2 mol/l. The amount is particularly preferably from 0.35 to 0.7 mol/l.

As a preservative for a dihydroxybenzene-series developing agent, the aforementioned ascorbic acid derivative may be used in a small amount together with a sulfite. Among these ascorbic derivatives, it is preferable to use sodium erysorbate in view of material costs. The amount of the ascorbic acid derivative in a range of preferably 0.03 to 0.12 and particularly preferably 0.05 to 0.10 in terms of mol ratio to dihydroxybenzene-series developing agent. When an ascorbic acid derivative is used as a preservative, it is not preferable that a boron compound is contained in the developer.

Examples of additives to be used other than those described above include a development inhibitor, such as sodium bromide and potassium bromide, an organic solvent, such as ethylene glycol, diethylene glycol, triethylene glycol, and dimethylformamide; a development accelerator, such as an alkanolamine including diethanolamine and triethanolamine, and an imidazole and derivatives thereof; and a physical development unevenness inhibitor, such as a heterocyclic mercapto compound (e.g. sodium 3-(5-mercaptotetrazol-1-yl)benzene sulfonate, 1-phenyl-5-rercaptotetrazole) and the compounds described in JP-A-62-212651.

Further, a mercapto-series compound, an indazole-series compound, a benzotriazole-series compound, or a benzimidazole-series compound may be added, as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, and 2-mercaptobenzotriazole. The addition amount thereof is generally from 0.01 to 10 mmol, preferably from 0.1 to 2 mmol, per liter of the developer.

Further, various kinds of organic or inorganic chelating agents can be used individually or in combination in the developer for use in the present invention.

Examples of the inorganic chelating agent include sodium tetrapolyphosphate and sodium hexametaphosphate.

Examples of the organic chelating agent include organic carboxylic acid, aminopolycarboxylic acid, organic phosphonic acid, aminophosphonic acid, and organic phosphonocarboxylic acid.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acid, described in U.S. Pat. Nos. 3,214,454 and 3,794,591 and West German Patent Publication (OLS) No. 2,227,369, and the compounds described in *Research Disclosure*, Vol. 181, Item 18170 (May 1979).

Examples of the aminophosphonic acid include aminotris(methylenephosphonic acid), ethylenediamine tetramethylenephosphonic acid, aminotrimethylenephosphonic acid, and the compounds described in *Research Disclosure*, No. 18170 (supra), JP-A-57-208554, JP-A-54-61125, JP-A-55-29883, and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, and *Research Disclosure*, No. 18170 (supra).

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{-1}$ mol, more preferably from $1\times10^{-3}$ to $1\times10^{-2}$ mol, per liter of the developer.

Examples of the silver stain inhibitor added to the developer include the compounds described in JP-A-56-24347, JP-B-56-46585, JP-B-62-2849, JP-A-4-362942, and JP-A-8-6215; triazines having one or more mercapto groups (for example, the compounds described in JP-B-6-23830, JP-A-3-282457, and JP-A-7-175178); pyrimidines having one or more mercapto groups (e.g. 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, compounds described in JP-A-9-274289); pyridines having one or more mercapto groups (e.g. 2-mercaptopyridine, 2,6-dimercaptopyridine, 3,5-dimercaptopyridine, 2,4,6-trimercaptopyridine, compounds described in JP-A-7-248587); pyrazines having one or more mercapto groups (e.g. 2-mercaptopyrazine, 2,6-dimercaptopyrazine, 2,3-dimercaptopyrazine, 2,3,5-trimercaptopyrazine); pyridazines having one or more mercapto groups (e.g. 3-mercaptopyridazine, 3,4-dimercaptopyridazine, 3,5-dimercaptopyridazine, 3,4,6-trimercaptopyridazine); the compounds described in JP-A-7-175177, and polyoxyalkylphosphates described in U.S. Pat. No. 5,457,011. These silver stain inhibitors may be used individually or in combination of two or more of these. The addition amount thereof is preferably from 0.05 to 10 mmol, more preferably from 0.1 to 5 mmol, per liter of the developer.

The developer may contain the compounds described in JP-A-61-267759, as a dissolution aid.

Further, the developer may contain a color toner, a surface-active agent, a defoaming agent, or a hardening agent, if necessary.

The developer preferably has a pH of from 9.0 to 12.0, more preferably from 9.0 to 11.0, particularly preferably from 9.5 to 11.0. The alkali agent used for adjusting the pH may be a usual water-soluble inorganic alkali metal salt (e.g. sodium hydroxide, potassium hydroxide, sodium carbonate, potassium carbonate, or the like).

With respect to the cation of the developer, potassium ion does not inhibit development but causes small indentations, called a fringe, on the periphery of the blacked portion, as compared with sodium ion. When the developer is stored as a concentrated solution, potassium salt is generally preferred, because of its higher solubility. However, since, in the fixing solution, potassium ion causes fixing inhibition on the same level as caused by silver ion, if the developer has a high potassium ion concentration, the developer is carried over by the light-sensitive material, to disadvantageously increase the potassium ion concentration in the fixing solution. Accordingly, the molar ratio of potassium ion to sodium ion in the developer is preferably between 20:80 and 80:20. The ratio of potassium ion to sodium ion can be freely controlled within the above-described range by a counter cation, such as a pH buffer, a pH-adjusting agent, a preservative, or a chelating agent.

The replenishing amount of the developer replenisher is generally 390 ml or less, preferably from 325 to 30 ml, and most preferably from 250 to 120 ml, per $m^2$ of the light-sensitive material. The developer replenisher may have the same composition and/or concentration as the development initiating solution, or it may have a different composition and/or concentration from the initiating solution.

Examples of the fixing agent in the fixing processing agent for use in the present invention include ammonium thiosulfate, sodium thiosulfate, and ammonium sodium thiosulfate. The amount to be used of the fixing agent may be varied appropriately, but it is generally from about 0.7 to about 3.0 mol/l.

The fixing solution for use in the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, and aluminum lactate. These are each preferably contained, in terms of an aluminum ion concentration in the use solution, in an amount of from 0.01 to 0.15 mol/l.

When the fixing solution is stored as a concentrated solution or a solid agent, it may be constituted by a plurality of parts, preparing a hardening agent or the like as a separate part, or it may be constituted as a one-part agent containing all components.

The fixing processing agent may contain, if desired, a preservative (e.g. sulfite, bisulfite, metabisulfite; in an amount of generally 0.015 mol/l or more, preferably from 0.02 to 0.3 mol/l), a pH buffer (e.g. acetic acid, sodium acetate, sodium carbonate, sodium hydrogencarbonate, phosphoric acid, succinic acid, adipic acid; in an amount of generally from 0.1 to 1 mol/l, preferably from 0.2 to 0.7 mol/l), or a compound having aluminum-stabilizing ability or hard-water-softening ability (e.g. gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, crysteine, ethylenediaminetetraacetic acid, nitrilotriacetic acid, and a derivative and salt thereof, saccharides, and boric acid; in an amount of generally from 0.001 to 0.5 mol/l, preferably from 0.005 to 0.3 mol/l).

In addition, the fixing processing agent may contain a compound described in JP-A-62-78551, a pH-adjusting agent (e.g. sodium hydroxide, ammonia, sulfuric acid), a surface-active agent, a wetting agent, or a fixing accelerator. Examples of the surface-active agent include anionic surface-active agents, such as sulfated products and sulfonated products; polyethylene-series surface-active agents, and amphoteric surface-active agents described in JP-A-57-6840. A known deforming agent may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535, and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645, and JP-A-3-101728; thiocyanates and meso-ionic compounds described in JP-A-4-170539.

The fixing solution for use in the present invention has a pH of preferably 4.0 or more, more preferably from 4.5 to 6.0. The pH of the fixing solution increases due to mingling of the developer upon processing, and in this case, the hardening fixing solution has a pH of generally 6.0 or less, preferably 5.7 or less, and the non-hardening fixing solution has a pH of generally 7.0 or less, preferably 6.7 or less.

The replenishing amount of the fixing solution is generally 500 ml or less, preferably 390 ml or less, more preferably from 320 to 80 ml, per 1 $m^2$ of the light-sensitive material. The replenisher may have the same composition and/or concentration as the initiating solution, or it may have a composition and/or a concentration different from the initiating solution.

The fixing solution may be regenerated and reused using a known fixing solution regenerating method, such as electrolytic silver recovery. Examples of the regeneration apparatus include Reclaim R-60, trade name, manufactured by Fuji Hunt KK.

It is also preferred to remove dyes or the like through an adsorption filter, such as activated carbon.

When the development and fixing processing agents are liquid agents, it is preferable to store these agents in packing material having low oxygen-permeability as described in, for example, JP-A-61-73147. Moreover, when these solutions are concentrated solutions, they are used after being diluted by adding water in a ratio of 0.2 to 3 parts to 1 part of the concentrated solution such that a given concentration is obtained.

Even if the development and fixing processing agents used in the present invention are solids, the same results as those of the liquid agents can be obtained. Descriptions concerning the solid processing agents will be shown hereinbelow.

For the solid agents in the present invention, known forms (e.g., a powder, particle, granule, block, tablet, compactor, briquette, plate, bar and paste) may be used. These solid agents may be coated with a water-soluble coating agent or film to separate components, which are mutually brought into contact and reacts, from each other, or may have a structure of plural layers to separate components, which mutually reacts, from each other. Also, these means may be combined.

As the coating agent and granulation auxiliary, known materials may be used and a polyvinylpyrrolidone, polyethylene glycol, polystyrenesulfonic acid or vinyl-series compound is preferable. Besides the above compounds, the description of JP-A-5-45805, column 2, line 48 to column 3, line 13 can be made to reference.

When a structure of plural layers is adopted, a material having a structure in which a component that is not reactive is interposed between components that react with each other when brought into contact, may be prepared and may be processed into a tablet or a briquette or the like. Also, components having known forms are used to make the above same layer structure, which is then packaged. These methods are shown in, for instance, JP-A-61-259921, JP-A-4-16841, JP-A-4-78848 and JP-A-5-93991.

The apparent density of the solid agent is preferably 0.5 to 6.0 g/$cm^3$, specifically, 1.0 to 5.0 g/$cm^3$ in the case of a tablet and 0.5 to 1.5 g/$cm^3$ in the case of a granule.

As the method of the production of the solid agent of the present invention, any known method may be used. For instance, methods described in JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and the like can be made to reference.

More specifically, a rolling granulation method, extrusion granulation method, compression granulation method, cracking granulation method, agitation granulation method, spray drying method, dissolution solidification method, briquetting method, roller compacting method, or the like may be used.

The solid agent of the present invention may be changed in surface condition (e.g. smoothness and porousness) and thickness in part, or it may be made into a hollow donut shape, to control solubility. It is also possible to make the solid agents have plural shapes, in order to give plural granulated materials different solubilities, or to make materials having different solubilities accord with each other in solubility. Further, multilayer granulated materials in which the surface and the inside have different compositions may be used.

As the packing material for the solid agent, materials which have low oxygen and water permeability are preferable and as the shape of the package material, known shapes such as a bag form, cylinder form and box form may be used. A foldable form as disclosed in JP-A-6-242585 to JP-A-6-242588, JP-A-6-247432, JP-A-6-247448, JP-A-6-301189, JP-A-7-5664 and JP-A-7-5666 to JP-A-7-5669 is preferable to decrease a space required for storing discarded packings.

These packing materials may be provided with a screw cap, pull-top, or aluminum seal at the take-off port or may be heat-sealed. Also, other known materials may be used and the packing materials are not particularly restricted. Moreover, it is preferable to recycle or reuse discarded packings in view of environmental safeguard.

There is no particular limitation to a method of dissolving and replenishing the solid agent of the present invention and known methods may be used. Examples of these methods include a method in which a fixed amount of solid agent is dissolved in a dissolving apparatus with a stirring function and replenished, a method in which the solid agent is dissolved in a dissolving apparatus comprising a dissolution section and a section for stocking a complete solution and is replenished from the stock section as disclosed in JP-A-9-80718, a method in which the processing agent is introduced into a circulatory system of an automatic developing machine to dissolve and replenish the processing agent as disclosed in JP-A-5-119454, JP-A-6-19102 and JP-A-7-261357 and a method in which corresponding to the processing of a light-sensitive material the processing agent is introduced into and dissolved in an automatic developing machine with a built-in dissolving vessel. Also, any one of known methods besides the above methods may be used. Also, the processing agent may be introduced either by human hands or by opening the seal and introducing automatically by using a dissolution apparatus comprising a seal-opening mechanism as described in JP-A-9-138495 and using an automatic developing machine. The latter is preferable in view of working circumstance. Specifically, there are methods of breaking through, peeling off, cutting off and push-cutting the take-off port and methods described in JP-A-6-19102 and JP-A-6-95331.

The light-sensitive material processed through development and fixing is then subjected to water-washing or stabilization (hereinafter, unless otherwise specified, water-washing includes stabilization, and the solution for use therein is called water or washing water). The water for use in water-washing may be tap water, ion exchanged water, distilled water, or a stabilizing solution. The replenishing amount of the washing water is generally from about 17 to about 8 liter per $m^2$ of the light-sensitive material, but a replenishing amount lower than the above-described range may also be used. In particular, when the replenishing amount is 3 liter or less (including 0, namely, standing water washing), not only can the processing achieve water savings, it can also dispense with piping for installation of an automatic developing machine. When water-washing is performed with a small replenishing amount of water, a rinsing tank of a squeeze roller or a crossover roller, described in JP-A-63-18350 and JP-A-62-287252, is preferably provided. Alternatively, addition of various oxidizing agents (e.g. ozone, hydrogen peroxide, sodium hypochlorite, active halogen, chlorine dioxide, sodium carbonate hydrogen peroxide salt) or filter filtration may be combined, so as to reduce the pollution load, which is a problem incurred in the case of water-washing with a small amount of water, or for preventing water scale.

As the method for reducing the replenishing amount of washing water, a multi-stage countercurrent system (for example, two or three stages) has been known for a long time, and the replenishing amount of washing water is preferably from 200 to 50 ml per $m^2$ of the light-sensitive material. This effect can also be obtained similarly in the case of an independent multi-stage system (a method of not using a countercurrent system but supplying a new solution individually to the multi-stage water-washing tanks).

In the method in the present invention, a means for preventing water scale may be provided in the water-washing step. The water-scale-preventing means is not particularly restricted, and a known means may be used. Examples thereof include a method of adding a fungicide (a so-called water scale inhibitor), a method of passing electricity, a method of irradiating ultraviolet rays, infrared rays, or far infrared rays, a method of applying a magnetic field, a method of treating with ultrasonic waves, a method of applying heat, and a method of evacuating the tank on standing. The water-scale-preventing means may be applied according to the processing of the light-sensitive material; it may be applied at a predetermined interval irrespective of the use state, or it may be applied only in the period of non-processing time, such as nighttime. Further, the washing water may be previously treated with a water-scale-preventing means and then replenished. Further, in view of preventing generation of resistant microbes, it is preferred to perform different water-scale-preventing means at predetermined intervals.

The fungicide is not particularly restricted, and a known fungicide may be used. Examples thereof include, in addition to the above-described oxidizing agents, a glutaraldehyde, a chelating agent, such as aminopolycarboxylic acid, a cationic surface-active agent, and a mercaptopyridine oxide (e.g. 2-mercaptopyridine-N-oxide), and a sole fungicide may be used, or a plurality of fungicides may be used in combination.

The electricity may be passed according to the method described in JP-A-3-224685, JP-A-3-224687, JP-A-4-16280, or JP-A-4-18980.

In addition, a known water-soluble surface-active agent or defoaming agent may be added, so as to prevent uneven processing due to bubbling, or to prevent transfer of stains. Further, a dye adsorbent described in JP-A-63-163456 may be provided in the water-washing system, so as to prevent stains due to a dye dissolved out from the light-sensitive material.

The overflow solution from the water-washing step may be partly or wholly used by mixing it with the processing solution having fixing ability, as described in JP-A-60-235133. It is also preferred, in view of conservation of the natural environment, to reduce the biochemical oxygen demand (BOD), chemical oxygen demand (COD), or iodine consumption before discharge, by subjecting the solution to microorganism treatment (for example, sulfur oxidation bacteria or activated sludge treatment, or treatment with a filter comprising a porous carrier, such as activated carbon or ceramic, having carried thereon microorganisms) or oxidation treatment with an oxidizing agent or electrification, or to reduce the silver concentration in waste water by passing the solution through a filter, using a polymer having affinity for silver, or by adding a compound that forms a hardly soluble silver complex, such as trimercaptotriazine, to precipitate silver, and then passing the solution through a filter.

In some cases, stabilization may be performed subsequent to the water-washing, and as one example, a bath containing the compounds described in JP-A-2-201357, JP-A-2-132435, JP-A-1-102553, and JP-A-46-44446 may be used as a final bath of the light-sensitive material. This stabilization bath may also contain, if desired, an ammonium compound, a metal compound, such as Bi or Al, a fluorescent brightening agent, various chelating agents, a layer pH-adjusting agent, a hardening agent, a bactericide, a fungicide, an alkanolamine, or a surface-active agent.

The additives, such as a fungicide and the stabilizing agent added to the water-washing or stabilization bath, may be formed into a solid agent, similarly to the above-described development and fixing processing agents.

Wastewater of the developer, the fixing solution, the washing water, or the stabilizing solution for use in the present invention, is preferably burned for disposal. The wastewater can also be formed into a concentrated solution or a solid by a concentrating apparatus, as described, for example, in JP-B-7-83867 and U.S. Pat. No. 5,439,560, and then disposed.

When the replenishing amount of the processing agent is reduced, it is preferred to prevent evaporation or air oxidation of the solution, by reducing the contact area of the processing tank with air. A roller transportation-type automatic-developing machine is described, for example, in U.S. Pat. Nos. 3,025,779 and 3,545,971, and in the present specification, it is simply referred to as a roller transportation-type automatic processor. This automatic processor comprises four steps of development, fixing, water-washing, and drying, and it is most preferred to follow this four-step processing also in the present invention, though other steps (e.g. stopping step) are not excluded. Further, a rinsing bath may be provided between development and fixing, and/or between fixing and water-washing.

In the processing in the present invention, the dry-to-dry time is preferably from 25 to 160 seconds, the development time and the fixing time are each generally 40 seconds or less, preferably from 6 to 35 seconds, and the temperature of each solution is preferably from 25 to 50° C., more preferably from 30 to 40° C. The temperature and the time of water-washing are preferably from 0 to 50° C. and 40 seconds or less, respectively. According to the method in the present invention, the light-sensitive material after development, fixing, and water-washing may be passed through squeeze rollers, for squeezing washing water, and then dried. The drying is generally performed at a temperature of from about 40° C. to about 100° C. The drying time may be appropriately varied depending upon the ambient state. The drying method is not particularly restricted, and any known method may be used, but hot-air drying, and drying by far infrared rays or a heat roller as described in JP-A-4-15534, JP-A-5-2256, and JP-A-5-289294 may be used, and a plurality of drying methods may also be used in combination.

The silver halide photographic light-sensitive material of the present invention produces such excellent working effects that it has excellent photographic properties such as high sensitivity, high contrast (for example, γ is 10 or more) and high Dmax and also has good original reproduction property in the formation of an image.

The silver halide photographic light-sensitive material of the present invention is also superior in the point that it is reduced in the variations of sensitivity, γ and Dmax and has also excellent original reproduction even if it is processed in a developer in which the density of sulfurous acid introduced as a preservative is decreased or the pH is changed by deterioration over time, or in a developer in which the pH is changed and the density of bromine ions is increased on account of the processing of a large number of films. Also, according to the processing method of the present invention, if the processing is carried out using a developer having a pH lower than that of a conventional method, the aforementioned excellent properties can be maintained and it is possible to decrease the amount of a developer to be replenished.

Further, the light-sensitive material of the present invention which combines a nucleation accelerator has a wide exposure latitude and good dot quality besides the aforementioned properties. The image forming method using this light-sensitive material makes it possible to attain the formation of an image ensuring good dot quality, good reproduction of dot images and excellent original reproduction.

The present invention will now be described in more detail with reference to the following examples, but the invention is not limited to those.

EXAMPLES

Used developers and fixing solutions have the compositions shown below.

The composition of Developer (1) per liter of its concentrated solution is shown below.

| | |
|---|---|
| Potassium hydroxide | 105.0 g |
| Diethylenetriamine-pentaacetate | 6.0 g |
| Potassium carbonate | 120.0 g |
| Sodium metabisulfite | 120.0 g |
| Potassium bromide | 9.0 g |
| Hydroquinone | 75.0 g |
| 5-Methylbenzotriazole | 0.25 g |
| 4-Hydroxymethyl-4-methyl-1-phenyl-3-pyrazolidone | 1.35 g |
| 4-(N-carboxymethyl-N-methylamino)-2,6-dimercaptopyrimidine | 0.3 g |
| Sodium 2-mercaptobenzoimidazole-5-sulfonate | 0.45 g |
| Sodium erysorbate | 9.0 g |
| Diethylene glycol | 60.0 g |
| pH | 10.7 |

When use was made, 1 part of the above concentrated solution was diluted with 2 parts of water. pH of the used solution was 10.5.

The composition of solid developer (Developer (2)) is shown below.

| | |
|---|---|
| Sodium hydroxide (beads) 99.5% | 11.5 g |
| Potassium sulfite (raw powder) | 63.0 g |
| Sodium sulfite (raw powder) | 46.0 g |
| Potassium carbonate | 62.0 g |
| Hydroquinone (briquette) | 40.0 g |
| Materials listed below were briquetted together. | |
| Diethylenetriamine-pentaacetate | 2.0 g |
| 5-Methylbenzotriazole | 0.35 g |
| 4-Hydroxymethyl-4-methyl-1-phenyl-3-pyrazolidone | 1.5 g |
| 4-(N-carboxymethyl-N-methylamino)-2,6-dimercaptopyrimidine | 0.2 g |
| Sodium 3-(5-mercaptotetrazol-1-yl)benzene sulfonate | 0.1 g |
| Sodium erysorbate | 6.0 g |
| Potassium bromide | 6.6 g |

Water was added to make 1 liter, and pH was adjusted to 10.65.

Here, as to the form of raw materials, a general industrial product was used as it was as the raw powder and a commercially available product was used as the beads of alkali metal salt.

When the form of the raw material was a briquette, it was used after it was compressed using a briquetting machine to form a plate which was then crushed. With regard to least components, these components were blended with each other and then briquetted.

The above processing agent was filled in an amount corresponding to 10 liter in a foldable container made of a high density polyethylene and its take off port was sealed with an aluminum seal. For the dissolution and replenishment, a dissolving and replenishing apparatus having an automatic seal-opening mechanism as disclosed in JP-A-9-80718 and JP-A-9-138495 was used.

The composition of Developer (3) per liter of its concentrated solution is shown below.

| | |
|---|---|
| Potassium hydroxide | 60.0 g |
| Diethylenetriamine-pentaacetate | 3.0 g |
| Potassium carbonate | 90.0 g |
| Sodium metabisulfite | 105.0 g |
| Potassium bromide | 10.5 g |
| Hydroquinone | 60.0 g |
| 5-Methylbenzotriazole | 0.53 g |
| 4-Hydroxymethyl-4-methyl-1-phenyl-3-pyrazolidone | 2.3 g |
| Sodium 3-(5-mercaptotetrazole-1-yl)-benzenesulfonate | 0.15 g |
| Sodium 2-mercaptobenzoimidazole-5-sulfonate | 0.45 g |
| Sodium erysorbate | 9.0 g |
| Diethylene glycol | 7.5 g |
| pH | 10.79 |

When use was made, 2 parts of the above concentrated solution was diluted with 1 part of water. pH of the used solution was 10.65. For replenisher, 4 parts of the above concentrated solution was diluted with 3 parts of water. pH of the replenisher was 10.62.

The composition of fixing solution (1) per liter of its concentrated solution is shown below.

| | |
|---|---|
| Ammonium thiosulfate | 360 g |
| Ethylenediaminetetraacetic acid 2Na dihydrate | 0.09 g |
| Sodium thiosulfate pentahydrate | 33.0 g |
| Sodium metabisulfite | 57.0 g |
| Sodium hydroxide | 37.2 g |
| Acetic acid (100%) | 90.0 g |
| Tartaric acid | 8.7 g |
| Sodium gluconate | 5.1 g |
| Alminum sulfate | 25.2 g |
| pH | 4.85 |

When use was made, 1 part of the above concentrated solution was diluted with 2 parts of water. pH of the used solution was 4.8.

The composition of solid fixing agent (fixing solution (2)) is shown below.

| | |
|---|---|
| Agent A (solid) | |
| Ammonium thiosulfate (compact) | 125.0 g |
| Sodium thiosulfate anhydride (raw powder) | 19.0 g |
| Sodium methabisulfite (raw powder) | 18.0 g |
| Sodium acetate anhydride (raw powder) | 42.0 g |
| Agent B (liquid) | |
| Ethylenediamine.tetraacetic acid.2Na.dihydrate | 0.03 g |
| tartaric acid | 2.9 g |
| Sodium gluconate | 1.7 g |
| Aluminum sulfate | 8.4 g |
| Sulfuric acid | 2.1 g |

These components were diluted with water into a volume of 50 ml.

The agents A and B were dissolved in water to prepare 1 liter of solution, and pH was adjusted to 4.8.

As ammonium thiosulfate (compact), one obtained by compressing a flake product produced by a spray drying method under pressure by using a roller compactor and by crushing the flake product into tips with an undefined shape and a length of 4 to 6 mm was used and blended with sodium thiosulfate anhydride. As other raw powders, general industrial products were used.

Both of the agents A and B were respectively filled in an amount corresponding to 10 liter in a foldable container made of a high density polyethylene. The take-off port of the container for the agent A was sealed with an aluminum seal and the port of the container for the agent B was sealed using a screw cap. For the dissolution and replenishment, a dissolving and replenishing apparatus having an automatic seal-opening mechanism as disclosed in JP-A-9-80718 and JP-A-9-138495 was used.

Example 1

Preparation of Emulsion A

Emulsion A was prepared by the following method.

500 cc of an aqueous silver nitrate solution in which 150 g of silver nitrate was dissolved and 500 cc of an aqueous halide solution in which 44 g of potassium bromide and 34 g of sodium chloride were dissolved and $(NH_4)_2RhCl_5(H_2O)$ and $K_3IrCl_6$ were included in amounts equivalent to $2\times10^{-7}$ mol and $1\times10^{-7}$ mol respectively per 1 mol of silver of a total emulsion, were added to an aqueous 2% gelatin solution, in which 3 g of sodium chloride, 0.02 g of 1,3-dimethyl-2-imidazolithion, 0.5 g of citric acid, 4 mg of sodium benzenethiosulfonate, and 1 mg of sodium benzenesulfinate were dissolved in 1 liter of water, at 38° C. for 20 minutes with stirring by using a double jet method to obtain particles of silver chlorobromide having an average particle size of 0.21 $\mu$m and containing silver chloride in a content of 58 mol % thereby forming a nuclei. In succession, 200 cc of an aqueous silver nitrate solution in which 50 g of silver nitrate was dissolved and 200 cc of an aqueous halide solution in which 12 g of potassium bromide and 13 g of sodium chloride were dissolved and potassium hexacyano iron (II) acid salt was included in an amount equivalent to $1\times10^{-5}$ mol per 1 mol of silver of a total emulsion were added to the resulting solution over 10 minutes by using a double jet method.

Thereafter, a KI solution was added in an amount of $1\times10^{-3}$ mol per 1 mol of silver to carry out conversion, followed by washing with water by a flocculation method according to the usual method. Then, a gelatin was added in an amount of 40 g per 1 mol of silver and the resulting mixture was adjusted to pH 5.9 and pAg 7.5. Thereafter 8 mg of sodium benzenethiosulfonate, 2 mg of sodium benzenesulfinate, 3 mg of sodium thiosulfate, 2 mg of triphenylphosphine selenide and 8 mg of chloroauric acid, per 1 mol of silver, were further added to the resulting mixture, which was then heated at 55° C. for 60 minutes to carry out a chemical sensitization operation. After that, 250 mg of 4-hydroxy-6-methyl-1,3,3a,7-tetrazaindene as a stabilizer and 100 mg of PROXEL (trade name, manufactured by ICI Co., Ltd.) as an antiseptic agent were added. The resulting particles were cubic particles of silver iodochlorobromide having an average particle size of 0.23 $\mu$m and containing silver chloride in a content of 60 mol % (coefficient of variation: 10%).

Preparation of Emulsion B

Emulsion B was prepared by the following method.

250 cc of an aqueous silver nitrate solution in which 75 g of silver nitrate was dissolved and 250 cc of an aqueous halide solution in which 16 g of potassium bromide and 20 g of sodium chloride were dissolved and $(NH_4)_2RhCl_5(H_2O)$ and $K_3IrCl_6$ were included in amounts equivalent to $4\times10^{-7}$ mol and $1\times10^{-7}$ mol respectively per 1 mol of silver of a total emulsion was added to an aqueous 2% gelatin solution, in which 4 g of sodium chloride, 0.02 g of 1,3-dimethyl-2-imidazolithion, 0.5 g of citric acid, 4 mg of sodium benzenethiosulfonate and 1 mg of sodium benzenesulfinate were dissolved in 1 liter of water, at 45° C. for 12 minutes with stirring by using a double jet method to obtain particles of silver chlorobromide having an average particle size of 0.20 $\mu$m and containing silver chloride in a content of 70 mol % thereby forming a nuclei. In succession, 400 cc of an aqueous silver nitrate solution in which 125 g of silver nitrate was dissolved and 400 cc of an aqueous halide solution in which 26 g of potassium bromide and 34 g of sodium chloride were dissolved to the resulting solution over 20 minutes by using a double jet method.

Thereafter, a KI solution was added in an amount of $1\times10^{-3}$ mol per 1 mol of silver to carry out conversion, followed by washing with water by a flocculation method according to the usual method. Then, a gelatin was added in an amount of 40 g per 1 mol of silver and the resulting mixture was adjusted to pH 6.0 and pAg 7.5. Thereafter 7 mg of sodium benzenethiosulfonate, 2 mg of sodium benzenesulfinate, 8 mg of chloroauric acid, and 5 mg of sodium thiosulfate, per 1 mol of silver, were further added to the resulting mixture, which was then heated at 60° C. for 60 minutes to carry out a chemical sensitization operation. After that, 250 mg of 4-hydroxy-6-methyl-1,3,3a,7-tetrazaindene as a stabilizer and 100 mg of PROXEL as an antiseptic agent were added. The resulting particles were cubic particles of silver iodochlorobromide having an average particle size of 0.28 $\mu$m and containing silver chloride in a content of 70 mol % (coefficient of variation: 10%).

Preparation of Coating Solution for Hydrazine-containing Layer Emulsion

To Emulsion A were added $5\times10^{-4}$ mol of a compound represented by the following structual formula (s-1) as a sensitizing dye and further $1\times10^{-3}$ mol of potassium bromide, $5\times10^{-4}$ mol of a mercapto compound represented by the following structural formula (a) and a mercapto compound represented by the following structural formula (b), $1\times10^{-4}$ mol of a triazine compound represented by the following structural formula (c), $1\times10^{-3}$ mol of a hydrazine compound represented by the structural formula (D-66) and $5\times10^{-4}$ mol of a nucleation accelerator represented by the structural formula (F-25), per 1 mol of silver. Furthermore, colloidal silica (Snowtex C (trade name), manufactured by Nissan Chemical Industries, Ltd.) and a dispersion of polyethylacrylate were added such that both compounds were applied in amounts of 500 mg/m$^2$ and 500 mg/m$^2$ respectively to prepare a coating solution for a hydrazine-containing layer. The pH of the solution was adjusted to 5.8.

(S-1)

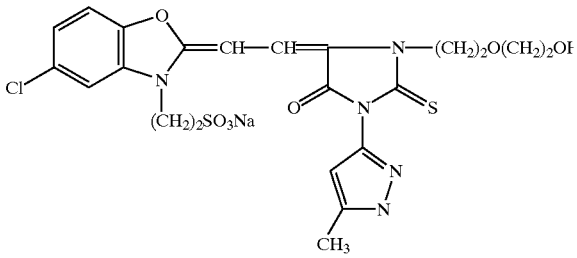

-continued (a)

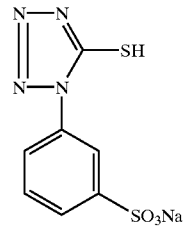

(b)

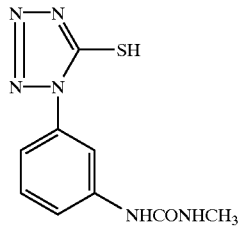

(c)

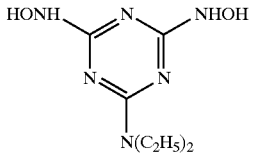

Preparation of Coating Solution for Redox Compound-containing Layer Emulsion To Emulsion B were added $1\times10^{-4}$ mol of a compound represented by the structural formula (s-1) shown previously as a sensitizing dye and further $5\times10^{-4}$ mol of a mercapto compound represented by the structural formula (a) and $1\times10^{-4}$ mol of a triazine compound represented by the structural formula (c) per 1 mol of silver of a redox compound-containing layer emulsion. Moreover, a dye represented by the structural formula (e) shown below, a dispersion of a polyethylacrylate, and 1,2-bis (vinylsulfonylacetamide)ethane as a hardening agent such that these compounds were applied in amounts of 5 mg/m$^2$, 100 mg/m$^2$, and 50 mg/m$^2$ respectively. Still more, exemplified compounds or the following comparative compounds (A) to (H) shown in Tables 1 to 3 were added in an amount of $2.8\times10^{-3}$ mol/mol Ag based on total silver of a light-sensitive material to prepare a coating solution for a redox compound-containing layer emulsion. The pH of the solution was adjusted to 5.6.

At this time, an emulsified redox compound prepared in the following manner was dissolved at 60° C. and added to the coating solution.

Comparative compound (A)

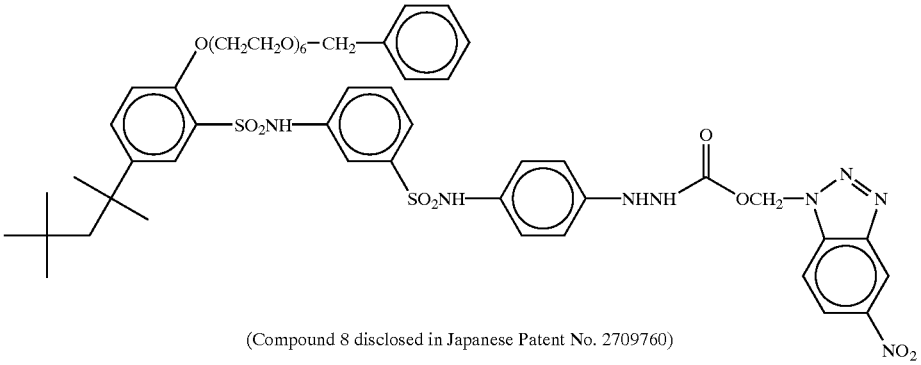

(Compound 8 disclosed in Japanese Patent No. 2709760)

Comparative compound (B)

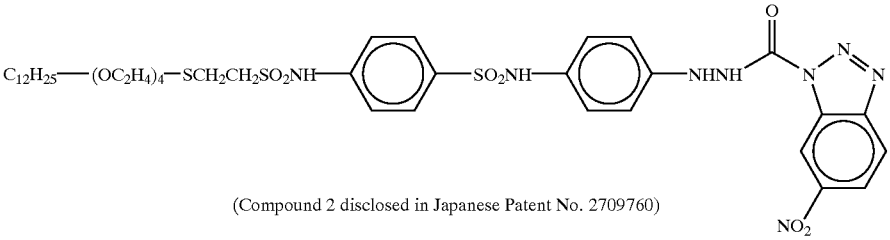

(Compound 2 disclosed in Japanese Patent No. 2709760)

Comparative compound (C)

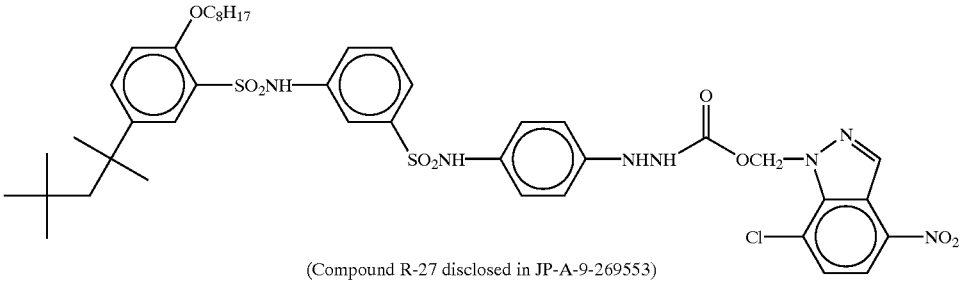

(Compound R-27 disclosed in JP-A-9-269553)

Comparative compound (D)

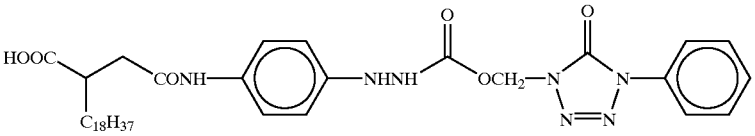

(Compound (5) disclosed in Japanese patent No. 2656924)

Comparative compound (E)

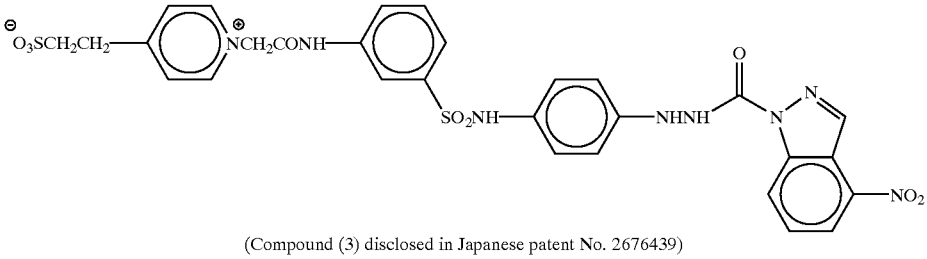

(Compound (3) disclosed in Japanese patent No. 2676439)

Comparative compound (F)

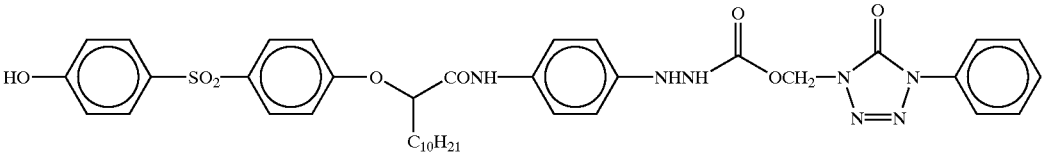

(Compound (2) disclosed in Japanese patent No. 2656924)

-continued

Comparative compound (G)

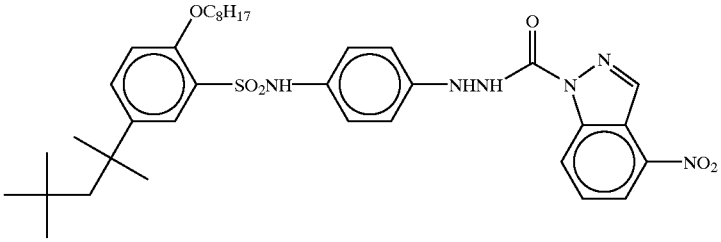

(Compound 10 disclosed in Japanese patent No. 2725088)

(e)

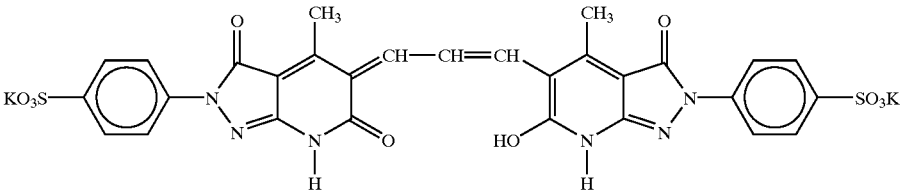

(Preparation of an Emulsified Redox Compound)

4 g of the above redox compound, 0.3 g of sodium p-dodecylbenzenesulfonate, and 4 g of tricresyl phosphate were added to 30 cc of ethyl acetate, and the mixture was dissolved at 60° C. to prepare a solution A. 8.5 g of a gelatin and 0.02 g of PROXEL (trade name, manufacture by ICI Co., Ltd.) were added to 82 g of water and dissolved at 60° C. to prepare a solution B. The solution A was mixed with the solution B and the mixture was emulsion-dispersed at 60° C. by using a high-speed homogenizer. After the emulsion-dispersion was finished, a solvent-removal operation was performed at 60° C under reduced pressure to obtain an emulsified dispersion of the redox compound.

Preparation of Coating Solution for Interlayer

Sodium ethanethiosulfonate, a dye represented by the following formula (f), hydroquinone, 5-chloro-8-hydroxlyquinoline, and a dispersion of a polyethylacrylate were added to a gelatin solution containing PROXEL as an antiseptic agent such that these compounds were applied in amounts of 5 mg/m$^2$, 50 mg/m$^2$, 100 mg/m$^2$, 10 mg/m$^2$ and 100 mg/m$^2$ respectively to prepare a coating solution for an interlayer. The pH of the solution was adjusted to 7.0.

(f)

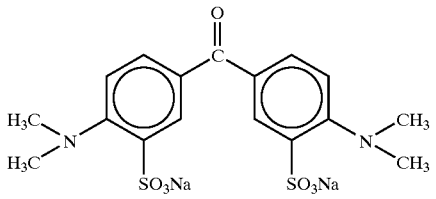

Preparation of Light-sensitive Material Samples

Then, on a polyethylene terephthalate film of which both surfaces were undercoated by a moisture-proofing layer composed of vinylidene chloride, 0.3 g/m$^2$ of a gelatin layer was formed as the lowest layer. Also, a redox compound-containing layer (0.4 g/m$^2$ of Ag and 0.4 g/m$^2$ of a gelatin) was formed on the gelatin layer through a hydrazine-containing layer (3.4 g/m$^2$ of Ag and 1.65 g/m$^2$ of a gelatin) and an interlayer (1.0 g/m$^2$ of a gelatin). Further, 0.2 g/m$^2$ of a gelatin as a protective layer, 50 mg/m$^2$ of an $SiO_2$ matting agent having an undefined shape and an average particle size of about 3.5 μm, 0.1 g/m$^2$ of colloidal silica (Snowtex C (trade name) manufactured by Nissan Chemical Industries, Ltd.), 50 mg/m$^2$ of a liquid paraffin, 1 mg/m$^2$ of a fluoro-surfactant represented by the structural formula (g) shown below and 10 mg/m$^2$ of sodium p-dodecylbenzenesulfonate were applied to the redox compound-containing layer. At this time, to the lowest gelatin layer, a dispersion of a polyethylacrylate was added in the same amount as the gelatin and 1,2-bis(vinylsulfonylacetamide)ethane was added as a hardening agent such that it was applied in an amount of 50 mg/m$^2$. The pH of the film surface of the resulting samples were 5.5 to 5.8.

| <Back layer> | |
|---|---|
| Gelatin | 2.8 g/m$^2$ |
| Surfactants: | |
| Sodium p-dodecylbenzenesulfonate | 40 mg/m$^2$ |
| Sodium dihexyl-α-sulfosuccinate | 40 mg/m$^2$ |
| Gelatin hardening agent: 1,2-bis(vinylsulfonylacetamide)ethane | 200 mg/m$^2$ |
| $SnO_2$/Sb (weight ratio: 90/10, average particle diameter: 0.20/μm) | 200 mg/m$^2$ |
| Dye (a mixture of the following dyes (h-1), (h-2), (h-3) and (h-4)) | |
| Dye (h-1) | 20 mg/m$^2$ |
| Dye (h-2) | 50 mg/m$^2$ |
| Dye (h-3) | 20 mg/m$^2$ |
| Dye (h-4) | 30 mg/m$^2$ |
| Antiseptic agent (PROXEL) | 10 mg/m$^2$ |

Also, the back layer was formed using the following composition.

<Back layer>

| | |
|---|---|
| Gelatin | 2.8 g/m$^2$ |
| Surfactants: | |
| Sodium p-dodecylbenzenesulfonate | 40 mg/m$^2$ |

(h-1)

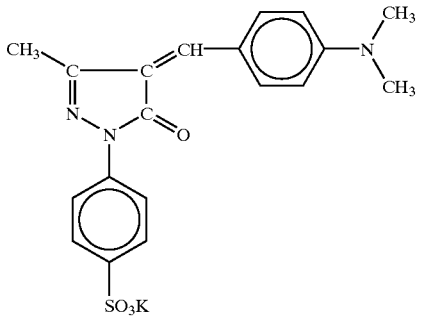

(h-2)

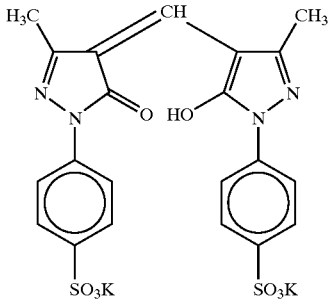

(h-3)

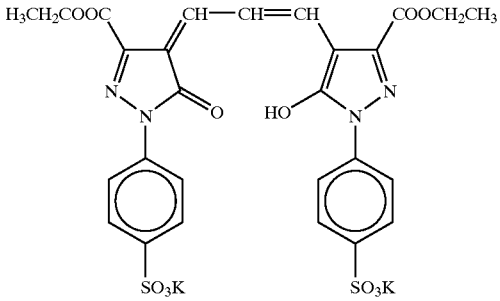

(h-4)

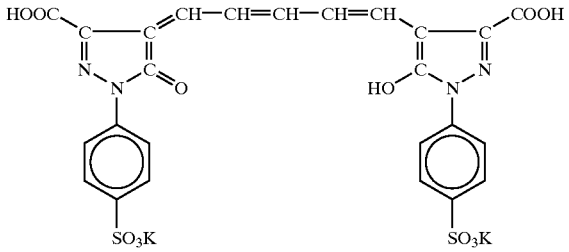

<Back protective layer>

| | |
|---|---|
| Gelatin | 1.1 g/m$^2$ |
| Fine particles of a polymethylmethacrylate (average particle diameter: 2.5 $\mu$m) | 20 mg/m$^2$ |

-continued

<Back protective layer>

| | |
|---|---|
| Sodium p-dodecylbenzenesulfonate | 15 mg/m$^2$ |
| Sodium dihexyl-α-sulfosuccinate | 15 mg/m$^2$ |
| Sodium acetate | 60 mg/m$^2$ |
| Antiseptic agent PROXEL | 1 mg/m$^2$ |

Samples as shown in Table 1 to 3 were made in this manner.

The evaluation was made by the following methods.

The resulting samples were exposed to a tungsten light source from the side of the emulsion surface through a step wedge. Then, using the developer (3) and the fixing solution (1), the processing was carried out using an automatic developing machine FG-710 F (trade name, manufactured by Fuji Photo Film Co., Ltd.).

The sensitivity was shown by a common logarithmic value of an exposure value enabling the density obtained in developing at 35° C. for 30 seconds to have a fog of +0.1, and was defined such that the value of the sample 1 was set to 1 with regard to the samples 1 to 8, the value of the sample 9 was set to 1 with regard to the samples 9 to 16, and the value of the sample 17 was set to 1 with regard to the samples 17 to 25, and the sensitivity was given such that the larger the value was, the higher the sensitivity was. γ was expressed as a value given by the formula: ((1.5−0.3)/log (exposure value giving a density of 1.5)−log(exposure value giving a density of 0.3)). Dmax was expressed as a density at an exposure value of logE+0.5 with respect to a sensitivity point of a density+0.1 on the characteristic curve.

The quality of an image was evaluated by the following method.

1. Evaluation of the Quality of Division-extension Image (1) Production of an Original Using a monochromatic scanner SCANART 30 and a dedicated sensitive material SF-100 (trade names) manufactured by Fuji Photo Film Co., Ltd., a transmission image of a person made of dots and a step wedge in which a dot percentage was gradually changed were formed. At this time, the number of screen lines was made to be 150 lines/inch.

(2) Photographing

The above original was set on a process camera Fine Zoom C-880 (trade name) manufactured by Dainippon Screen Mfg. Co., Ltd. Mfg. Co., Ltd. (a camera-united type automatic developing machine LD-281Q used for processing) in a manner that the magnification of division extension was the same and light was then emitted from a Xe lamp to expose the evaluation sample to the light. At this time, the exposure was run while the exposure value was controlled to be 10% on 90% of the step wedge of the original.

(3) Evaluation

The sample was rated into five ranks from "5" to "1" in order of the level of the reproduction of gradation (resistance to breaking of dots) in the shadow part of the sample in which the dot percentage of the small point side (highlight section) was fixed by controlling the exposure value as described in the above (2). In the rating, the rank "5" shows the best quality and the rank "1" shows the worst quality. The rank "5" or "4" means that the sample is usable, the rank "3" means that the sample is barely usable though it is worse and the rank "2" or "1" means that the sample is unusable.

2. Evaluation of the Quality of Copied Dots (1) Production of an Original

Using a monochromatic scanner SCANART 30 and a dedicated sensitive material SP-100WP (trade names) manufactured by Fuji Photo Film Co., Ltd., a step wedge in which a dot percentage was gradually changed was formed. The number of screen lines in the exposing step was made to be 150 lines/inch.

(2) Photographing

The above original and the sample were set on predetermined positions of a process camera C-690 (Auto Companica) (trade name) manufactured by Dainippon Screen Mfg. Co., Ltd. and the reflecting original was irradiated with light to photograph. At this time, the exposure was run while the exposure value was controlled to be 20% of that of the sample on 80% of the step wedge of the original.

(3) Evaluation

The sample was rated into five ranks from "5" to "1" in order of the level of the reproduction of gradation (resistance to braking of dots) in the shadow part of the sample in which the dot percentage of the small point side was fixed by controlling the exposure time as described in the above (2). In the rating, the rank "5" shows the best quality and the rank "1" shows the worst quality. The rank "5" or "4" means that the sample is usable, the rank "3" means that the sample is barely usable though it is worse and the rank "2" or "1" means that the sample is unusable.

Next, using the developer (3), 20 largest full size sheets (50.8 cm×61 cm) of a Scanner Film HL (trade name) manufactured by Fuji Photo Film Co., Ltd., which was blacken by 20%, were processed a day while a working solution was replenished in an amount by volume of 50 cc per sheet and the running was continuously made for 15 weeks provided that it was made for 6 days a week, to obtain the developer reduced to ⅓ in the density of sulfurous acid on account of the processing of a small number of films. The photographic property 2 is the result obtained by evaluating the sensitivity, γ, Dmax, division extension image quality, and copy dot image quality like the photographic property 1 by using the above solution.

Next, using the developer (3), 300 largest full size sheets (50.8 cm×61 cm) of a Scanner Film HL (trade name) manufactured by Fuji Photo Film Co., Ltd., which was blacken by 80%, were processed a day while a working solution was replenished in an amount by volume of 50 cc per sheet and the running was continuously made for 4 days, to obtain the developer reduced to pH 10.2 and increased in the density of a bromine ion on account of the processing of a large number of films. The photographic property 3 is the result obtained by evaluating the sensitivity, γ, Dmax, division extension image quality, and copy dot image quality as same as the photographic property 1 by using the above developer. The "change in sensitivity" in the photographic properties 2 and 3 shows the variation of the relative sensitivity to the sensitivity of the photographic property 1 of each example.

The results are shown in Tables 1 to 3.

TABLE 1

| | | Photographic property (1) [Developer (3), property processed in new developer] | | | | | Photographic property (2) | | | | |
|---|---|---|---|---|---|---|---|---|---|---|---|
| Sample No. | Redox Compound | Sensitivity | γ | Dmax | Division extension image quality | Copy dot image quality | Change in Sensitivity | γ | Dmax | Division extension image guality | Copy dot image quality |
| 1 | Comparative Compound (A) | 1.0 | 8.6 | 4.6 | 4 | 3 | +0.05 | 7.5 | 4.1 | 3 | 3 |
| 2 | Comparative Compound (B) | 0.92 | 8.0 | 4.3 | 3 | 3 | +0.05 | 7.5 | 3.7 | 3 | 2 |
| 3 | Comparative Compound (C) | 1.05 | 9.2 | 4.8 | 4 | 4 | +0.07 | 8.0 | 4.2 | 3 | 3 |
| 4 | Exemplified Compound (1-2) | 1.12 | 10.9 | 5.2 | 5 | 5 | +0.02 | 10.9 | 5.0 | 5 | 4 |
| 5 | Exemplified Compound (1-7) | 1.07 | 10.9 | 5.0 | 5 | 4 | +0.02 | 10.0 | 4.9 | 5 | 4 |
| 6 | Exemplified Compound (1-1) | 1.20 | 13.3 | 5.4 | 5 | 5 | +0.03 | 13.0 | 5.3 | 5 | 5 |
| 7 | Exemplified Compound (1-12) | 1.15 | 12.0 | 5.1 | 5 | 5 | +0.02 | 13.3 | 5.0 | 5 | 5 |
| 8 | Exemplified Compound (1-8) | 1.24 | 12.0 | 5.3 | 5 | 5 | +0.03 | 12.0 | 5.1 | 5 | 5 |

| | | Photographic property (3) | | | | |
|---|---|---|---|---|---|---|
| Sample No. | Redox Compound | Change in Sensitivity | γ | Dmax | Division extension image quality | Copy dot image quality |
| 1 | Comparative Compound (A) | −0.10 | 7.0 | 4.0 | 3 | 2 |
| 2 | Comparative Compound (B) | −0.08 | 7.0 | 3.5 | 3 | 2 |

TABLE 1-continued

| | | | | | | |
|---|---|---|---|---|---|---|
| 3 | Comparative Compound (C) | −0.08 | 7.5 | 4.0 | 3 | 3 |
| 4 | Exemplified Compound (1-2) | −0.05 | 10.0 | 4.9 | 5 | 4 |
| 5 | Exemplified Compound (1-7) | −0.04 | 10.0 | 4.9 | 5 | 4 |
| 6 | Exemplified Compound (1-1) | −0.04 | 12.0 | 5.2 | 5 | 5 |
| 7 | Exemplified Compound (1-12) | −0.03 | 10.9 | 4.9 | 5 | 5 |
| 8 | Exemplified Compound (1-8) | −0.04 | 10.9 | 5.0 | 5 | 4 |

TABLE 2

| | | Photographic property (1) [Developer (3), property processed in new developer] | | | | | Photographic property (2) | | | | |
|---|---|---|---|---|---|---|---|---|---|---|---|
| Sample No. | Redox Compound | Sensi-tivity | γ | Dmax | Division extension image quality | Copy dot image quality | Change in Sensi-tivity | γ | Dmax | Division extension image guality | Copy dot image quality |
| 9 | Comparative Compound (D) | 1.00 | 8.6 | 4.6 | 4 | 3 | +0.05 | 7.6 | 4.1 | 3 | 3 |
| 10 | Comparative Compound (E) | 0.92 | 8.2 | 4.3 | 3 | 3 | +0.05 | 7.5 | 3.8 | 3 | 2 |
| 11 | Comparative Compound (F) | 1.04 | 8.9 | 4.8 | 4 | 4 | +0.07 | 7.9 | 4.2 | 3 | 3 |
| 12 | Exemplified Compound (2-1) | 1.12 | 10.9 | 5.3 | 5 | 5 | +0.02 | 10.9 | 5.0 | 5 | 4 |
| 13 | Exemplified Compound (2-3) | 1.17 | 11.0 | 5.0 | 5 | 5 | +0.02 | 10.0 | 4.9 | 5 | 4 |
| 14 | Exemplified Compound (2-9) | 1.20 | 13.3 | 5.3 | 5 | 5 | +0.03 | 13.0 | 5.2 | 5 | 5 |
| 15 | Exemplified Compound (2-59) | 1.15 | 11.9 | 5.1 | 5 | 5 | +0.02 | 13.3 | 5.0 | 5 | 5 |
| 16 | Exemplified Compound (2-17) | 1.23 | 12.0 | 5.3 | 5 | 5 | +0.03 | 12.0 | 5.1 | 5 | 5 |

| | | Photographic property (3) | | | | |
|---|---|---|---|---|---|---|
| Sample No. | Redox Compound | Change in Sensi-tivity | γ | Dmax | Division extension image quality | Copy dot image quality |
| 9 | Comparative Compound (D) | −0.10 | 7.0 | 4.0 | 3 | 2 |
| 10 | Comparative Compound (E) | −0.08 | 7.1 | 3.5 | 3 | 2 |
| 11 | Comparative Compound (F) | −0.08 | 7.5 | 4.0 | 3 | 3 |
| 12 | Exemplified Compound (2-1) | −0.05 | 10.9 | 4.9 | 5 | 4 |
| 13 | Exemplified Compound (2-3) | −0.04 | 11.0 | 4.9 | 5 | 4 |
| 14 | Exemplified Compound (2-9) | −0.04 | 12.0 | 5.2 | 5 | 5 |

TABLE 2-continued

| | | | | | | |
|---|---|---|---|---|---|---|
| 15 | Exemplified Compound (2-59) | −0.03 | 10.9 | 4.9 | 5 | 5 |
| 16 | Exemplified Compound (2-17) | −0.04 | 10.9 | 5.0 | 5 | 4 |

TABLE 3

| | | Photographic property (1) [Developer (3), property processed in new developer] | | | | | Photographic property (2) | | | | |
|---|---|---|---|---|---|---|---|---|---|---|---|
| Sample No. | Redox Compound | Sensitivity | γ | Dmax | Division extension image quality | Copy dot image quality | Change in Sensitivity | γ | Dmax | Division extension image guality | Copy dot image quality |
| 17 | Comparative Compound (G) | 1.00 | 8.6 | 4.6 | 4 | 3 | +0.05 | 7.6 | 4.1 | 3 | 3 |
| 18 | Comparative Compound (C) | 0.92 | 8.1 | 4.4 | 3 | 3 | +0.05 | 7.5 | 3.7 | 3 | 2 |
| 19 | Exemplified Compound (3-1) | 1.12 | 11.0 | 5.2 | 5 | 5 | +0.02 | 10.9 | 5.0 | 5 | 5 |
| 20 | Exemplified Compound (3-8) | 1.13 | 10.9 | 5.3 | 5 | 5 | +0.02 | 11.0 | 5.2 | 5 | 5 |
| 21 | Exemplified Compound (3-17) | 1.20 | 13.3 | 5.4 | 5 | 5 | +0.03 | 13.0 | 5.3 | 5 | 5 |
| 22 | Exemplified Compound (3-18) | 1.15 | 12.4 | 5.1 | 5 | 5 | +0.02 | 13.2 | 5.0 | 5 | 5 |
| 23 | Exemplified Compound (3-20) | 1.24 | 12.0 | 5.3 | 5 | 5 | +0.03 | 12.0 | 5.1 | 5 | 5 |
| 24 | Exemplified Compound (3-46) | 1.10 | 10.7 | 4.9 | 4 | 4 | +0.03 | 11.0 | 4.9 | 4 | 4 |
| 25 | Exemplified Compound (3-64) | 0.99 | 9.9 | 4.8 | 4 | 4 | +0.04 | 9.9 | 4.8 | 4 | 4 |

| | | Photographic property (3) | | | | |
|---|---|---|---|---|---|---|
| Sample No. | Redox Compound | Change in Sensitivity | γ | Dmax | Division extension image quality | Copy dot image quality |
| 17 | Comparative Compound (G) | −0.10 | 7.1 | 4.0 | 3 | 2 |
| 18 | Comparative Compound (C) | −0.08 | 7.0 | 3.5 | 3 | 2 |
| 19 | Exemplified Compound (3-1) | −0.05 | 10.0 | 4.9 | 5 | 5 |
| 20 | Exemplified Compound (3-8) | −0.04 | 11.0 | 5.1 | 5 | 5 |
| 21 | Exemplified Compound (3-17) | −0.04 | 12.0 | 5.2 | 5 | 5 |
| 22 | Exemplified Compound (3-18) | −0.03 | 10.9 | 5.0 | 5 | 5 |
| 23 | Exemplified Compound (3-20) | −0.04 | 10.9 | 5.0 | 5 | 4 |
| 24 | Exemplified Compound (3-46) | −0.05 | 10.7 | 4.9 | 4 | 4 |
| 25 | Exemplified Compound (3-64) | −0.06 | 9.0 | 4.2 | 4 | 4 |

As is understood from Tables 1 to 3, the comparative samples No. 1 to 3, No. 9 to 11, and No. 17 and No. 18 have a lower contrast than the samples of the present invention and are not good in division extension and copy dot image quality. Also, the variations of the sensitivity, γ and Dmax between the photographic properties 2 and 3 are larger. On the other hand, the samples No. 4 to 8, No. 12 to 16, and No. 19 to 25 of the present invention have a higher sensitivity, contrast and Dmax than those of the above comparative examples. Also, these samples of the present invention are superior in the division extension and copy dot image quality to those of comparative samples, and the variations between the photographic properties 2 and 3 in the running solution are reduced, showing high stability in processing.

Example 2

Preparation of Emulsion C

Emulsion C was prepared by the following method.

170 cc of an aqueous silver nitrate solution in which 50 g of silver nitrate was dissolved and 170 cc of an aqueous halide solution in which 13 g of potassium bromide and 9 g of sodium chloride were dissolved and $(NH_4)_2RhCl_5(H_2O)$ and $K_3IrCl_6$ were included in amounts equivalent to $7\times10^{-8}$ mol and $7\times10^{-8}$ mol respectively per 1 mol of silver of a total emulsion, were added to an aqueous 2% gelatin solution, in which 4 g of sodium chloride, 0.02 g of 1,3-dimethyl-2-imidazolithion, 0.5 g of citric acid, 8 mg of sodium benzenethiosulfonate, and 2 mg of sodium benzenesulfinate were dissolved in 1 liter of water, at 38° C. for 8 minutes with stirring by using a double jet method to obtain particles of silver chlorobromide having an average particle size of 0.16 μm and containing silver chloride in a content of 55 mol % thereby forming a nuclei. In succession, 450 cc of an aqueous silver nitrate solution in which 107 g of silver nitrate was dissolved and 450 cc of an aqueous halide solution in which 28 g of potassium bromide and 28 g of sodium chloride were dissolved and potassium hexacyano iron (II) acid salt was included in an amount equivalent to $1\times10^{-5}$ mol per 1 mol of silver of a total emulsion were added to the resulting solution over 20 minutes by using a double jet method. Further, 80 cc of an aqueous silver nitrate solution in which 25 g of silver nitrate was dissolved and 80 cc of an aqueous halide solution in which 7 g of potassium bromide and 5 g of sodium chloride were dissolved and $(NH_4)_2RhCl_5(H_2O)$ and $K_3IrCl_6$ were included in amounts equivalent to $3\times10^{-8}$ mol and $3\times10^{-8}$ mol respectively per 1 mol of silver of a total emulsion was added to the resulting solution over 4 minutes by using a double jet method.

Thereafter, a KI solution was added in an amount of $1\times10^{-3}$ mol per 1 mol of silver to carry out conversion, followed by washing with water by a flocculation method according to the usual method. Then, a gelatin was added in an amount of 40 g per 1 mol of silver and the resulting mixture was adjusted to pH 6.0 and pAg 7.5. Thereafter 8 mg of sodium benzenethiosulfonate, 2 mg of sodium benzenesulfinate, 5 mg of sodium thiosulfate and 8 mg of chloroauric acid, per 1 mol of silver, were further added to the resulting mixture, which was then heated at 60° C. for 60 minutes to carry out a chemical sensitization operation. After that, 150 mg of 4-hydroxy-6-methyl-1,3,3a,7-tetrazaindene as a stabilizer and 100 mg of PROXEL as an antiseptic agent were added. The resulting particles were cubic particles of silver iodochlorobromide having an average particle size of 0.26 μm and containing silver chloride in a content of 60 mol % (coefficient of variation: 10%).

Samples were prepared in the same manner as in Example 1 except that Emulsion C was used in place of Emulsion A and evaluated to find that each sample according to the present invention had high sensitivity, contrast, and Dmax, and also exhibited stable photographic property even if the running solution was used, like the results of Example 1 shown in Tables 1 to 3.

Example 3

Preparation of Coating Solution for Hydrazine-containing Layer Emulsion

To Emulsion A used in Example 1 were added $5\times10^{-4}$ mol of a compound represented by the structural formula (s-2) as a sensitizing dye and further $5\times10^{-4}$ mol of a short wave cyanine dye represented by the structural formula (s-3), $2\times10^{-4}$ mol of 1-phenyl-5-mercaptotetrazole, $5\times10^{-4}$ mol of a mercapto compound represented by the aforementioned structural formula (a) and a mercapto compound represented by the aforementioned structural formula (b), $2\times10^{-4}$ mol of a triazine compound represented by the structural formula (c), $5\times10^{-4}$ mol of 5-chloro-8-hydroxyquinoline, $5\times10^{-4}$ mol of a hydrazine compound represented by the aforementioned structural formula (D-66) and $5\times10^{-4}$ mol of a compound represented by the aforementioned structural formula (F-25) as a nucleation accelerator, per 1 mol of silver. Furthermore, a sodium N-oleyl-N-methyltaurate, colloidal silica (Snowtex C (trade name), manufactured by Nissan Chemical Industries, Ltd.), a dispersion of polyethylacrylate, and a dispersion of a core/shell type latex (core: styrene/butadiene copolymer (weight ratio: 37/63), shell: styrene/2-acetoacetoxyethylmethacrylate (weight ratio: 84/16), core/shell ratio: 50/50) were added such that these compounds were coated in amounts of 20 mg/m$^2$, 500 mg/m$^2$, 250 mg/m$^2$ and 250 mg/m$^2$ respectively to prepare a coating solution for a hydrazine-containing layer. The pH of the solution was adjusted to 5.9.

Preparation of Coating Solution for Redox Compound-containing Layer Emulsion To Emulsion B were added $2\times10^{-4}$ mol of a compound represented by the aforementioned structural formula (s-2) as a sensitizing dye and further $5\times10^{-4}$ mol of a mercapto compound represented by the aforementioned structural formula (b), $5\times10^{-4}$ mol of a triazine compound represented by the structural formula (c), and $5\times10^{-4}$ mol of 5-chlor-8-hydroxyquinoline, per 1 mol of silver of a redox compound-containing layer emulsion. Moreover, a dye represented by the aforementioned structural formula (e), a dispersion of a polyethyl acrylate, a core/shell type latex (core: styrene/butadiene copolymer (weight ratio: 37/63), shell: styrene/2-acetoacetoxyethylmethacrylate (weight ratio: 84/16), core/shell ratio: 50/50), and 1,2-bis(vinylsulfonylacetamide) ethane as a hardening agent such that these compounds were applied in amounts of 10 mg/m$^2$, 150 mg/m$^2$, 150 mg/m$^2$, and 30 mg/m$^2$ respectively. As the redox compound defined in the present invention, the exemplified compound (1-1), (2-1) or (3-1) was added in an amount of $8.1\times10^{-3}$ mol/mol-Ag based on total silver in a light-sensitive material to prepare a coating solution for a redox compound-containing layer emulsion. An emulsified redox compound was dissolved and added to the coating solution. The pH of the solution was adjusted to 5.8.

(S-2)

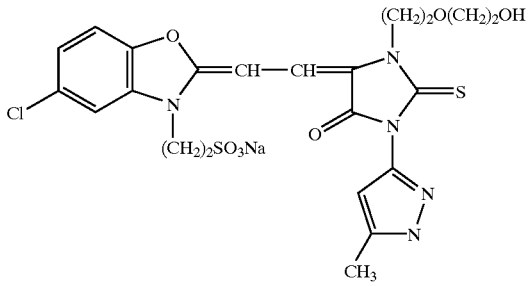

(S-3)

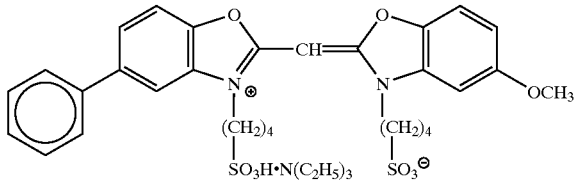

Preparation of Light-sensitive Material Samples

Then, on a polyethylene terephthalate film of which both surfaces were undercoated by a moisture-proofing layer composed of vinylidene chloride, 0.3 g/m$^2$ of a gelatin layer was formed as the lowest layer. Also, a redox compound-containing layer (0.5 g/m$^2$ of Ag and 0.5 g/m$^2$ of a gelatin) was formed on the gelatin layer through a hydrazine-containing layer (3.5 g/m$^2$ of Ag and 1.7 g/m$^2$ of a gelatin) and the interlayer (0.5 g/m$^2$ of a gelatin) of Example 1. Further, 0.2 g/m$^2$ of a gelatin as a protective layer, 50 mg/m$^2$ of an $SiO_2$ matting agent having an undefined shape and an average particle size of about 3.5 $\mu$m, 0.1 g/m$^2$ of colloidal silica (Snowtex C (trade name) manufactured by Nissan Chemical Industries, Ltd.), 50 g/m$^2$ of a liquid paraffin, 2 mg/m$^2$ of a fluoro-surfactant and 20 mg/m$^2$ of sodium p-dodecylbenzenesulfonate, as coating aids, were applied to the redox compound-containing layer. At this time, to the lowest gelatin layer, a dispersion of a polyethylacrylate was added in the same amount as the gelatin and bis (vinylsulfonyl)methane was added such that it was applied in an amount of 40 mg/m$^2$. The pH of the film surface of the resulting samples were 5.6 to 5.9.

Also, the back layer was formed using the following composition.

| <Back layer> | |
|---|---|
| Gelatin | 2.8 g/m$^2$ |
| Surfactants: | |
| Sodium p-dodecylbenzenesulfonate | 40 mg/m$^2$ |
| Sodium dihexyl-α-sulfosuccinate | 40 mg/m$^2$ |
| Gelatin hardening agent: | |
| 1,2-bis(vinylsulfonylacetamide)ethane | 200 mg/m$^2$ |
| Dye (h-1) | 20 mg/m$^2$ |
| Dye (h-2) | 50 mg/m$^2$ |
| Dye (h-3) | 20 mg/m$^2$ |
| Dye (h-4) | 30 mg/m$^2$ |
| Antiseptic agent (PROXEL) | 10 mg/m$^2$ |

A back protective layer was coated in the same method as in Example 1.

The obtained samples were evaluated in the same methods as in Example 1 and, as a result, each sample of the present invention had high sensitivity, contrast and Dmax and also exhibited stable photographic property even if the running solution was used, like the results of Example 1 shown in Tables 1 to 3.

Example 4

The evaluation of the photographic property was made in the same manner as in Example 1 except that the solid developer (developer (2)) and the solid fixing agent (fixing solution (2)) were used to find that each sample of the present invention had high sensitivity, contrast and Dmax and exhibited stable photographic property, even if the running solution was used, like the results of Example 1 shown in Tables 1 to 3.

Example 5

The evaluation of the photographic property was made in the same manner as in Example 1 except that the developer (1) and the fixing solution (1) were used to find that each sample of the present invention had high sensitivity, contrast and Dmax and exhibited stable photographic property, even if the running solution was used, like the results of Example 1 shown in Tables 1 to 3

Example 6

Samples were made in the same manner as in Example 1 except that the compound of (D-67) and the accelerator (F-30) were used in place of the hydrazine compound (D-66) and the accelerator (F-25) respectively and the evaluation of the photographic property was made in the same manner as in Example 1 to find that each sample of the present invention had high sensitivity, contrast and Dmax and exhibited stable photographic property, even if the running solution was used, like the results of Example 1 shown in Tables 1 to 3.

Example 7

Samples were made in the same manner as in the case of the samples No. 17 to No. 25 obtained in Examples 1 to 6 except that a solid dispersion of the redox compound was prepared and added by the method described below and the evaluation of the photographic property was made to find that each sample of the present invention had high sensitivity, contrast and Dmax and exhibited stable photographic property, even if the running solution was used, like the results of Example 1 shown in Table 3.

Method of the Preparation of the Solid Dispersion 2.5 g of a polyvinyl alcohol (PVA-217 (trade name), manufactured by Kuraray Co., Ltd.) and 87.5 g of water were added to 5 g of a redox compound and the mixture was sufficiently stirred to form a slurry, which was then allowed to stand for 3 hours. Thereafter, 240 g of 0.5-mm-diameter zirconia beads was prepared and was poured into a vessel together with the slurry. The slurry was dispersed using a dispersion machine (1/16G sand grinder mill: manufactured by Imex Co.) for 10 hours to prepare a solid fine particle dispersion. 80 wt % of the particles had a particle diameter of 0.1 $\mu$m to 1.0 $\mu$m and the average particle diameter was 0.5 $\mu$m.

Example 8

Samples were made in the same manner as in the case of the samples No. 17 to No. 25 obtained in Examples 1 to 6 except that an emulsified dispersion of the redox compound was prepared and added, and the evaluation of the photo graphic property was made to find that each sample of the present invention had high sensitivity, contrast and Dmax and exhibited stable photographic property, even if the running solution was used, like the results of Example 1 shown in Table 3.

except that a quaternary onium salt or a comparative compound was used in place of the nucleation accelerator represented by the structural formula (F-25) in an amount shown in Table 4.

Comparative compound (I)

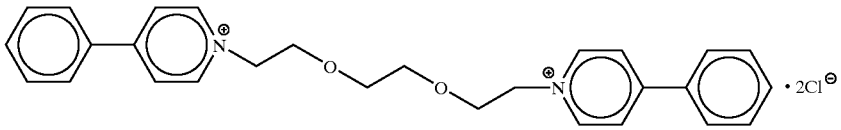

(Compound A-211 disclosed in JP-A-7-261310)

Method of the Preparation of the Emulsified Dispersion

A solution consisting of 4 g of a redox compound, 6.0 g of a poly(N-tert-butylacrylamide) and 50 ml of ethyl acetate was heated to 60° C. and dissolved, and then added to 120 ml of an aqueous solution containing 12 g of a gelatin and 0.7 g of sodium dodecylbenzenesulfonate. The mixture was finely dispersed using a high-speed stirrer (homogenizer, manufactured by Nippon Seiki Seisakusho) to prepare a fine particle emulsified dispersion having an average particle diameter of 0.3 $\mu$m. To this dispersion were added PROXEL as an antiseptic agent in an amount of 2000 ppm on the basis of the gelatin. Finally the resulting dispersion was adjusted to pH 5.0 by addition of ascorbic acid to thereby prepare an emulsified dispersion.

Example 9

Preparation of Coated Samples

Each layer was coated on a support of a polyethylene terephthalate film of which both surfaces were undercoated by a moisture-proofing layer containing vinyl idene chloride so as to have a structure of UL layer/hydrazine-containing EM layer/interlayer/redox compound-containing EM layer/protective layer to make samples.

A method of the preparation of each layer and the amount of each layer to be coated are shown below.

The resulting coating solution of an silver halide emulsion was coated such that the amount of silver was 3.4 g/m$^2$ and the amount of a gelatin was 1.6 g/m$^2$.

(Interlayer)

Preparation of Coating Solution for Interlayer

A coating solution for an interlayer was prepared in the same manner as in Example 1. The pH of the solution was adjusted to 7.0.

An interlayer was coated such that the amount of a gelatin was 1.0 g/ m$^2$.

(Redox Compound-containing EM Layer)

Preparation of Coating Solution for Redox Compound-containing Layer Emulsion

A coating solution for a redox compound-containing layer emulsion was prepared in the same manner as in Example 1 except that the redox compound or the comparative compound shown in Table 4 in place of the exemplified compound or the comparative compound shown in Tables 1 to 3 in the amount shown in Table 4. The pH of the solution was adjusted to 5.6.

Comparative compound (J)

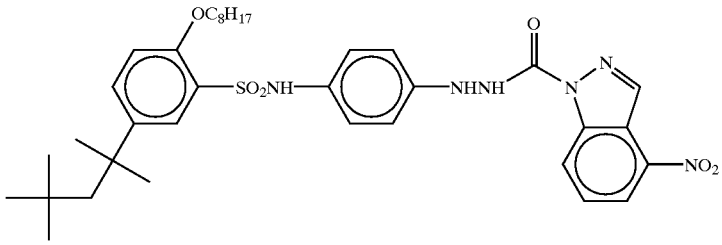

(Compound I-40 disclosed in JP-A-7-261310)

(UL Layer)

As a UL layer, 0.3 g/m$^2$of a gelatin, 0.25 gm$^2$ of a polyethylacrylate, and 50 mg/m$^2$ of 1,2-bis(vinylsulfonylacetamide)ethane as a hardening agent were coated.

(Hydrazine-containing EM Layer)

Preparation of Coating Solution for Hydrazine-containing Layer Emulsion

A coating solution for a hydrazine-containing layer emulsion was prepared in the same manner as in Example 1

When the redox compound was added, an emulsified redox compound prepared in the same manner as in Example 1 was dissolved at 60° C. and added to the coating solution.

The resulting coating solution for a redox compound-containing emulsion was coated such that the amount of silver was 0.3 g/m$^2$ and the amount of a gelatin was 0.3 g/m$^2$.

(Protective Layer)

0.2 g/m$^2$ of a gelatin, 50 mg/m$^2$ of an $SiO_2$ matting agent having an undefined shape and an average particle size of about 3.5 $\mu$m, 60 mg/m$^2$ of colloidal silica (Snowtex C (trade name) manufactured by Nissan Chemical Industries, Ltd.), 50 mg/m$^2$ of liquid paraffin, and 1 mg/m$^2$ of a fluorosurfactant represented by the structural formula (g) shown in Example 1 and 10 mg/m$^2$ of sodium p-dodecylbenzenesulfonate, as coating aids, were coated.

In this manner, samples were made by coating so as to have a structure comprising 5 layers, namely, UL layer/hydrazine-containing EM layer/interlayer/redox compound-containing EM layer/protective layer.

The pH of the film surface of the resulting samples were 5.5 to 5.8.

In addition, the back layer and the back protective layer were applied in the same formulations as in Example 1.

Thus, samples were made as shown in Table 4.

The samples were evaluated by the following methods.

The resulting sample was exposed to the light emitted from a tungsten light source in such a condition that a 150 lines/inch contact screen gray scanner negative No. 2 (manufactured by Dainippon Screen Mfg. Co., Ltd.) was brought into contact with the emulsion surface intimately.

Then, using the developer (3) and the fixing solution (1), the sample was treated at 35° C. for 30 seconds in terms of a developing time in an automatic developing machine FG-710F (trade name, manufactured by Fuji Photo Film Co., Ltd.).

The dot gradation (logarithmic notation of the ratio of an exposure value giving 95% dot area to an exposure value giving 5% dot area) of the resulting dot image was measured. An increase in the value shows that the latitude to exposure is wider and the reproduction of an image is better.

In addition, the dot was observed by a magnifier with a magnifying power of 100 to evaluate the quality of the formed dot.

The level "5" shows that the density of the dot is high and the sharpness of edge is better whereas the level "1" shows that the dot is reduced in contrast and sharpness. The level "3" shows a level of a dot quality practicable for an original of a photographic process. $\gamma$ is shown as the value given by the formula: ((1.5−0.3)/log (exposure value giving a density of 1.5)−log (exposure value giving a density of 0.3)).

The image quality of a copy dot was evaluated by the following method.

1. Evaluation of a Copy Dot (1) Production of an Original

Using a monochromatic scanner SCANART 30 and a dedicated sensitive material SP-100WP (trade name) manufactured by Fuji Photo Film Co., Ltd., a step wedge in which a dot percentage was gradually changed was formed. The number of screen lines was made to be 150 lines/inch during exposure.

(2) Photographing

The above original and the sample were set on a process camera C-690 (Autocompanica) (trade name) manufactured by Dainippon Screen Mfg. Co., Ltd. to apply light to the reflecting original thereby photographing. At this time, the exposure was run while the exposure value was controlled so as to be 20% of that of the sample on 80% of the step wedge of the original. Then, using the aforementioned developer (3) and the fixing solution (1), the sample was processed at 35° C. for 30 seconds in terms of a developing time by an automatic developing machine FG-710F (trade name, manufactured by Fuji Photo Film Co., Ltd.).

(3) Evaluation

The sample was rated into five ranks from "5" to "1" in order of the level of the reproduction of gradation (resistance to the breaking of dots) in the shadow part of the sample in which the dot percentage of the small point side was fixed by controlling the exposure time as described in the above (2). In the rating, the rank "5" shows the best quality and the rank "1" shows the worst quality. The rank "5" or "4" means that the sample is usable, the rank "3" means that the sample is barely usable though it is worse and the rank "2" or "1" means that the sample is unusable.

The obtained results are shown in Table 4. The samples using the quaternary salt compound represented by each of the formulae (a) to (f) and the redox compound represented by each of the formulae (1) to (3) have long dot gradation and better dot quality. It is also found that the copy dot is resistant to breaking in the shadow part and exhibits good reproduction over a range from a large dot to a small dot and hence the sample has a wide latitude.

TABLE 4

| Sample | Quaternary onium salt compound | | Redox compound | | Dot | Dot | Copy dot image | |
|---|---|---|---|---|---|---|---|---|
| No. | No. | mol/m$^2$ | No. | mol/m$^2$ | gradation | qualitiy | quality | Remarks |
| 26 | — | 0 | — | 0 | 1.20 | 2 | 2 | Comparative example |
| 27 | (3) | $1.2 \times 10^{-5}$ | — | 0 | 1.21 | 4 | 2 | Comparative example |
| 28 | — | 0 | R-1 | $1.5 \times 10^{-4}$ | 1.24 | 2 | 3 | Reference example |
| 29 | Comparative compound (I) | $1.2 \times 10^{-5}$ | Comparative compound (J) | $1.5 \times 10^{-4}$ | 1.30 | 3 | 3 | Comparative example |
| 30 | Comparative compound (I) | $1.2 \times 10^{-5}$ | R-1 | $1.5 \times 10^{-4}$ | 1.32 | 3 | 3 | Reference example |
| 31 | (3) | $1.2 \times 10^{-5}$ | Comparative compound (J) | $1.5 \times 10^{-4}$ | 1.30 | 3 | 3 | Comparative example |
| 32 | (3) | $1.2 \times 10^{-5}$ | R-1 | $1.5 \times 10^{-4}$ | 1.42 | 5 | 5 | This invention |
| 33 | (4) | $1.2 \times 10^{-5}$ | R-1 | $1.5 \times 10^{-4}$ | 1.42 | 5 | 5 | This invention |
| 34 | (6) | $1.2 \times 10^{-5}$ | R-1 | $1.5 \times 10^{-4}$ | 1.40 | 5 | 5 | This invention |
| 35 | (50) | $1.2 \times 10^{-5}$ | R-1 | $1.5 \times 10^{-4}$ | 1.40 | 5 | 5 | This invention |

TABLE 4-continued

| Sample | Quaternary onium salt compound | | Redox compound | | Dot | Dot | Copy dot image | |
|---|---|---|---|---|---|---|---|---|
| No. | No. | mol/m$^2$ | No. | mol/m$^2$ | gradation | qualitiy | quality | Remarks |
| 36 | (51) | $1.2 \times 10^{-5}$ | R-1 | $1.5 \times 10^{-4}$ | 1.38 | 5 | 5 | This invention |
| 37 | (3) | $1.2 \times 10^{-5}$ | R-2 | $1.5 \times 10^{-4}$ | 1.40 | 5 | 5 | This invention |
| 38 | (3) | $1.2 \times 10^{-5}$ | R-21 | $1.5 \times 10^{-4}$ | 1.39 | 5 | 5 | This invention |
| 39 | (3) | $1.2 \times 10^{-5}$ | R-22 | $1.5 \times 10^{-4}$ | 1.38 | 4 | 5 | This invention |
| 40 | (3) | $1.2 \times 10^{-5}$ | R-48 | $1.5 \times 10^{-4}$ | 1.37 | 5 | 4 | This invention |

Example 10

The evaluation of the photographic property was made in the same manner as in Example 9 except that the solid developer (developer (2)) and the solid fixing agent (fixing solution (2)) were used to find that the samples using the quaternary salt compound represented by each of the formulae (a) to (f) and the redox compound represented by each of the formulae (1) to (3) exhibited good performance like the Example 9.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material comprising at least one compound selected from the group consisting of compounds represented by formulas (1), (2) and (3):

formula (1)

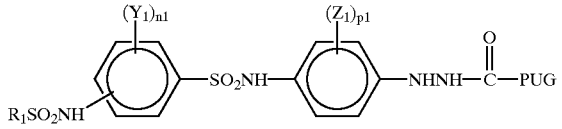

wherein $R_1$ represents a phenyl group having at least one electron-withdrawing group as a substituent, or aromatic heterocyclic or aliphatic group, provided that when $R_1$ is an alkyl group, it does not contain 4 or more repeating units of an ethyleneoxy group, PUG represents a residue of a development inhibitor, $Y_1$ and Z, respectively represent a substituent which is substitutable on a benzene ring, and n1 and p1 denote integers from 0 to 4;

formula (2)

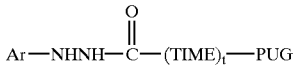

wherein Ar represents an aryl group or an aromatic heterocyclic group, PUG represents a residue of a development inhibitor, TIME represents a timing group and t denotes 0 or 1, wherein the group represented by Ar is substituted directly or indirectly by at least one dissociating group;

formula (3)

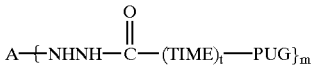

wherein A represents a connecting group, m denotes an integer from 2 to 6, PUG represents a residue of a development inhibitor, TIME represents a timing group and t denotes 0 or 1.

2. The silver halide photographic light-sensitive material as claimed in claim 1, comprising at least one compound represented by the formula (1).

3. The silver halide photographic light-sensitive material as claimed in claim 2, wherein $R_1$ in the formula (1) is a phenyl group having at least one electron-withdrawing group as a substituent.

4. The silver halide photographic light-sensitive material as claimed in claim 2, wherein the compound represented by the formula (1) has, as a substituent, at least one ballasting group or an (alkyl, aryl or heterocyclic)thio group.

5. The silver halide photographic light-sensitive material as claimed in claim 1, comprising at least one redox compound represented by the formula (2).

6. The silver halide photographic light-sensitive material as claimed in claim 5, wherein the redox compound represented by the formula (2) is represented by the following formula (2-1):

formula (2-1)

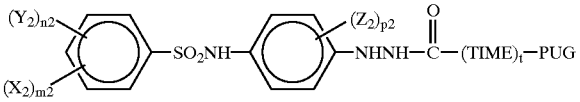

wherein TIME, t, and PUG respectively have the same meaning as those in the formula (2), $X_2$ represents a dissociating group or a substituent containing at least one dissociating group, $Y_2$ and $Z_2$ respectively represent a substituent which is substitutable on a benzene ring, m2 denotes an integer from 1 to 5, n2 and p2 denote integers from 0 to 4, provided that the sum of m2 and n2 does not exceed 5 and when $X_2$ includes a sulfo group (—$SO_3H$) or its salt, it does not contain a pyridinio group as a substituent at the same time.

7. The silver halide photographic light-sensitive material as claimed in claim 6, wherein the dissociating group in the formula (2-1) is selected from the group consisting of a carboxy group (—COOH), a sulfo group (—$SO_3H$), —$SO_2NH_2$, —$SO_2NHCO$—, —$SO_2NHCONH$—, —$NHSO_2NHCO$—, —CONHCO—, —$SO_2NHSO_2$—, and salts of these.

8. The silver halide photographic light-sensitive material as claimed in claim 5, wherein the redox compound represented by the formula (2) contains at least one ballasting group as a substituent.

9. The silver halide photographic light-sensitive material as claimed in claim 6, wherein at least one group represented by $X_2$ or $Y_2$ in the formula (2-1) is a ballasting group or a substituent substituted with a ballasting group.

10. The silver halide photographic light-sensitive material as claimed in claim 5, wherein the redox compound represented by the formula (2) contains at least one alkylthio group, arylthio group or heterocyclic thio group as a substituent.

11. The silver halide photographic light-sensitive material as claimed in claim 6, wherein at least one group represented by $X_2$ or $Y_2$ in the formula (2-1) is a substituent substituted with an alkylthio group, an arylthio group or a heterocyclic thio group.

12. The silver halide photographic light-sensitive material as claimed in claim 1, comprising at least one redox compound represented by the formula (3).

13. The silver halide photographic light-sensitive material as claimed in claim 12, wherein the redox compound represented by the formula (3) is represented by the following formula (3-1) or (3-2):

formula (3-1)

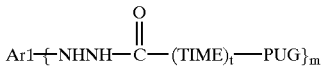

formula (3-2)

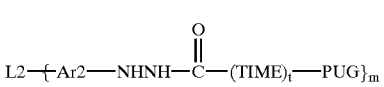

wherein Ar1 represents an m-valent aromatic or aromatic heterocyclic group, Ar2 represents a divalent aromatic or aromatic heterocyclic group, L2 represents an m-valent connecting group, and PUG, TIME, t and m respectively have the same meaning as those in the formula (3).

14. The silver halide photographic light-sensitive material as claimed in claim 13, wherein the redox compound represented by the formula (3-2) is represented by the following formula (3-3) or (3-4):

formula (3-3)

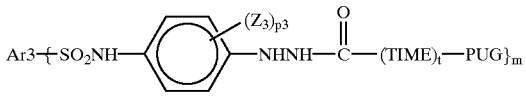

formula (3-4)

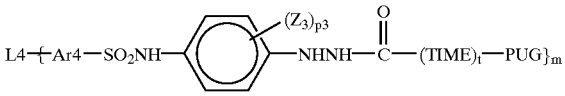

wherein Ar3 represents an m-valent aromatic or aromatic heterocyclic group, Ar4 represents a divalent aromatic or aromatic heterocyclic group, L4 represents an m-valent connecting group, TIME, t, PUG and m respectively have the same meaning as those in the formula (3), $Z_3$ represents a substituent which is substitutable on a benzene ring, and p3 denotes an integer from 0 to 4.

15. The silver halide photographic light-sensitive material as claimed in claim 12, wherein the redox compound is made to be contained by solid dispersion or polymer dispersion.

16. The silver halide photographic light-sensitive material as claimed in claim 1, comprising at least one nucleating agent.

17. The silver halide photographic light-sensitive material as claimed in claim 16, comprising at least one nucleation accelerator.

18. The silver halide photographic light-sensitive material as claimed in claim 17, comprising at least one quaternary salt compound represented by the formula (a), (b), (c), (d), (e) or (f):

formula (a)

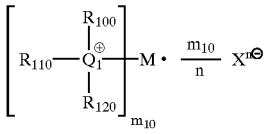

formula (b)

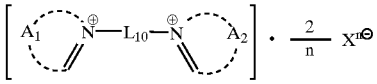

formula (c)

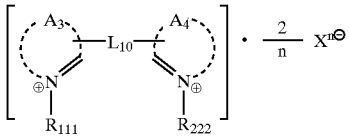

formula (d)

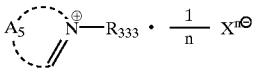

in the formula (a), $Q_1$represents a nitrogen atom or a phosphorous atom, $R_{100}$, $R_{110}$ and $R_{120}$ respectively represent an aliphatic group, an aromatic group or a heterocyclic group and may be combined to form a ring structure, and M represents an mlo-valent organic group which is combined with $Q_1^+$ by a carbon atom contained in M wherein $m_{10}$denotes an integer from 1 to 4;

in the formula (b), (c) or (d), $A_1$, $A_2$, $A_3$, $A_4$ and $A_5$ respectively represent an organic residue for forming an unsaturated hetero ring containing a quaternary nitrogen atom, $L_{10}$ and $L_{20}$ respectively represent a divalent connecting group and $R_{111}$, $R_{222}$ and $R_{333}$ respectively represent a substituent;

the quaternary salt compound represented by the formula (a), (b), (c) or (d) has, in its molecule, 20 or more of total repeating units of an ethyleneoxy group or propyleneoxy group, and these repeating units may be substituted on over plural positions;

formula (e)

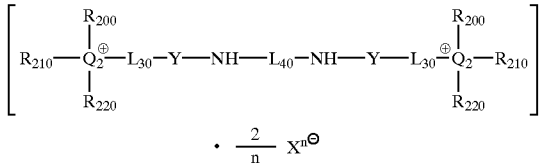

formula (f)

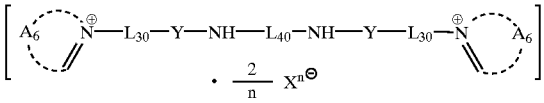

in the formula (e), $Q_2$ represents a nitrogen atom or a phosphorous atom, $R_{200}$, $R_{210}$ and $R_{220}$ respectively represent the same groups as defined for $R_{100}$, $R_{110}$ and $R_{120}$ in the formula (a) respectively;

in the formula (f), $A_6$ represents the same groups as defined for $A_1$ or $A_2$ in the formula (b) provided that the nitrogen-containing unsaturated hetero ring which $A_6$ forms may have a substituent but does not contain a primary hydroxyl group on the substituent;

in the formulae (e) and (f), $L_{30}$ represents an alkylene group, Y represents —C(=O)— or —$SO_2$—, $L_{40}$ represents a divalent connecting group having at least one hydrophilic group;

in the formulae (a) to (f), $X^{n-}$ represents an n-valent counter anion where n denotes an integer from 1 to 3, provided that when an anionic group is contained besides in the molecule and forms an intermolecular salt with $Q_1^+$, $Q_2^+$ or $N^+$, $X^{n-}$ can be omitted.

19. The silver halide photographic light-sensitive material as claimed in claim 18, comprising at least one compound represented by the formula (1), and at least one quaternary salt compound represented by the formula (b) or (f).

20. A processing method of a silver halide photographic light-sensitive material, comprising developing the silver halide photographic light-sensitive material as claimed in claim 1 by using a developer having a pH of 9.0 to 11.0 after the light-sensitive material is subjected to image exposure.

21. The silver halide photographic light-sensitive material as claimed in claim 16, wherein the nucleating agent is a hydrazine derivative represented by the following formula (D):

formula (D)

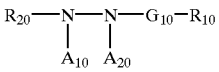

wherein $R_{20}$ represents an aliphatic group, an aromatic group, or a heterocyclic group, $R_{10}$ represents a hydrogen atom or a blocking group, $G_{10}$ represents a —CO—, —COCO—, —C(=S)—, —$SO_2$—, —SO—, —PO($R_{30}$)—, or an iminomethylene group, $R_{30}$ represents a hydrogen atom or a blocking group and may be the same as or different from $R_{10}$, $A_{10}$ and $A_{20}$ each represent a hydrogen atom or one of them is a hydrogen atom and the other is a substituted or unsubstituted alkylsulfonyl group, a substituted or unsubstituted arylsulfonyl group, or a substituted or unsubstituted acyl group.

* * * * *